US006702046B2

(12) United States Patent
Webb et al.

(10) Patent No.: US 6,702,046 B2
(45) Date of Patent: Mar. 9, 2004

(54) DRILL DEVICE FOR A DRILLING APPARATUS

(76) Inventors: Charles T. Webb, 1631 Greenview Ct., Aledo, TX (US) 76008; Roy L. Chandler, 1814 Dogwood Dr., Arlington, TX (US) 76102

( * ) Notice: Subject to any disclaimer, the term of this patent is extended or adjusted under 35 U.S.C. 154(b) by 0 days.

(21) Appl. No.: 10/147,160

(22) Filed: May 16, 2002

(65) Prior Publication Data

US 2002/0139586 A1 Oct. 3, 2002

Related U.S. Application Data

(63) Continuation-in-part of application No. 09/912,977, filed on Jul. 25, 2001, now Pat. No. 6,401,842.
(60) Provisional application No. 60/221,413, filed on Jul. 28, 2000.

(51) Int. Cl.[7] ..... E21B 10/62
(52) U.S. Cl. ..... 175/412; 175/53; 175/325.1
(58) Field of Search ..... 175/53, 73, 74, 175/325.1, 325.3, 325.5, 412, 413, 391

(56) References Cited

U.S. PATENT DOCUMENTS

| | | | | |
|---|---|---|---|---|
| 4,040,494 A | | 8/1977 | Kellner | |
| 4,281,723 A | | 8/1981 | Edmond et al. | |
| 4,732,223 A | | 3/1988 | Schoeffler | |
| 4,953,638 A | | 9/1990 | Dunn | |
| 5,423,388 A | | 6/1995 | Hale | |
| 5,490,569 A | | 2/1996 | Brotherton et al. | |
| 5,957,222 A | | 9/1999 | Webb et al. | |
| 6,050,350 A | | 4/2000 | Morris et al. | |
| 6,082,470 A | | 7/2000 | Webb et al. | |
| 6,227,312 B1 | * | 5/2001 | Eppink et al. | 175/57 |

* cited by examiner

*Primary Examiner*—Zakiya Walker
(74) *Attorney, Agent, or Firm*—Geoffrey A. Mantooth; Arthur F. Zobal

(57) ABSTRACT

The drill device has a body with a front end and a rear end and which is connectable to the shaft of a drilling apparatus. A plurality of angularly spaced apart slots are formed in the exterior of the device which extend between the front and rear ends. Each slot has a lip extending from each of its front and rear ends respectively. A cutting member is provided for each of the slots with each cutting member having a connecting portion located in one of the slots and having a forward end and a rearward. Each connecting portion has a hook near its front and rear ends respectively for connection to the lips of the slot in which it is located.

8 Claims, 41 Drawing Sheets

105
155
157
159
101F
161
163P
177B
167
171
101R
173
165
177A
163
163P
159
101S
169
175
175D 113
119R
133
119
119A
24
24
131
129
159
179
179
111
135
127
117
115
101F
157

101R
149
151
121
121A
153
171
167
179
169
167B
145
141
123
177A
165
25
25
163L
163S
163
163P
161
101

177BL
177B
145A

177BL
177B
145A

177BL
145AD
177B

145AC
145C
145AC
177AL
177A
177B
177BL
177B 145C
177B
177A 145C
177BL
145B
177AL
177B
177A 145C
177B
177BL

177BL
145D
177B

145DE
177BL 177B
145E

177BL
177B
177BL
145CE 177B
145B
177BL
177B
145AB
177BL

177B

177BL
145A
145AC
145AB 177B
177BL
145AD

177B

177BL
177AL
177A
145M
145B
177B
145M 145B
177BL
145B
177AL
177A
145B
177B 145B
177BL
145B
177AL
177A 145B
177AL
177B
145B
177BL
177A
177B

177BL
145C
177B

177BL
145C
177B

177BL
145C
177B 147
171T
153R
149
153P
147L
153C
147P
147C
113
153S
153

147
171T
153R
149
147L
153C
153RH
153P
147C
113
147P
153S
153

105D
105B
105S
105R
105F
105C
155P
155L
155L
155H
155D
155D 119R
113
131
119A
119A
119
135
137B
159
183
67
67
129D
111
129
117
127
117
115
101F
157

185
129
187
137B
183
185
137B
129D
111
101F
185
129
187

203R
211
219
201
209
203F
245
243
80
81
82
83

DRILL DEVICE FOR A DRILLING APPARATUS

This application is a continuation-in-part of U.S. application Ser. No. 09/912,977, filed Jul. 25, 2001, now U.S. Pat. No. 6,401,842, which claims the benefit of U.S. Provisional Patent Application No. 60/221,413, filed Jul. 28, 2000.

BACKGROUND OF THE INVENTION

1. Field of the Invention

The invention relates to a drill device for a drilling a hole in the earth.

2. Description of the Prior Art

U.S. Pat. Nos. 4,281,723, 4,953,638, 5,423,388, 5,490,569, 5,957,222, 6,050,350, and 6,082,470 disclose drilling apparatus.

SUMMARY OF THE INVENTION

It is an object of the invention to provide a drill device for drilling a hole in the earth. The drill device comprises a body having a front end and a rear end with a central axis extending between the front and rear ends and being connectable to a rotatable means. At least one slot is formed in the exterior of the body which is located outward relative to the central axis and which extends between the front and rear ends. The slot has a lip extending from its front and rear ends respectively. A cutting means is provided for the slot with the cutting means comprising a connecting portion located in the slot and having a forward end and a rearward end. The connecting portion comprises a hook near its front and rear ends respectively for connection to the lips of the slot. A removable stop means is positioned to prevent longitudinal movement of the connecting portion of the cutting means relative to the slot.

In another aspect, the plurality of angularly spaced apart slots are formed in the exterior of the body each for holding one of the cutting means.

DETAILED DESCRIPTION OF THE PREFERRED EMBODIMENTS

Figures 1, 2:
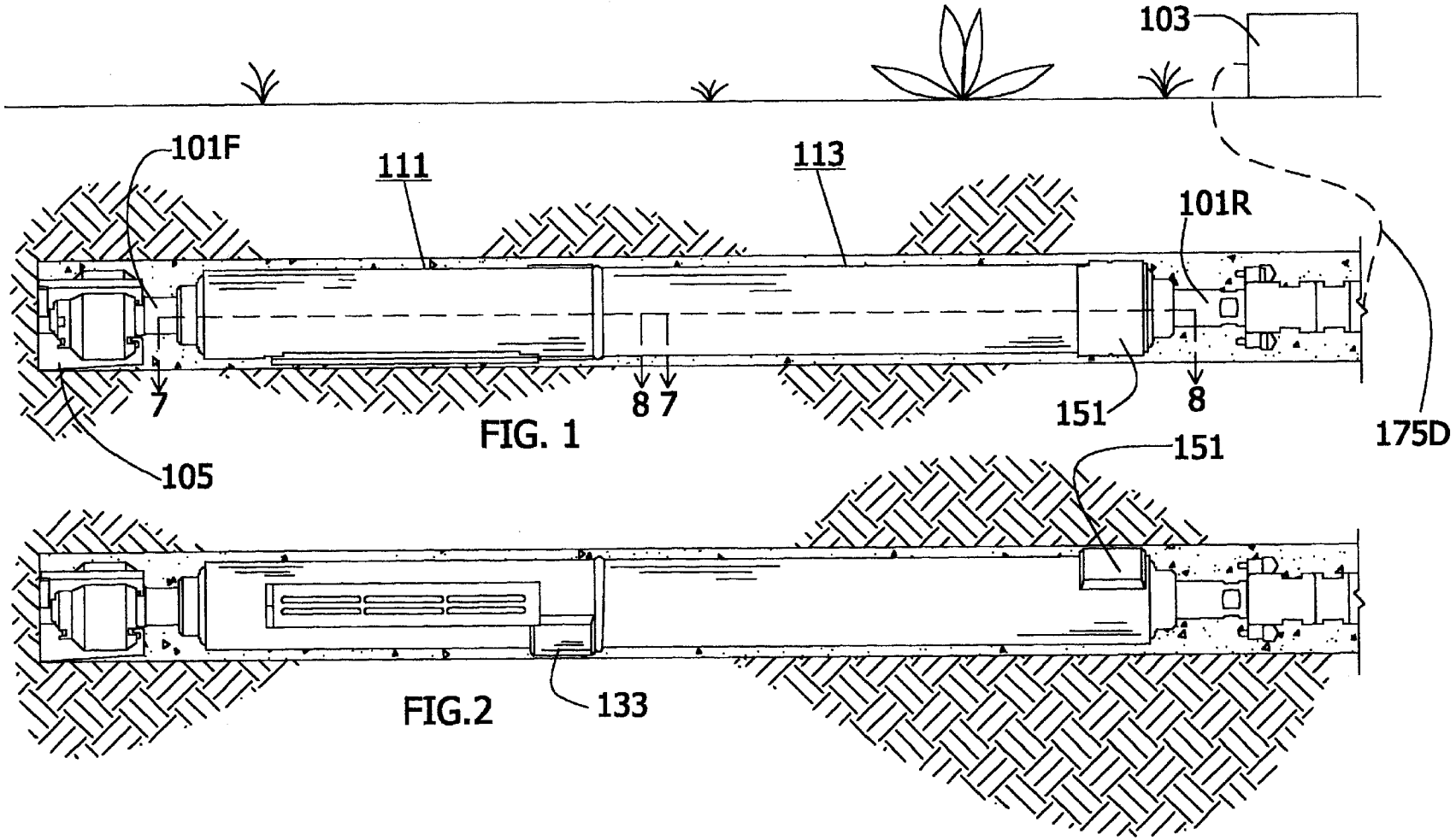
FIG. 1 illustrates the top view of a drilling apparatus in the straight drilling mode.
FIG. 2 illustrates the side view of the drilling apparatus in the straight drilling mode.
Figures 58, 59, 60, 61, 62, 63, 64, 65:
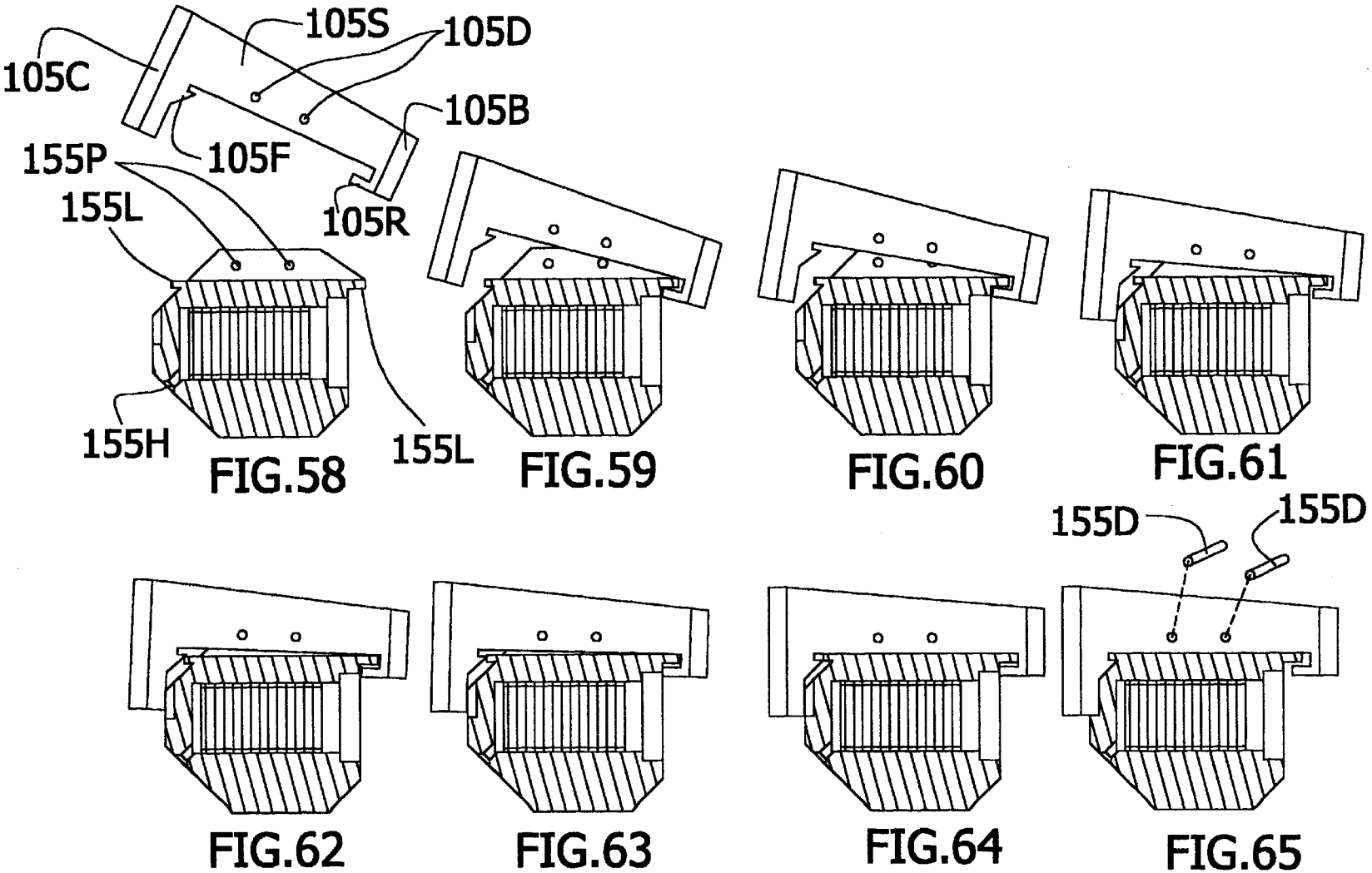
FIGS. 58–65 shows the coupling procedure of the rotational cutting means.

Referring to FIGS. 1–65 of the drawings, the apparatus comprises a shaft 101 having a rear end 101R connectable to a drilling system 103 and a rotational cutting means 105 connectable to the front end 101F. The shaft 101 extends through a front housing 111 and a rear housing 113. The drilling system is a conventional system that can rotate and push the shaft 101 forward for drilling purposes and it can also pull the shaft 101 rearward. Additional stem members can be attached to the rear 101R of the shaft 101 and to the drilling system 103 as the hole being drilled gets longer or deeper. The shaft 101 can rotate within each of units 111 and 113, and can move forward a small distance to a drilling position and rearward a small distance to a shifting position relative to units 111 and 113. Units 111 and 113 cannot rotate relative to each other, but they can bend or pivot lengthwise relative to each other, as shown in FIGS. 21–23 and 27–29.

A front ball joint 115 with pivot pins 117 located at the front of unit 111 supports unit 111 on the front of the shaft 101F. A middle ball joint 119 with a rear end 119R connects the rear of unit 111 with the front of unit 113. A rear ball joint 121 with pivot pins 121A similar to the front ball joint 115 supports the rear of unit 113 on the rear of shaft 101R.

A main cam 123 and a main cam follower 163 are employed in unit 113 to cause the apparatus to drill straight as shown in FIGS. 1 and 2 or to tilt or pivot units 111 and 113 relative to the shaft 101 as shown in FIGS. 21–23 and 27–29 to cause the front of the shaft 101F to turn up, down, left, or right or any fraction thereof while drilling operations are being carried out. A shifting cam 145 is also located in unit 113 for the purpose of regulating the straight and turn drilling by regulating the amount of longitudinal displacement between the main cam 123 and the main cam follower 163.

Figure 3:
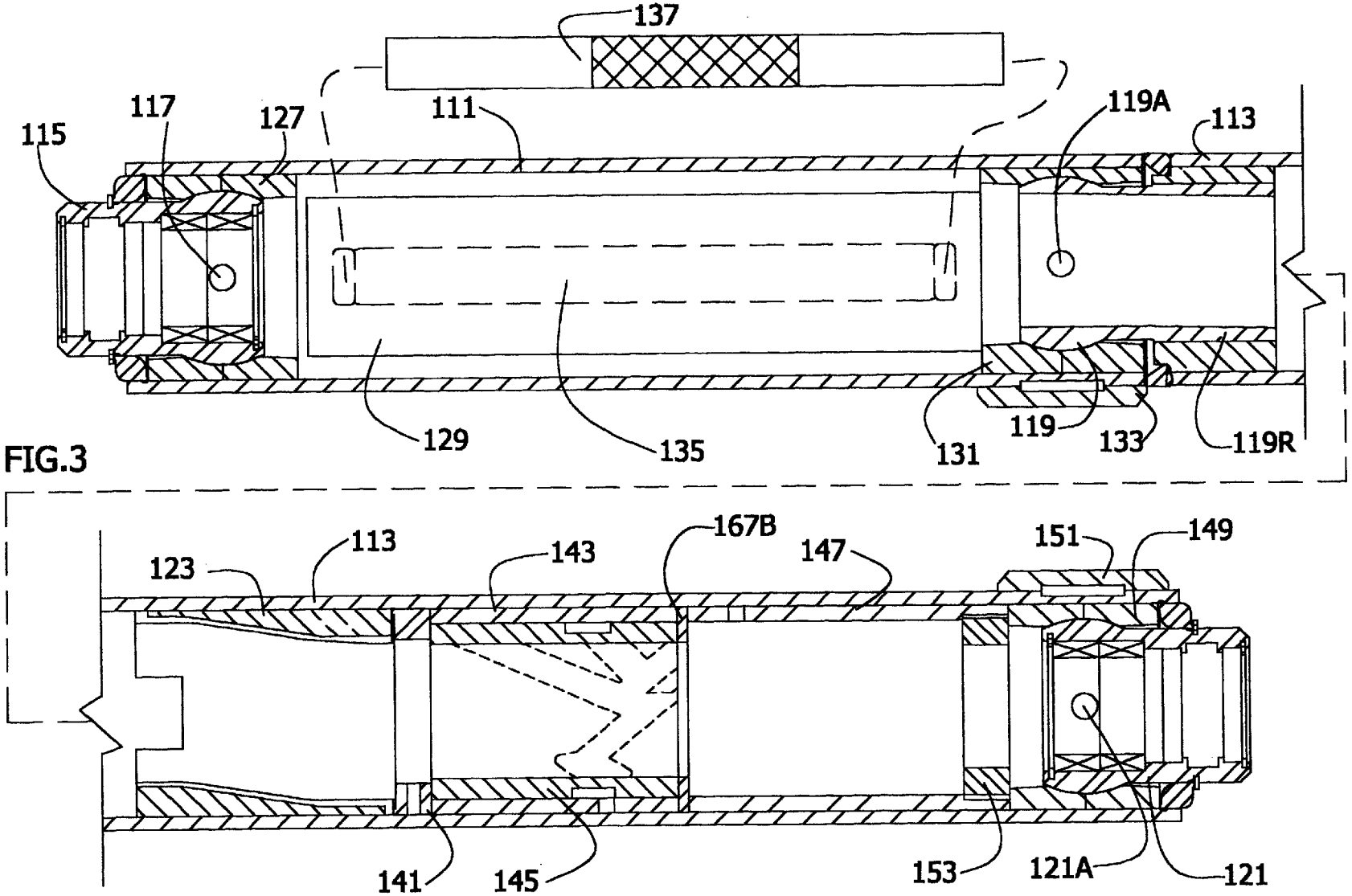
FIG. 3 is a side cross sectional view of the parts of the apparatus that are locked longitudinally with the guide housings.
Figure 4:
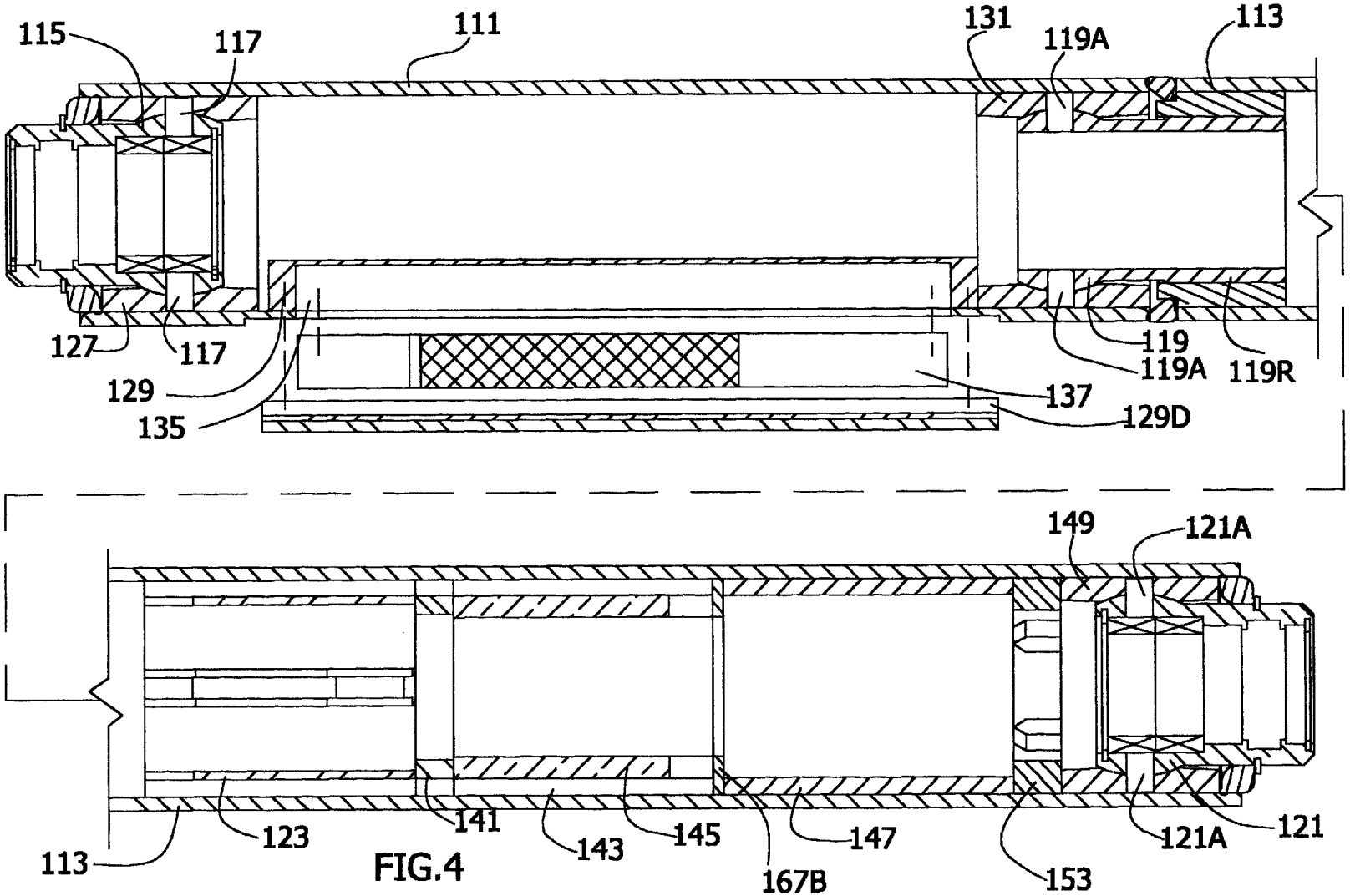
FIG. 4 is a top cross sectional view of the parts of the apparatus that are locked longitudinally with the guide housings.

For reference, in the drawings, the top of the drilling apparatus is on the inside of the radius being drilled, such that if the hole is being turned up relative to the earth, the top of the drilling apparatus is up relative to the earth. Likewise if the bore is being turned downward relative to the earth, the drilling apparatus is turned upside down, and so on. Referring to FIG. 3 and FIG. 4, the front housing 111 has fixedly attached to it, a front socket 127, a transmitter case 129, a middle socket 131, and a front wear pad 133. The front socket 127 encases the front ball 115 so that the front housing 111 may pivot relative to the shaft 101. The transmitter case 129 is accessible through a cutout 135 in the side of the front housing 111. The door 129D covers the transmitter 137. The transmitter case 129 holds the compartment for the transmitter 137 employed by the drilling apparatus. The middle socket 131 encases the middle ball 119 so that the front housing 111 may pivot relative to the rear housing 113. The middle socket 131 and the middle ball 119 are pinned together so that they cannot rotate relative to each other, such that the two housings 111 and 113 cannot rotate relative to each other. The front wear pad 133 is located on the bottom of the drilling apparatus, such that it pushes against the bore wall 179 to cause the drilling apparatus to turn. The rear of the middle ball 119R is fixedly attached to the front of the rear housing 113. The rear housing 113 has fixedly attached to it a main cam 123, a stop plate 141, a shifting cam bushing 143, a stop bushing 167B, a clutch stop 147, a rear socket 149, and a rear wear pad 151. The shifting cam bushing 143 supports a shifting cam 145. The shifting cam 145 is free to rotate, but is locked longitudinally relative to the rear housing 113. The clutch stop 147 is fixedly attached to the housing 113 and limits the rotational and forward movement of a female clutch member 153. The rear socket 149 limits the rearward movement of the female clutch member 153. The female clutch member 153 is free to rotate relative to the rear housing 113 only enough to allow the male clutch member 171 to engage with female clutch member 153 without regards to their starting rotational orientation.

Figure 5:
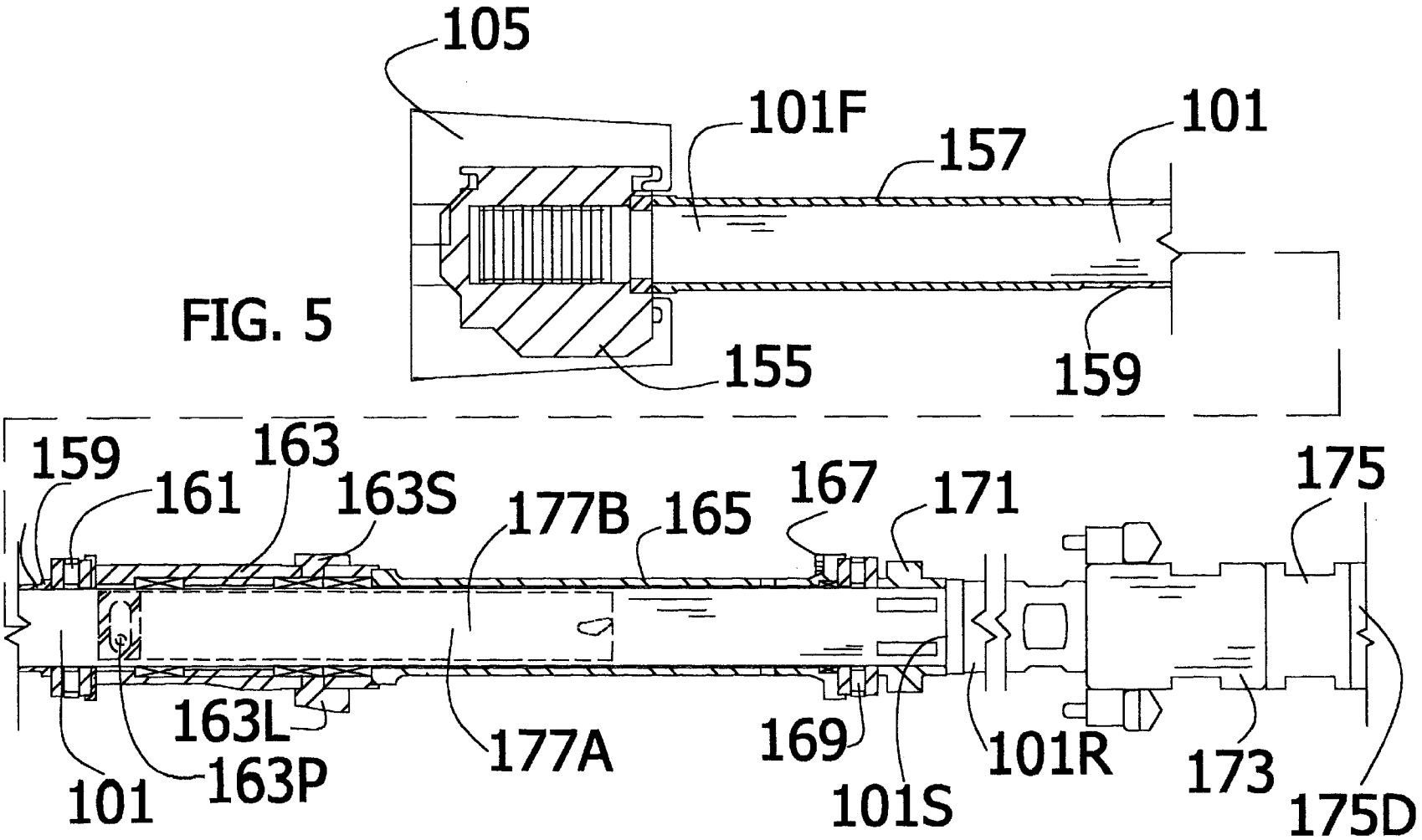
FIG. 5 is a side cross sectional view of the parts of the apparatus that are locked longitudinally with the shaft.
Figure 6:
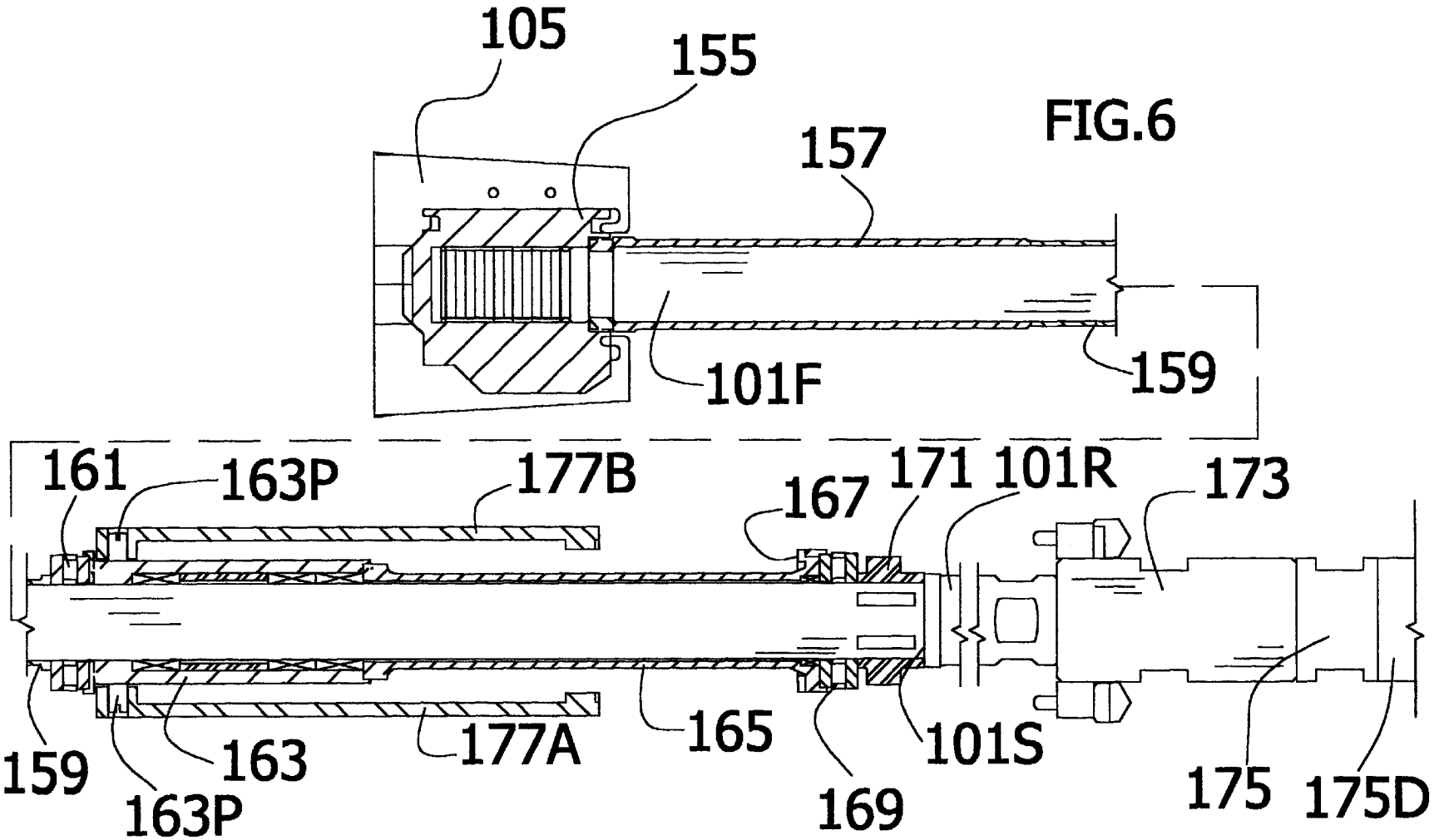
FIG. 6 illustrates the top cross sectional view of the parts that are locked longitudinally with the shaft.
Figure 7:
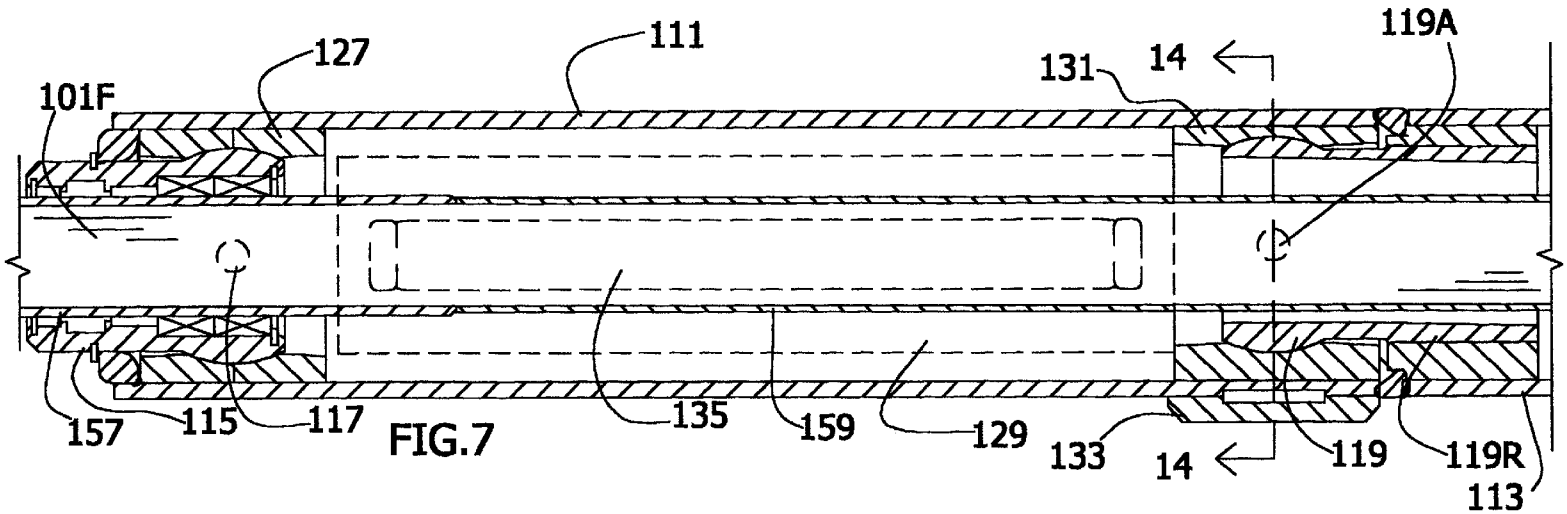
FIG. 7 is a cross sectional view of FIG. 1 taken along the lines 7—7 thereof.
Figure 8:
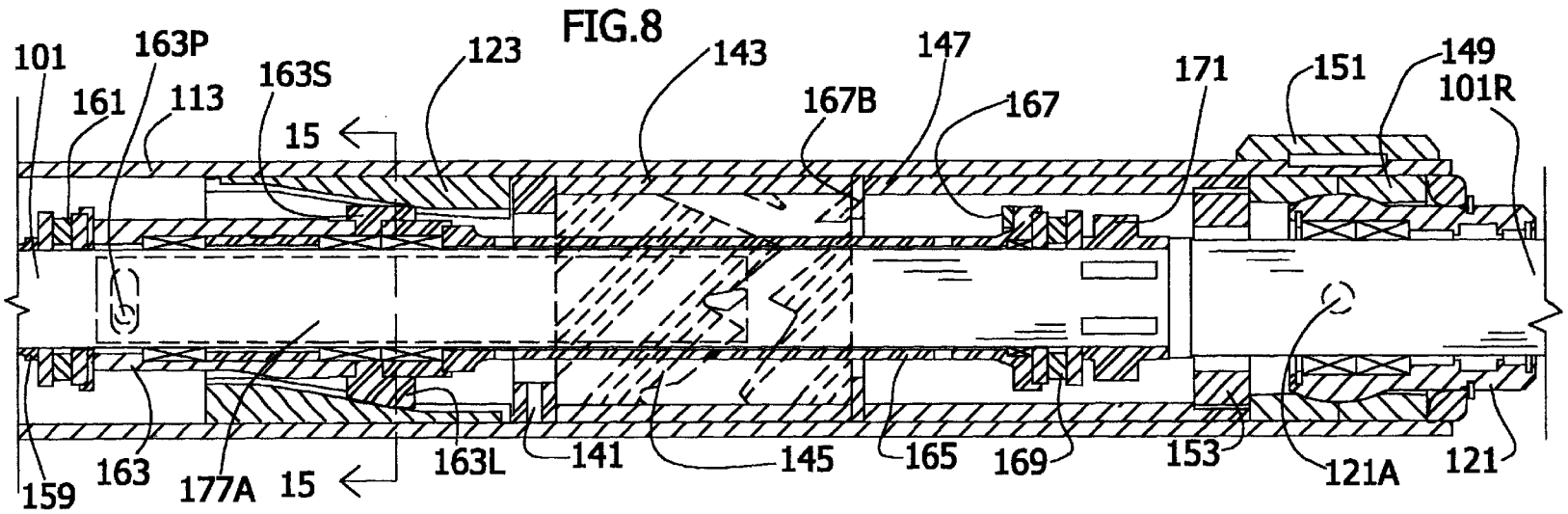
FIG. 8 is a cross sectional view of FIG. 1 taken along the lines 8—8 thereof.
Figure 9:
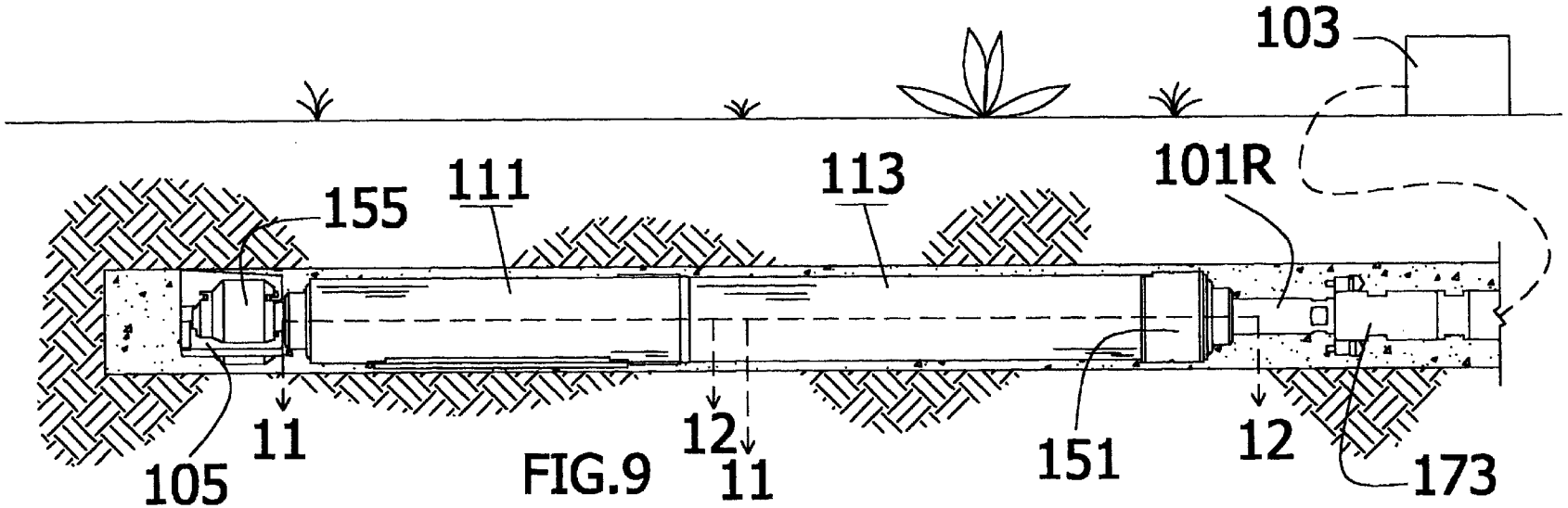
FIG. 9 is a top view of the drilling apparatus in the shifting mode.

Referring to FIGS. 5 and 6 the shaft 101 has attached to it a shaft retainer 155 upon which; in this case, a rotational cutting means 105 is mounted. The cutting means 105 may be a conventional rotary type as shown or it may be a hammering system that is commonly employed in harder strata and illustrated in FIGS. 74–76. Behind the shaft retainer 155 are two sleeves 157 and 159 that rotate with the shaft 101 and hold the other components longitudinally in place. Behind the sleeves 157 and 159 are a thrust bearing 161, a main cam follower 163, a cam follower spacer 165, a thrust bearing 169, and a male clutch member 171. The cam follower 163 and cam follower spacer 165 are free to rotate relative to the shaft 101, but are tied longitudinally to the shaft 101 by the shaft retainer 155, the two sleeves 157 and 159, the thrust bearings 161 and 165 and the shoulder 101S of the shaft 101. The shaft 101 can rotate relative to the cam follower 163 and spacer 165. Mounted on the rear of the shaft 101R is a rearward cutter 173. The rearward cutter 173 contains threads for accepting a thread adapter 175 that joins the drilling apparatus to the drill string and ultimately the drilling system 103. Two shifting cam followers 177A and 177B are mounted 180 degrees from each other and 90 degrees from the cam follower lugs 163S and 163L on the outside of the cam follower 163. The shifting cam followers 177A and 177B are free to pivot relative to the cam follower 163, but are locked longitudinally to the cam follower 163 by pins 163P. The shifting cam followers 177A and 177B are locked rotationally to the housing 113 but are free to move longitudinally relative to the housing 113. The followers 177A and 177B cannot rotate relative to the housing 113.

Referring to FIGS. 3–44 the main cam 123 has two slots cut into it, 180 degrees apart. The bottoms of the slots stay relatively parallel to each other. The bottom of the slots start out in the rear of the main cam 123 close to the bottom of the drilling apparatus and progress in several stages close to the top of the drilling apparatus as they progress to the front. The slots accept the main cam follower lugs 163S and 163L. The sides of slots keep the main cam follower 163 rotationally engaged to the rear housing 113 for rotation with the rear housing 113 as well as giving support for side loaded pressure placed on the drilling apparatus. The large cam follower lug 163L is located on the bottom of the drilling apparatus, while the small cam follower lug 163S is located on the top of the drilling apparatus. As the main cam follower 163 is displaced forward relative to the main cam 123, the main cam follower lugs 163S and 163L follow the slots in the main cam 123. This causes the front of the rear housing 113 and the rear of the front housing 111 to pivot downward away from the shaft 101, such that the bore wall 179 is pushed on by the wear pad 133 and the drilling apparatus is caused to change directions. When the main cam follower 163 is displaced fully rearward, the front of the rear housing 113 and the rear of the front housing 111 are pivoted upward toward the shaft 101. This causes the wear pad 133 to be pulled in as close as possible to the shaft 101.

Referring to FIGS. 34–44P, the shifting cam 145 and shifting cam followers 177A and 177B regulate the amount of longitudinal displacement that the main cam 123 and main cam follower 163 undergo. In FIGS. 35–44P the exterior surface of the cam 145 is shown laid out flat. The two cam followers 177A and 177B are located 180 degrees apart. In FIGS. 35, 42–44, and 44J–44M, 360 degrees of the cam is shown and in FIGS. 42–44 and 44J–44M both cam followers 177A and 177B are shown. In FIGS. 36–41, 44A–44(I) and 44N–44P only 180 degrees of the cam 145 is shown and only one cam follower 177B is shown although it is to be understood that the complete cam of FIGS. 34 and 35 and both followers 177A and 177B will be employed. In FIGS. 36–44P the horizontal arrows depict the direction of longitudinal travel of the followers 177A and 177B and the vertical arrows next to the cam 145 depict the direction of rotation of the cam 145. In FIGS. 36–44P, rearward movement of the followers 177A and 177B is to the right and forward movement of the followers 177A and 177B is to the left. The lugs 177AL and 177BL of the cams 177A and 177B can be moved between positions displaced fully rearward as shown by follower 177B in FIG. 38 and to positions fully displaced forward as shown by follower 177B in FIG. 41 and to intermediate positions. Grooves 145A–145E are cut into the outside of the shifting cam 145 at an angle such that when the shifting cam followers 177A and 177B are displaced longitudinally they contact the walls of the grooves 145A–145E, which rotate the shifting cam 145. Furthermore, the lugs 177AL and 177BL on the shifting cam followers 177A and 177B are shaped in such away as to ride along the walls of the grooves 145A–145E and to enter into an intersecting groove 145AB–145DE when the appropriate displacement and rotational positioning is achieved.

Figure 12:
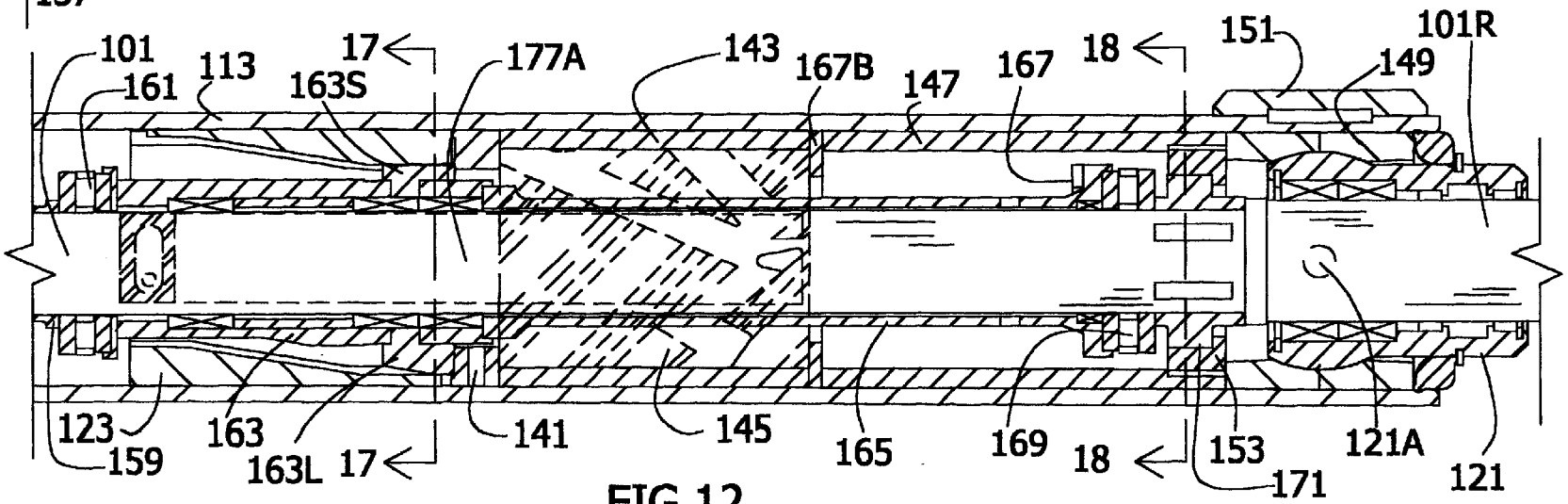
FIG. 12 is the cross sectional view of FIG. 9 taken along the lines of 12—12 thereof.
Figure 13:
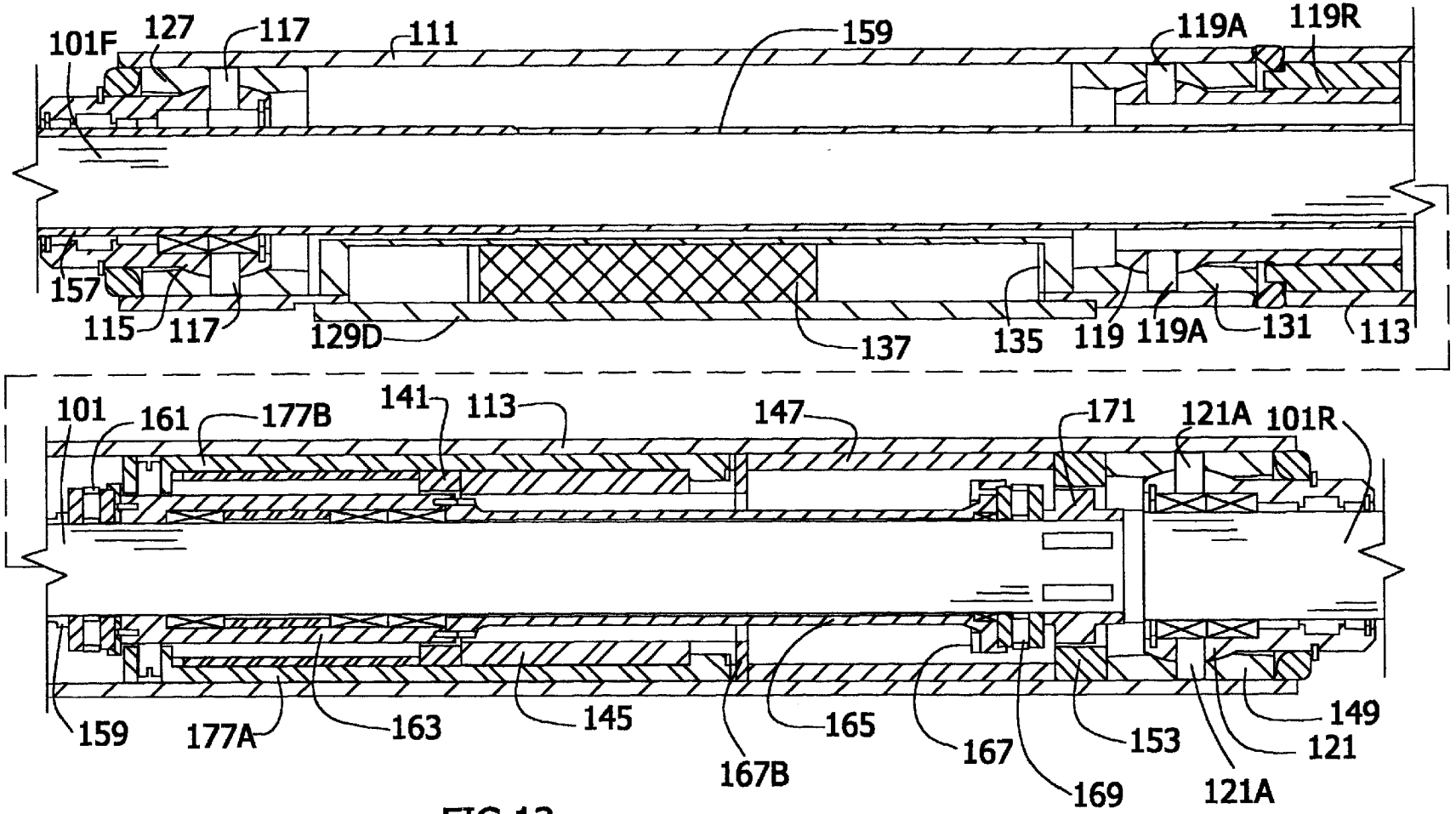
FIG. 13 is a cross sectional view of FIG. 10 taken along the lines of 13—13 thereof.
Figure 16:
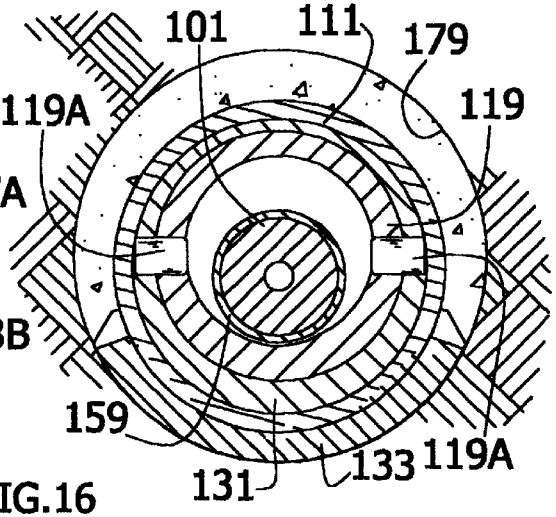
FIG. 16 is a cross sectional view of FIG. 11 taken along the lines of 16—16 thereof.
Figure 15:
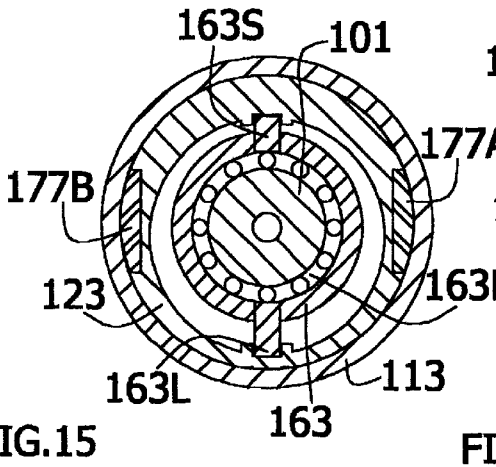
FIG. 15 is a cross sectional view of FIG. 8 taken along the lines of 15—15 thereof.
Figure 14:
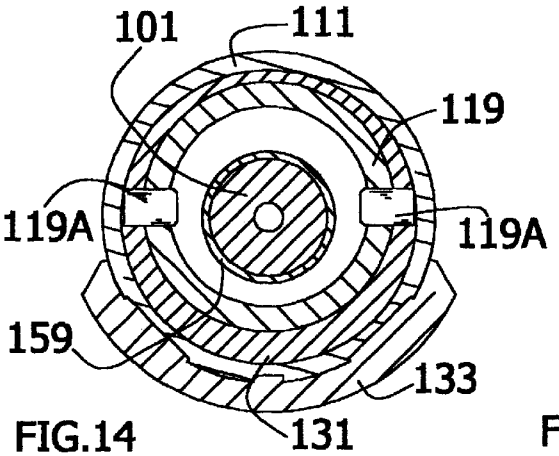
FIG. 14 is a cross sectional view of FIG. 7 taken along the lines of 14—14 thereof.
Figure 19:
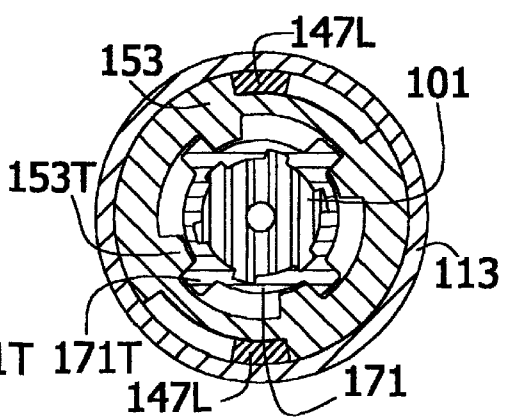
FIG. 19 is a cross sectional view of FIG. 12 taken along the lines of 18—18 thereof, which is the same lines as FIG. 18 was taken from but when the shaft has been rotated in order to rotate the drilling apparatus.
Figure 18:
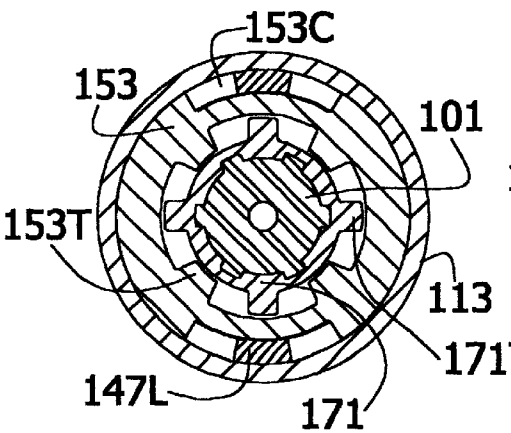
FIG. 18 is a cross sectional view of FIG. 12 taken along the lines of 18—18 thereof when the clutch is in the neutral position.
Figure 17:
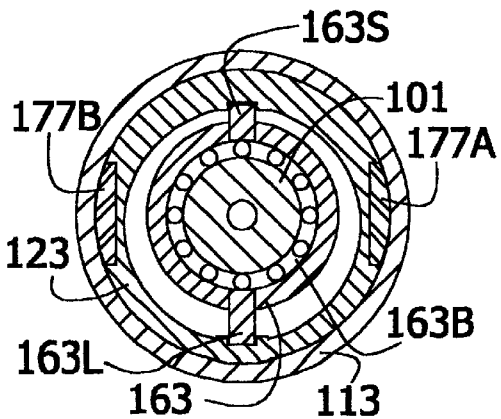
FIG. 17 is a cross sectional view of FIG. 12 taken along the lines of 17—17 thereof.
Figure 20:
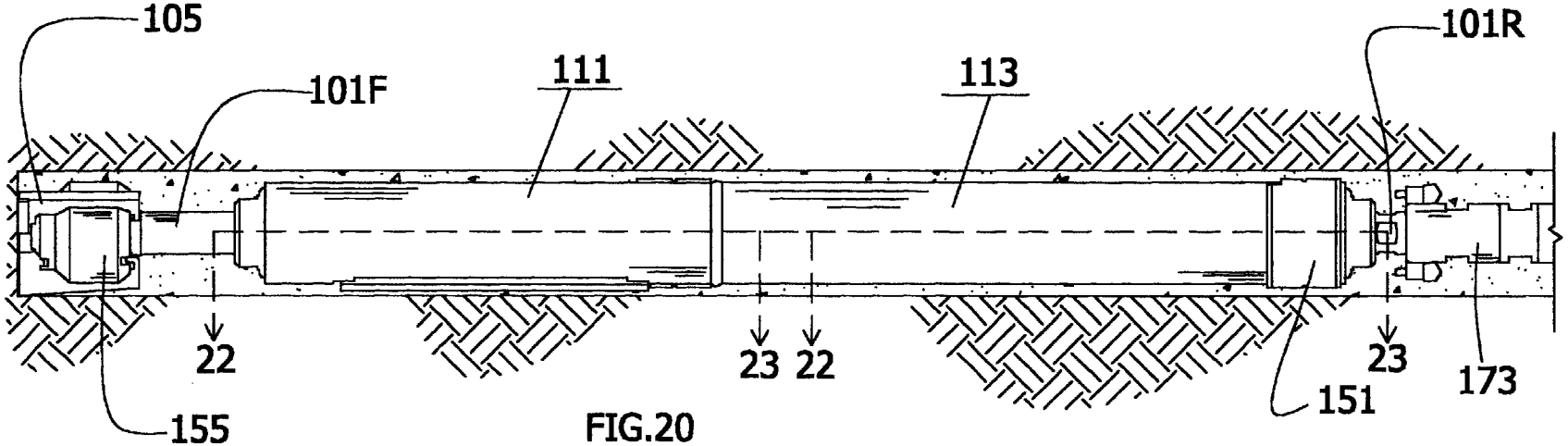
FIG. 20 is a top view of the drilling apparatus in the major turn mode.
Figure 21:
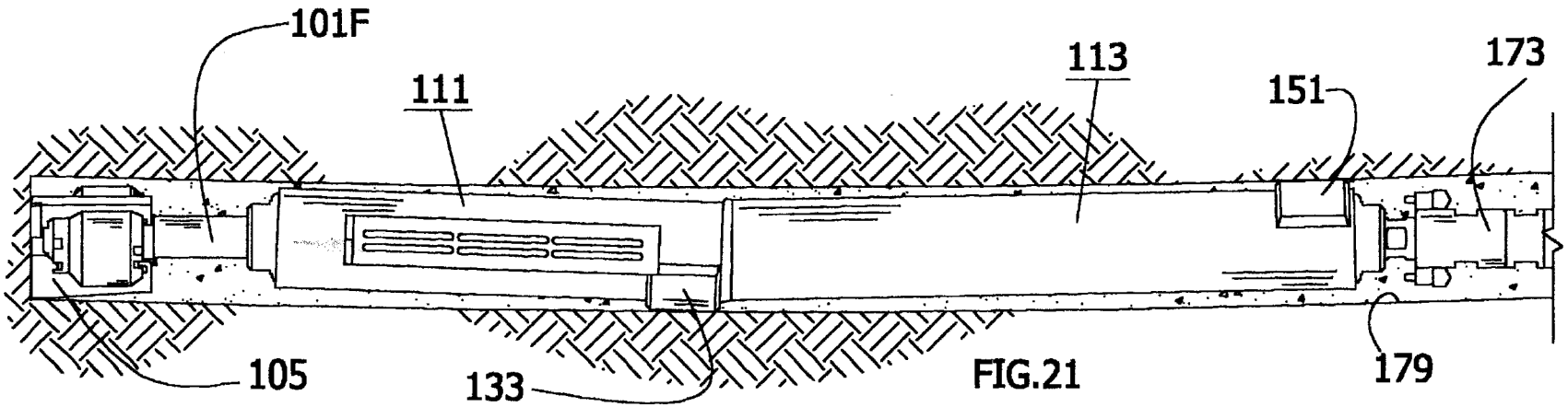
FIG. 21 is a side view of the drilling apparatus in the major turn mode.
Figures 22, 23:
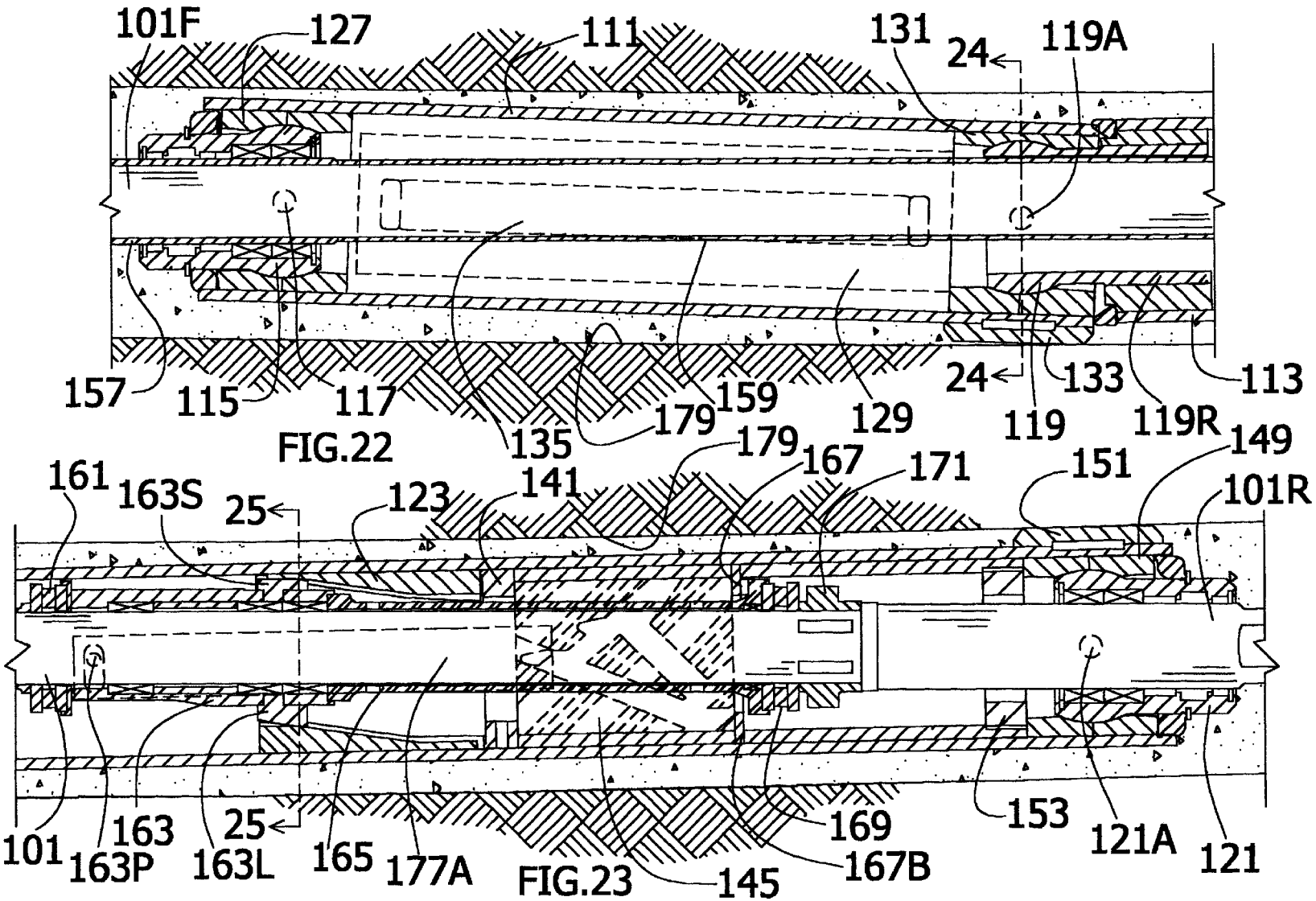
FIG. 22 is a cross sectional view of FIG. 20 taken along the lines of 22—22 thereof.
FIG. 23 is a cross sectional view of FIG. 20 taken along the lines of 23—23 thereof.
Figure 25:
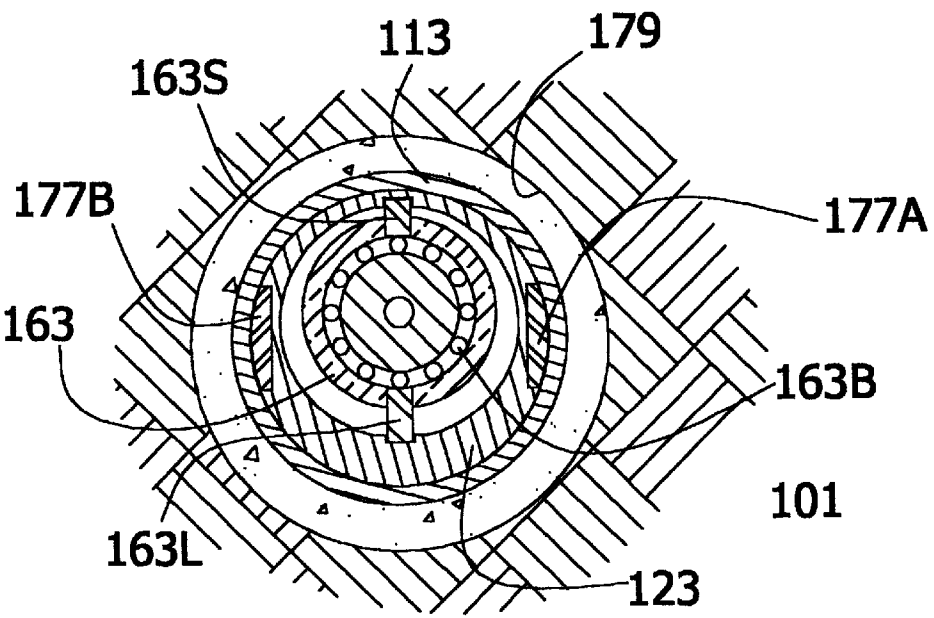
FIG. 25 is a cross sectional view of FIG. 23 taken along the lines of 25—25 thereof.
Figure 24:
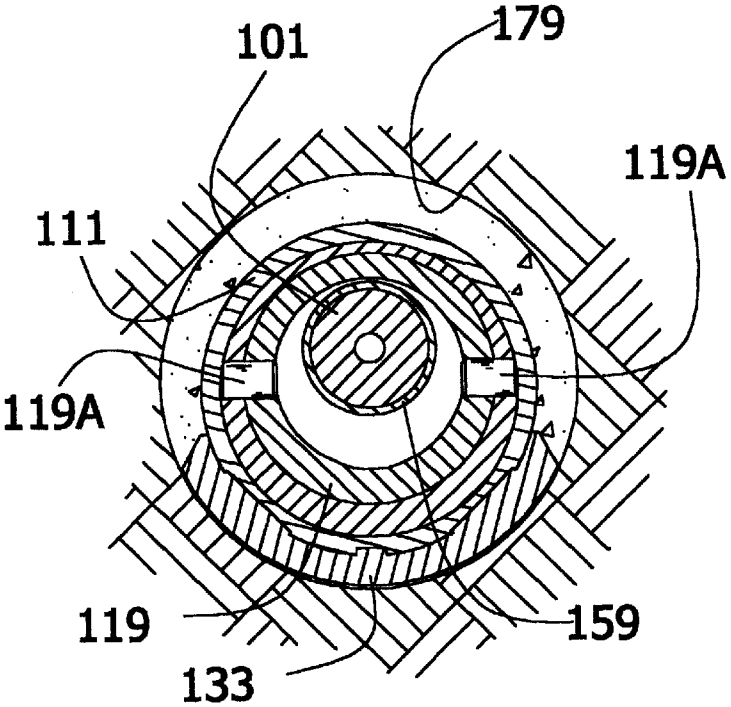
FIG. 24 is a cross sectional view of FIG. 22 taken along the lines of 24—24 thereof.
Figure 26:
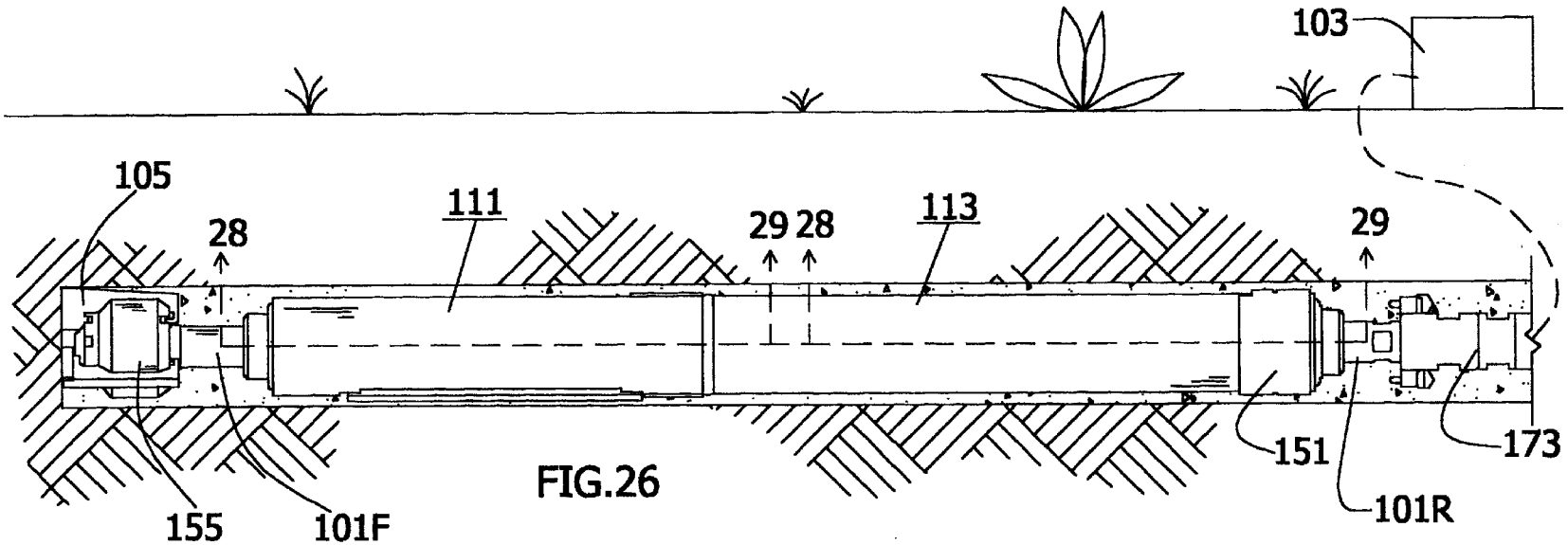
FIG. 26 is a top view of the drilling apparatus in the minor turn mode.
Figure 27:
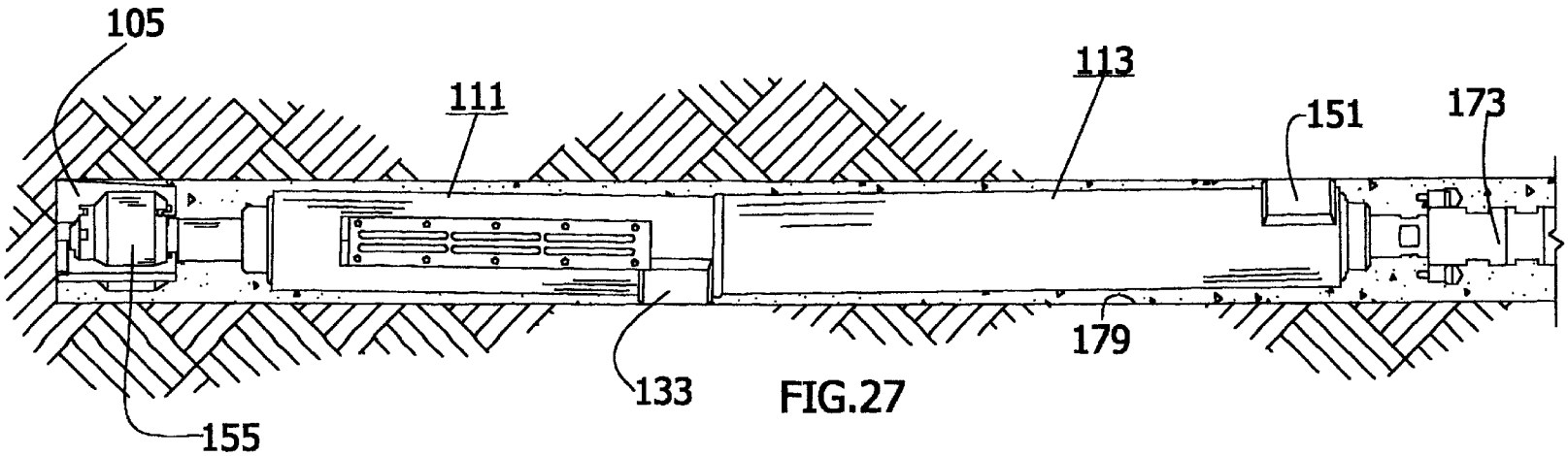
FIG. 27 is a side view of the drilling apparatus in the minor turn mode.
Figures 28, 29:
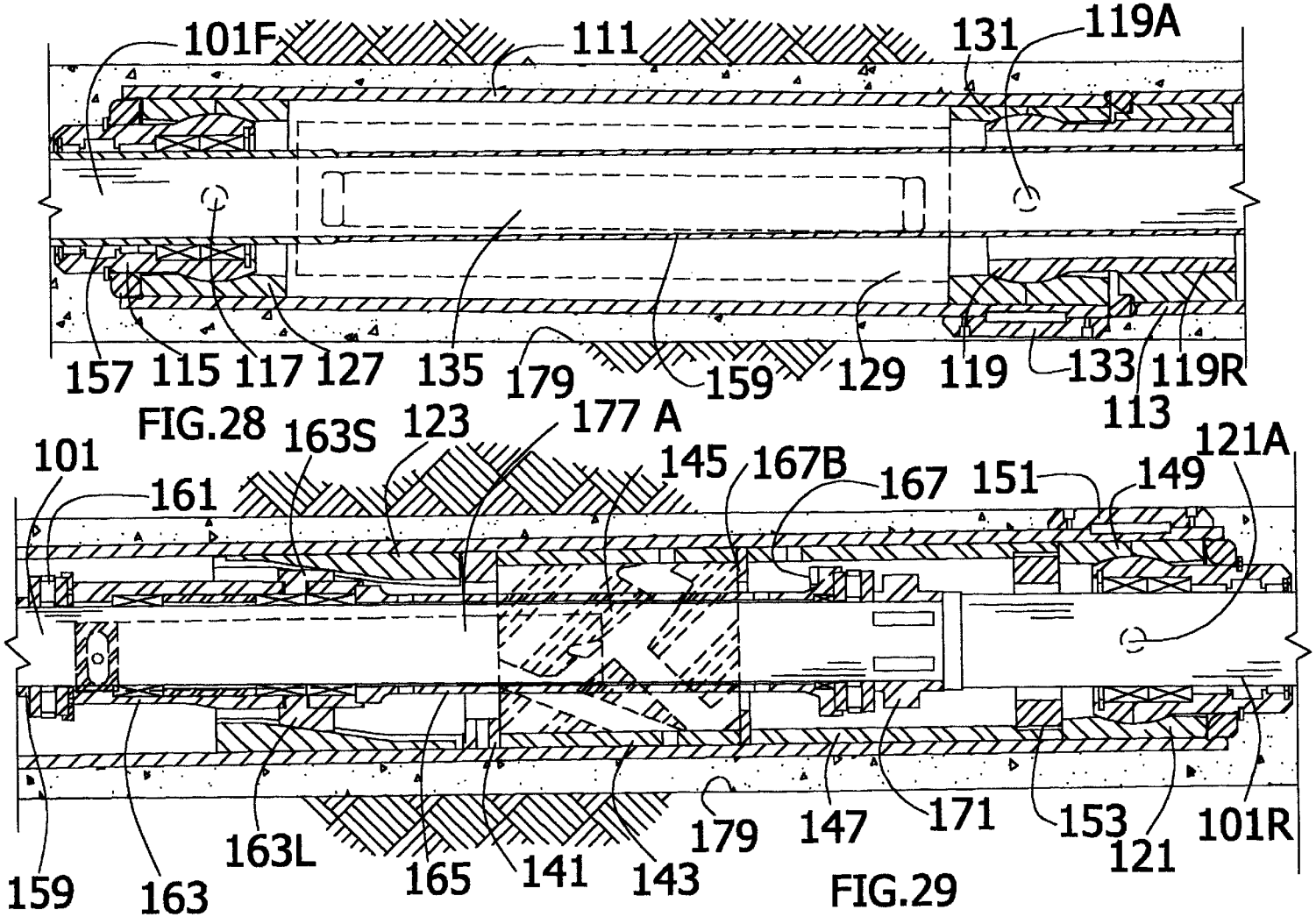
FIG. 28 is a cross sectional view of FIG. 26 taken along the lines of 28—28 thereof.
FIG. 29 is a cross sectional view of FIG. 26 taken along the lines of 29—29 thereof.
Figure 30:
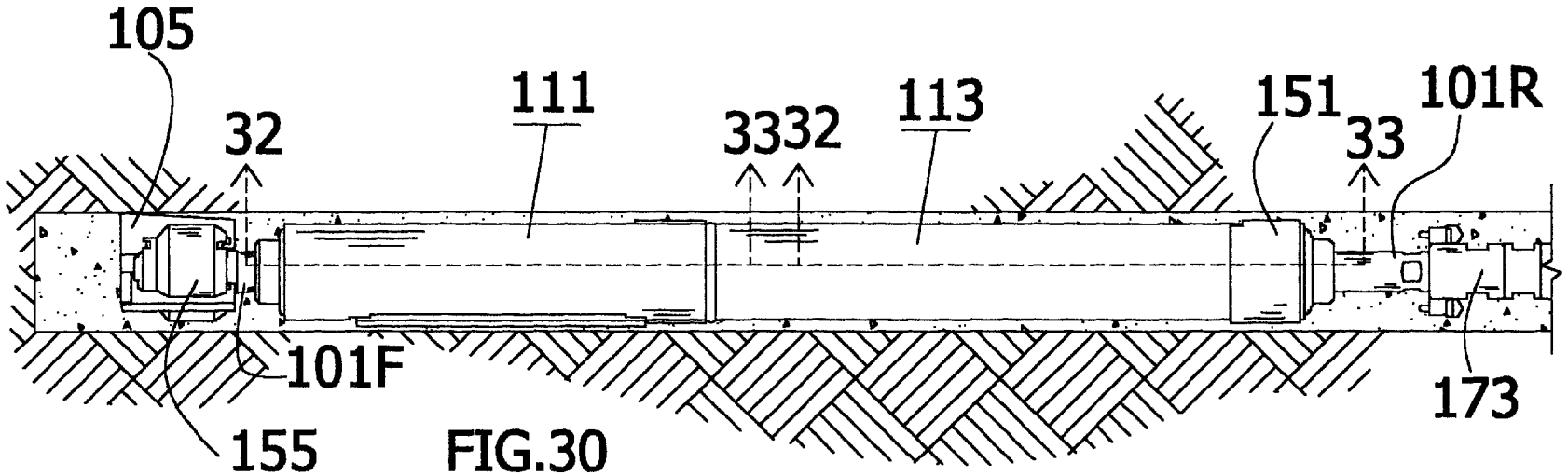
FIG. 30 is a top view of the drilling apparatus in the partially pulled back mode.
Figure 31:
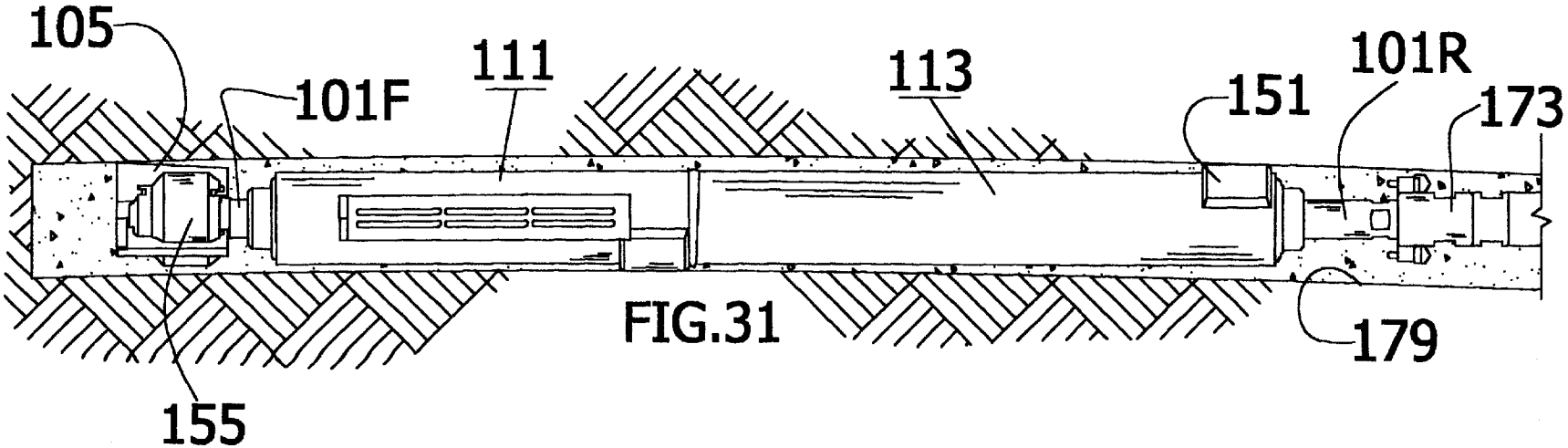
FIG. 31 is a side view of the drilling apparatus in the partially pulled back mode.
Figure 32:
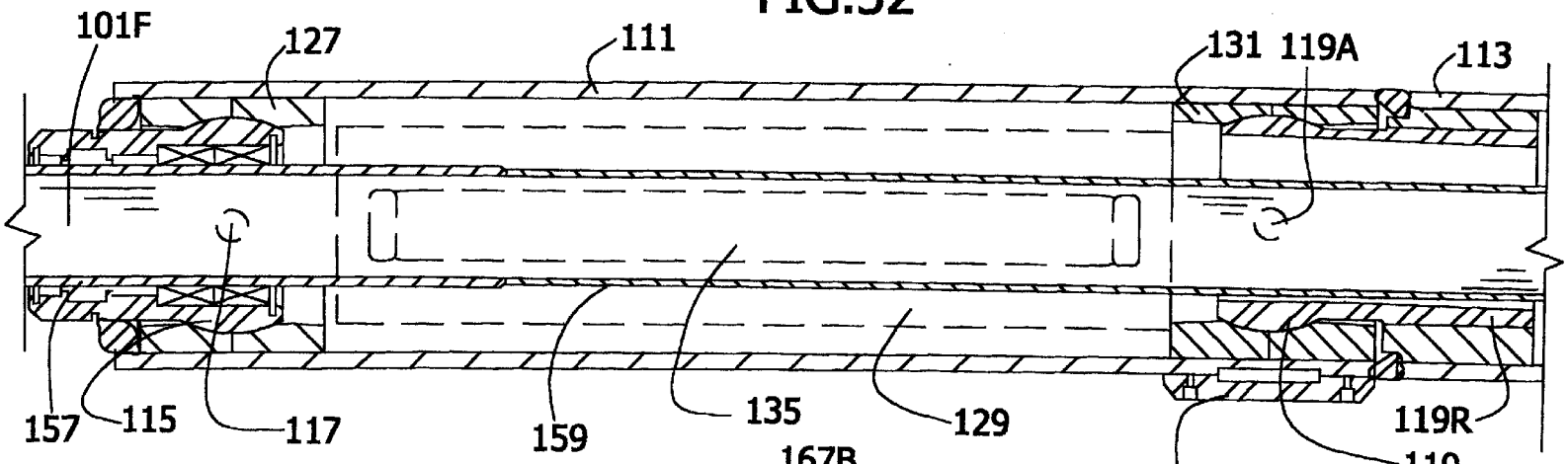
FIG. 32 is a cross sectional view of FIG. 30 taken along the lines of 32—32 thereof.
Figure 33:
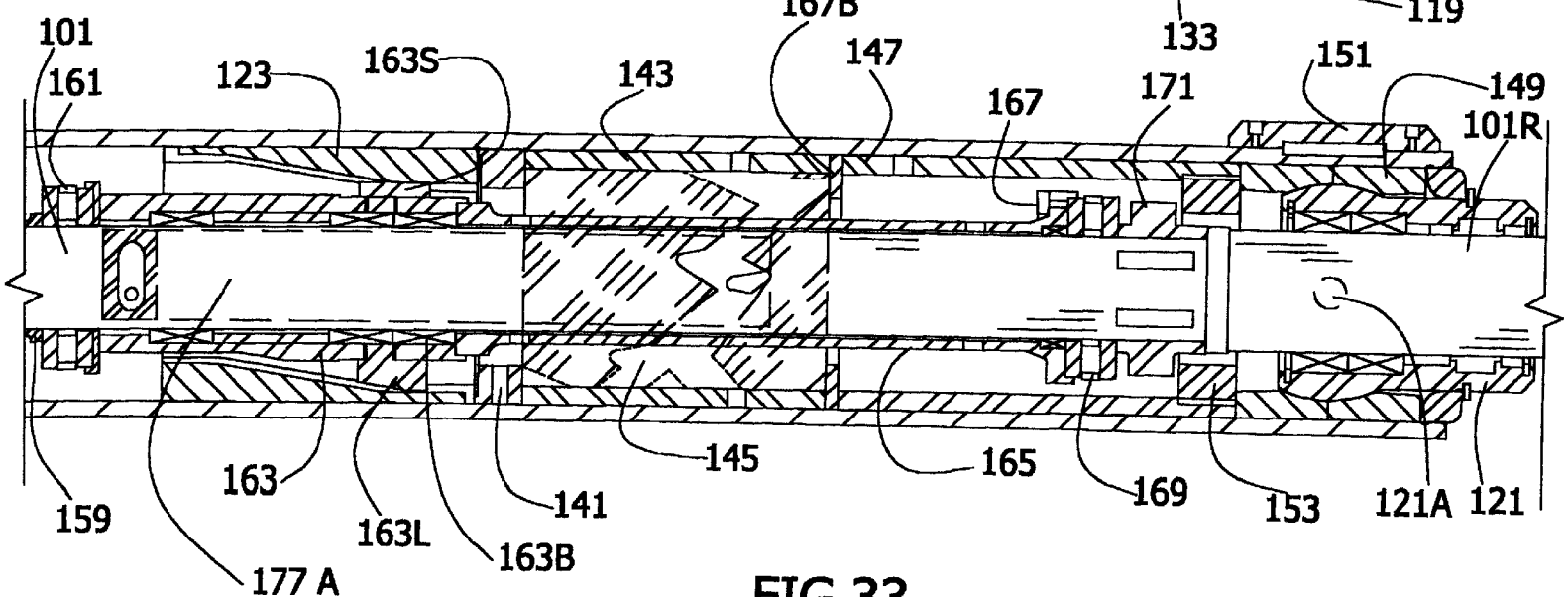
FIG. 33 is a cross sectional view of FIG. 30 taken along the lines of 33—33 thereof.
Figure 35:
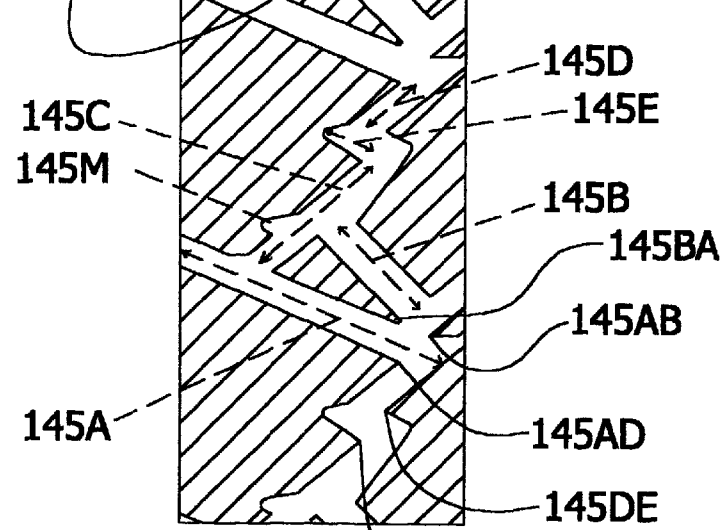
FIG. 35 is 360-degree flat view of the exterior of the shifting cam
Figure 34:
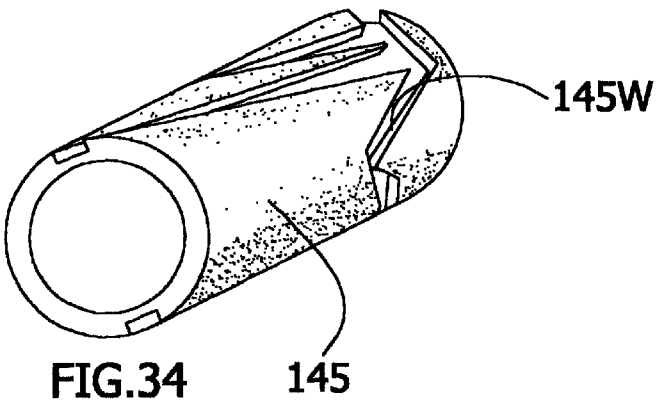
FIG. 34 is an isometric view of the shifting cam.
Figure 36:
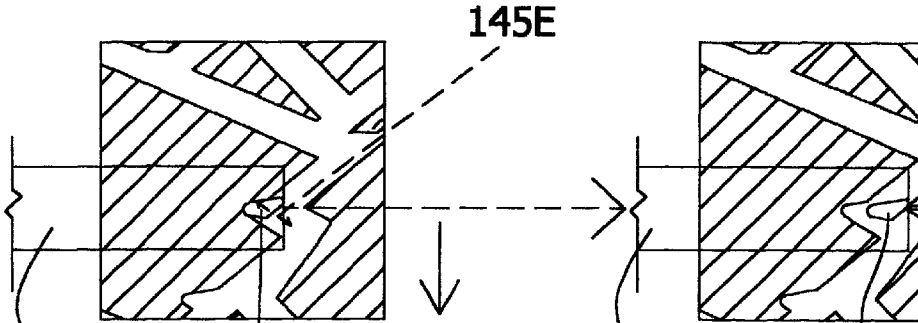
FIG. 36 is a 180-degree flat view of the shifting cam and the shifting cam follower in the straight drilling mode.
Figure 37:
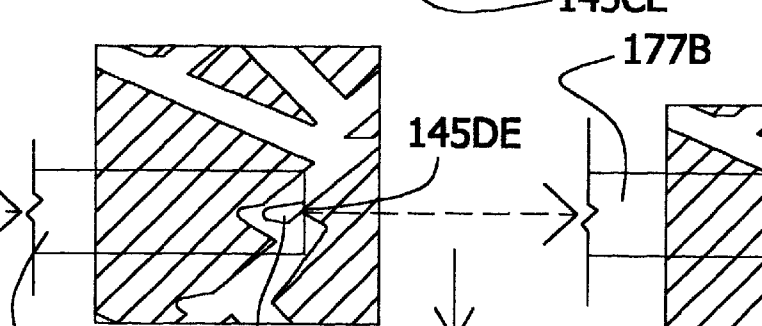
FIG. 37 is a 180-degree flat view of the shifting cam lug contacting the shifting cam groove intersection.
Figure 38:
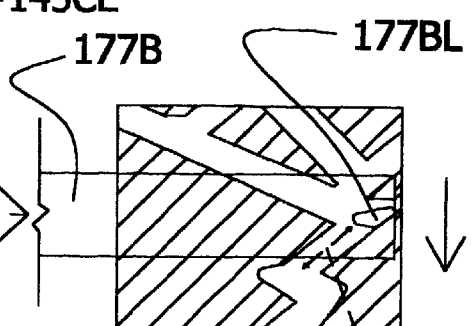
FIG. 38 is a 180-degree flat view of the shifting cam with the shifting cam followers in full rearward position.
Figures 39, 40, 41, 42, 43, 44, 44A:
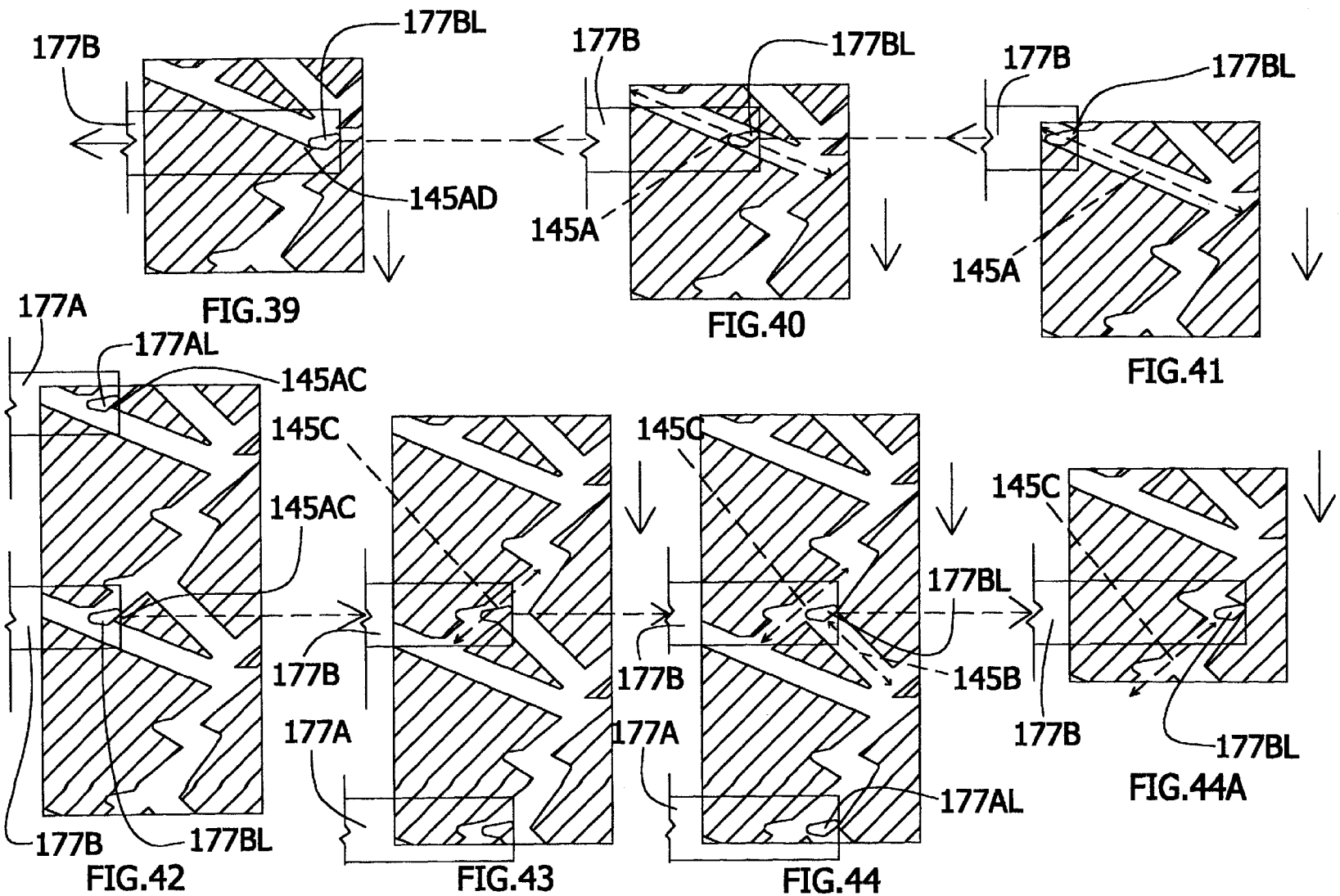
FIG. 39 is a 180-degree flat view of the shifting cam with the shifting cam follower lug contacting an intersection of the shifting cam grooves.
FIG. 40 is a 180-degree flat view of the shifting cam with the shifting cam follower in transition between the full rearward position and the full forward position.
FIG. 41 is a 180-degree flat view of the shifting cam with the shifting cam follower in the fully forward position.
FIG. 42 is a 360-degree flat view of the shifting cam with the shifting cam follower lugs contacting an intersection of the shifting cam grooves.
FIG. 43 is a 360-degree flat view of the shifting cam with the shifting cam followers in transition between the major turn position and the rearward position before drilling straight.
FIG. 44 is a 360-degree flat view of the shifting cam with the shifting cam followers by-passing the by-pass groove of the shifting cam.
FIG. 44A is a 180-degree flat view of the shifting cam with the shifting cam follower lug stopped by the end of the shifting cam groove.
Figures 44B, 44C, 44D, 44E, 44F, 44G, 44H, 44I:
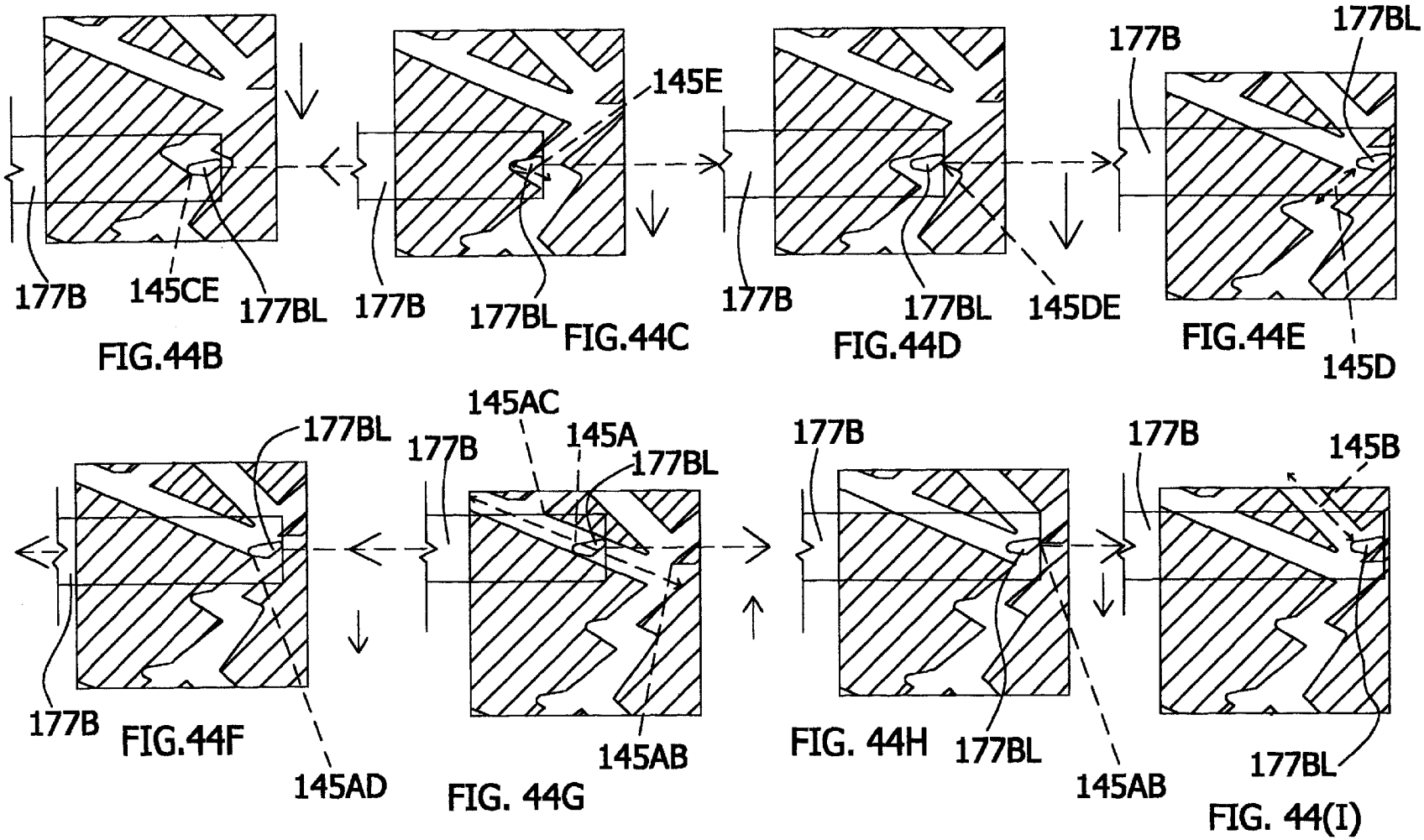
FIG. 44B is a 180-degree flat view of the shifting cam with the shifting cam follower lug contacting the intersection of the grooves in the shifting cam.
FIG. 44C is a 180-degree flat view of the shifting cam with the shifting cam follower in the straight position.
FIG. 44D is a 180-degree flat view of the shifting cam with the shifting cam follower contacting an intersection of the shifting cam grooves.
FIG. 44E is a 180-degree flat view of the shifting cam with the shifting cam follower in the full rearward position.
FIG. 44F is a 180-degree flat view of the shifting cam with the shifting cam follower lug contacting an intersection of the shifting cam grooves.
FIG. 44G is a 180-degree flat view of the shifting cam with the shifting cam follower's forward displacement halted in preparation to start the minor turn sequence.
FIG. 44H is a 180-degree flat view of the shifting cam with the shifting cam follower contacting an intersection of the shifting cam grooves.
FIG. 44(I) is a 180-degree flat view of the shifting cam with the shifting cam follower fully rearward in the minor turn sequence.
Figures 44J, 44K, 44L, 44M, 44N, 44O, 44P:
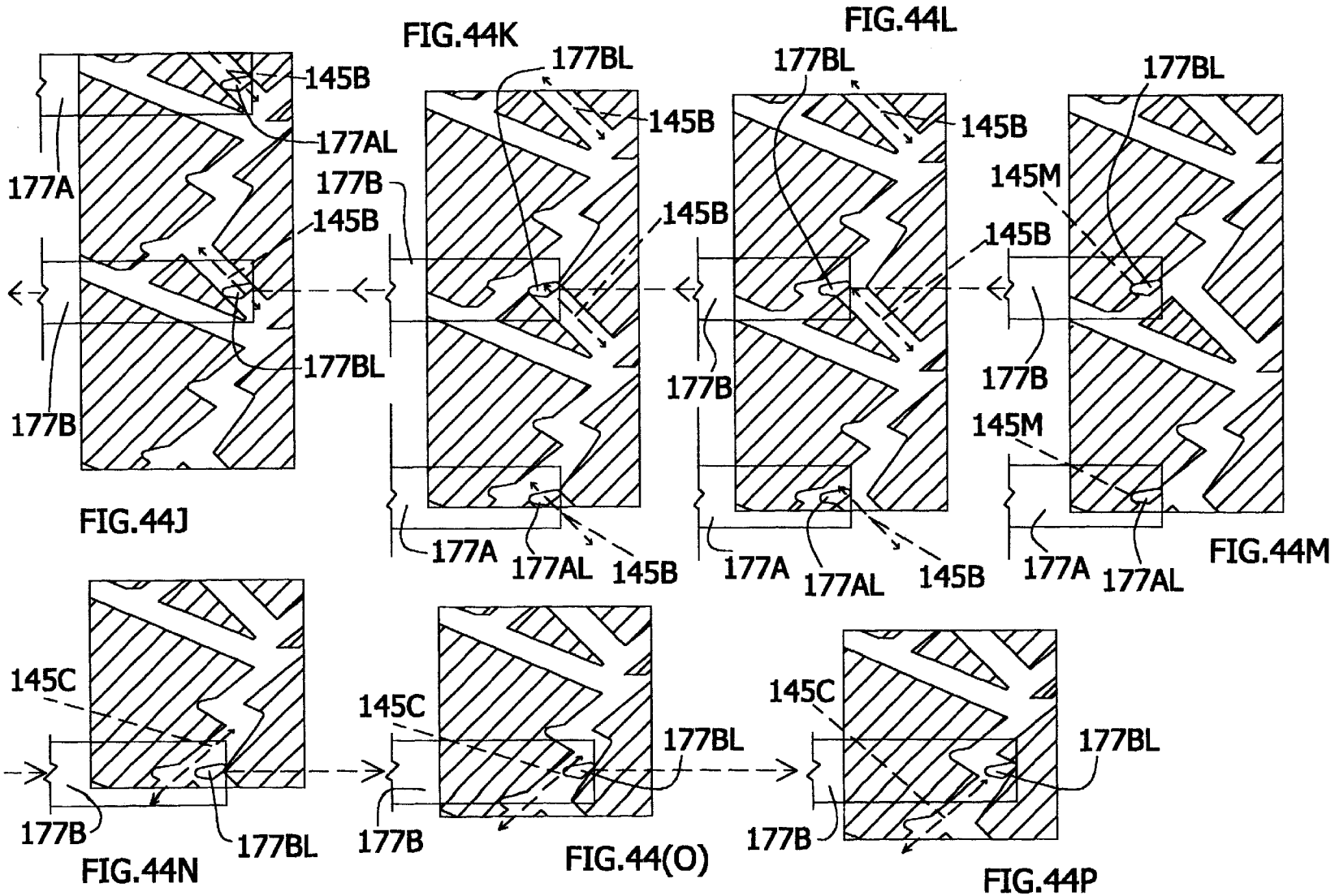
FIG. 44J is a 360-degree flat view of the shifting cam with the shifting cam followers in transition from the fully rearward position to the minor turn position.
FIG. 44K is a 360-degree flat view of the shifting cam with the shifting cam followers exiting the by-pass groove.
FIG. 44L is a 360-degree flat view of the shifting cam with the shifting cam followers heading toward the minor turn stop.
FIG. 44M is a 360-degree flat view of the shifting cam with the shifting cam follower lugs stopped by the minor turn stop.
FIG. 44N is a 180-degree flat view of the shifting cam with the shifting cam follower in transition between the minor turn and the rearward stop before going straight. This view shows the shifting cam follower missing the by-pass groove.
FIG. 44(O) is a 180-degree flat view of the shifting cam with the shifting cam follower in transition between the minor turn and the rearward stop before going straight.
FIG. 44P is a 180-degree flat view of the shifting cam with the shifting cam follower in the fully rearward position before going straight.
Figure 48:
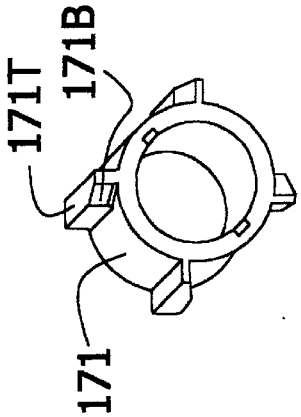
FIG. 48 is an isometric view of the rear of the male clutch member.
Figure 45A:
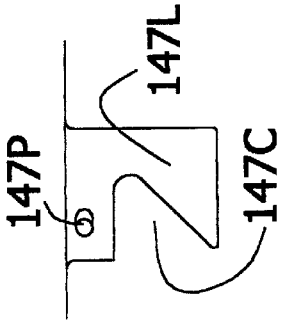
FIG. 45A is an enlargement of the clutch stop lug.
Figure 47:
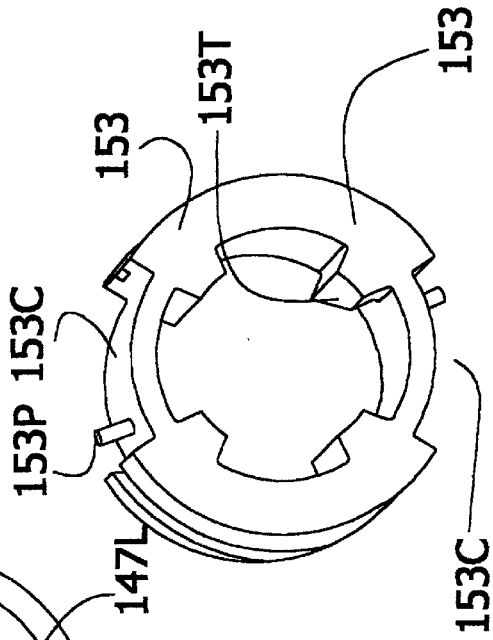
FIG. 47 is an isometric view of the rear of the female clutch member.
Figure 45:
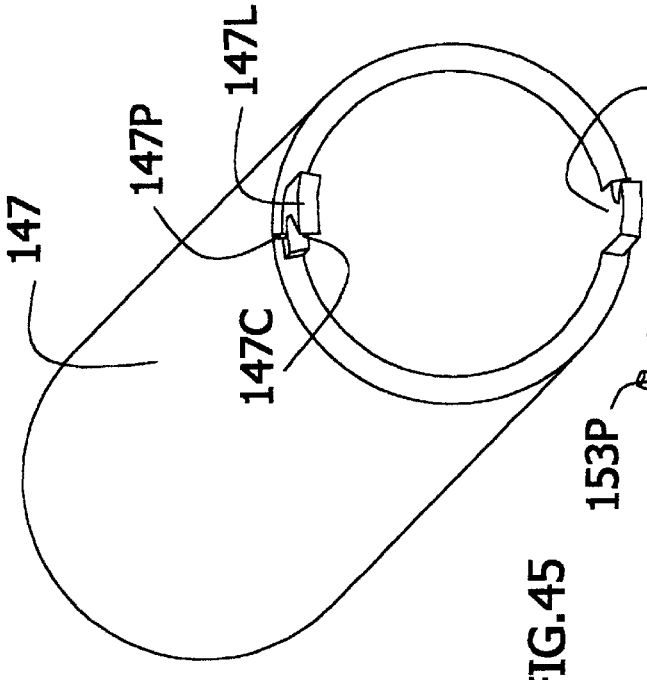
FIG. 45 is an isometric view of the clutch stop.
Figure 46:
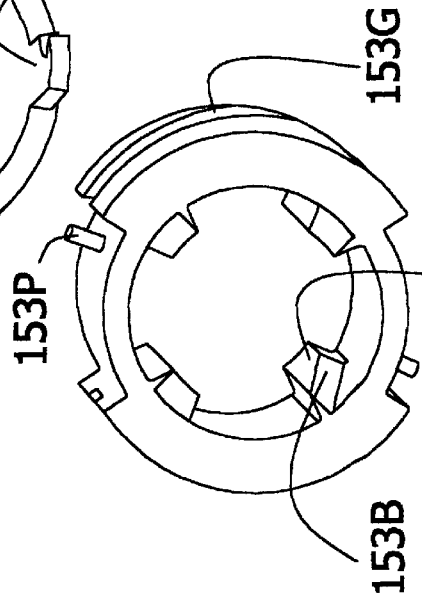
FIG. 46 is an isometric view of the front of the female clutch member.

FIG. 36 shows the shifting cam follower 177B in the straight drilling position. In this position the shifting cam followers 177A and 177B, and thus the main cam follower 163, cannot progress any further forward relative to the shifting cam 145, and thus the main cam 123, because the shifting cam follower lugs 177AL and 177BL are in contact with end of the shifting cam grooves 145E. Displacing the shifting cam followers 177A and 177B rearward causes them to contact the next set of intersecting grooves 145DE (FIG. 37). When the shifting cam followers 177A and 177B are displaced further rearward the shifting cam 145 is forced to rotate by the shifting cam follower lugs 177AL and 177BL pushing on the walls of the shifting cam grooves 145D. The contact of the main cam follower lugs 163S and 163L and the stop ring 141 halt the rearward longitudinal displacement of the shifting cam followers 177A and 177B relative to the shifting cam 145 (FIG. 38 and FIG. 12). In this longitudinal position the clutch members 153 and 171 are engaged and the housing 113 may be rotated with the shaft 101. When the desired rotational position is achieved, the shifting cam followers 177A and 177B can be moved forward relative to the shifting cam 145 until they contact the next set of intersecting grooves 145AD (FIG. 39). As the shifting cam followers 177A and 177B are further displaced forward relative to the shifting cam 145, the shifting cam follower lugs 177AL and 177BL push on the wall of the shifting cam grooves 145A forcing the shifting cam 145 to rotate relative to the housing 113 (FIG. 40). The shifting cam followers 177A and 177B do not rotate relative to the housing 113 because they are held rotationally locked to the housing 113 by the shifting cam bushings 143. The contact of the stop washer 167 and the stop bushing 167B halts the further forward displacement of the shifting cam followers 177A and 177B relative to the shifting cam 145 as well as the forward displacement of the main cam follower 163 relative to the main cam 123 (FIG. 41 and FIG. 23). In this position the tightest radius is being drilled. Displacing the shifting cam followers 177A and 177B rearward causes them to contact yet another set of intersecting grooves 145AC (FIG. 42). Further rearward displacement causes the shifting cam follower lugs 177AL and 177BL to push on the walls of shifting cam grooves 145C, forcing the shifting cam 145 to rotate relative to the housing 113 (FIG. 43). FIG. 44 shows the shifting cam followers 177A and 177B moving passed the by-pass groove 145B without entering it. This is possible by the widening of the grooves 145C in this location. The contact of the end of the shifting cam grooves 145C and the shifting cam follower lugs 177AL and 177BL stops the rearward displacement of the shifting cam followers 177A and 177B relative to the shifting cam 145 (FIG. 44A). In this embodiment the clutch members 171 and 153 are not engaged in this position, allowing the operator to know that upon pushing forward he will be drilling straight because the next intersecting groove leads to the straight position. Displacing the shifting cam followers 177A and 177B forward causes the shifting cam follower lugs 177AL and 177BL to contact the intersections of yet another set of shifting cam grooves 145CE (FIG. 44B). Further forward displacement of the shifting cam followers 177A and 177B causes the shifting cam follower lugs 177AL and 177BL to push on the shifting cam groove walls, which causes the shifting cam 145 to rotate relative to the housing 113. The contact of the shifting cam follower lugs 177AL and 177BL and the end of the shifting cam grooves 145E stops the forward displacement of the shifting cam followers 177A and 177B relative to the shifting cam 145 and thus, the forward displacement of the main cam follower 163 relative to the main cam 123 (FIG. 44C). In this position the housings 111 and 113 are virtually parallel with the shaft 101, thus causing zero effect on the direction of travel, which allows the drilling apparatus to drill straight. In this embodiment the clutch members 171 and 153 are not engaged, which allows the shaft 101 to rotate without rotating the housing 113. While drilling straight the housings 111 and 113 slide through the bore being drilled. Rearward displacement of the shifting cam followers 177A and 177B causes them to contact the next set of intersecting grooves 145DE (FIG. 44D). Further rearward displacement causes the shifting cam 145 to rotate relative to the housing 113. Contact between the main cam follower lugs 163S and 163L and the stop plate 141 stops the rearward displacement between the shifting cam followers 177A and 177B and the shifting cam 145 (FIG. 44E and FIG. 12). Forward displacement of the shifting cam followers 177A and 177B causes the shifting cam follower lugs 177AL and 177BL to contact the next set of intersecting grooves 145AD (FIG. 44F). Further forward displacement of the shifting cam followers 177A and 177B causes the shifting cam follower lugs 177AL and 177BL to push on the shifting cam groove walls causing the shifting cam 145 to rotate relative to the housing 113. By halting the forward displacement of the shifting cam followers 177A and 177B relative to the shifting cam 145 before the shifting cam follower lugs 177AL and 177BL are displaced enough to enter the intersecting grooves 145AC, but after they have passed the entrance of the by-pass grooves 145AB, the operator has a choice to either drill straight or at least drill a lesser deviated hole (FIG. 44G). The forward displacement of the shifting cam followers 177A and 177B may be stopped by the operator or by the hard surface of the bore wall. For example, if the cutting means 105 or 247 is not activated, by either the rotation of the shaft or the supply of a compressed medium, such as air or water, after the main cam follower 163 is displaced forward enough to put sufficient pressure on the housing 113 to deflect it against the bore wall, the apparatus will not cut off to the side and thus the pressure from the wear pads 151 and 133 and the non-activated cutting means 105 or 247 will halt the forward displacement of the main cam follower 163 relative to the main cam 123 and thus the shifting cam followers 177A and 177B relative to the shifting cam 145. Rearward displacement of the shifting cam followers 177A and 177B relative to the shifting cam 145 causes the shifting cam follower lugs 177AL and 177BL to contact the shifting cam groove walls causing the shifting cam 145 to rotate. This time the shifting cam 145 is rotating in the opposite direction from what it normally rotates. Further rearward displacement causes the shifting cam follower lugs 177AL and 177BL to contact the intersections of the bypass grooves 145AB (FIG. 44H). Still more rearward displacement of the shifting cam followers 177A and 177B causes the shifting cam 145 to rotate in its normal direction. The contact of the main cam follower lugs 163S and 163L and the stop ring 141 halts the rearward displacement (FIG. 44(I) and FIG. 12). In this position the clutch members 153 and 171 are engaged and the housing 113 may be rotated if desired. Forward displacement of the shifting cam followers 177A and 177B causes the shifting cam follower lugs 177AL and 177BL to contact the next set of intersecting grooves 145BA. Further forward displacement of the shifting cam followers 177A and 177B causes the shifting cam 145 to rotate in its normal direction (FIG. 44J and FIG. 44K). The shifting cam 145 is rotated until the shifting cam follower lugs 177AL and 177BL exit the by-pass grooves 145B (FIG. 44L). The continued forward displacement of shifting cam followers 177A and 177B causes the shifting cam follower lugs 177AL and 177BL to enter into a set of short grooves 145M, which stops the forward displacement of the shifting cam followers 177A and 177B relative to the shifting cam 145 (FIG. 44M). In this position the main cam follower 163 is displaced forward relative to the main cam 123 enough to deflect the housings 111 and 113 only part of their total deflection capabilities (FIGS. 27–29). If the operator chooses to drill forward the drilling apparatus will turn at a lesser degree than would otherwise be possible. If the operator chooses not to drill forward he can continue to manipulate the drill stem in order to position the drilling apparatus in the desired mode. Rearward displacement of the shifting cam followers 177A and 177B causes the shifting cam follower lugs 177AL and 177BL to contact the walls of shifting cam groove 145C on the other side of the by-pass groove 145B thus allowing the shifting cam 145 to be rotated in the normal direction (FIG. 44N). Further rearward displacement of the shifting cam followers 177A and 177B relative to the shifting cam 145 causes the shifting cam follower lugs 177AL and 177BL to push on the shifting cam groove wall, which causes the shifting cam 145 to rotate relative to the housing 113 (FIG. 44(O)). Contact between the shifting cam follower lugs 177AL and 177BL and the end of the shifting cam grooves 145C stops the rearward displacement of the shifting cam followers 177A and 177B relative to the shifting cam 145 (FIG. 44P). Further longitudinal displacement causes this sequence to repeat.

Referring to FIGS. 1, 2, 7, 8 and 36, when the shifting cam followers 177A and 177B are stopped by shifting cam grooves 145E the drilling apparatus is drilling with the main cam follower 163 only partially displaced relative to the main cam 123, such that a straight bore is produced.

Referring to FIGS. 9–13, 38, 44E, and 44(I) when the shifting cam followers 177A and 177B are allowed to regress backward without hindrance from the shifting cam 145 the longitudinal displacement of the main cam follower 163 relative to the main cam 123 is stopped by the main cam follower lugs 163S and 163L and the stop plate 141. In this position all of the parts of the drilling apparatus are rotationally locked by the engagement of the clutch means 171 and 153.

Figure 10:
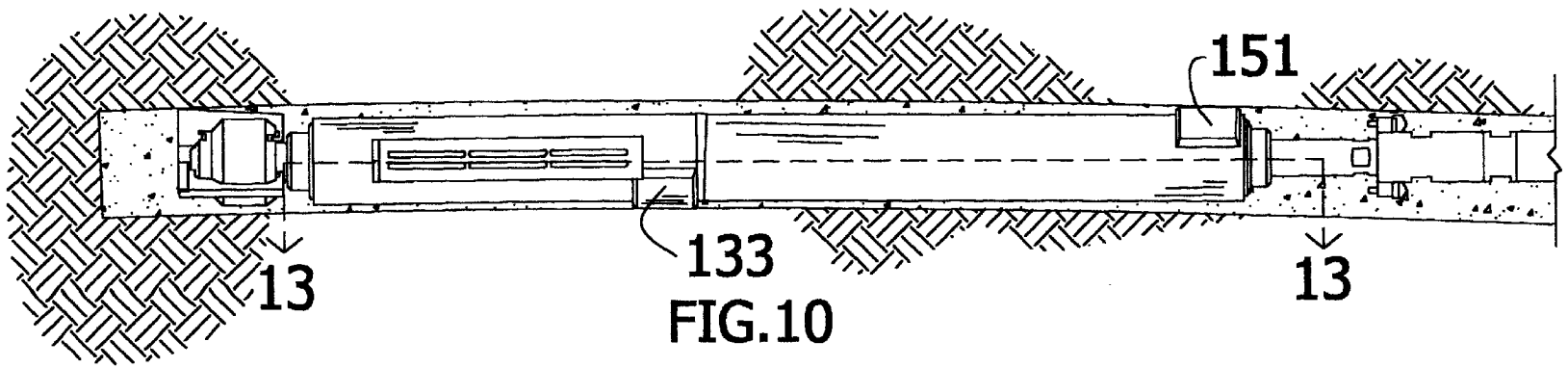
FIG. 10 is a side view of the drilling apparatus in the shifting mode positioned in a curved hole.
Figure 11:
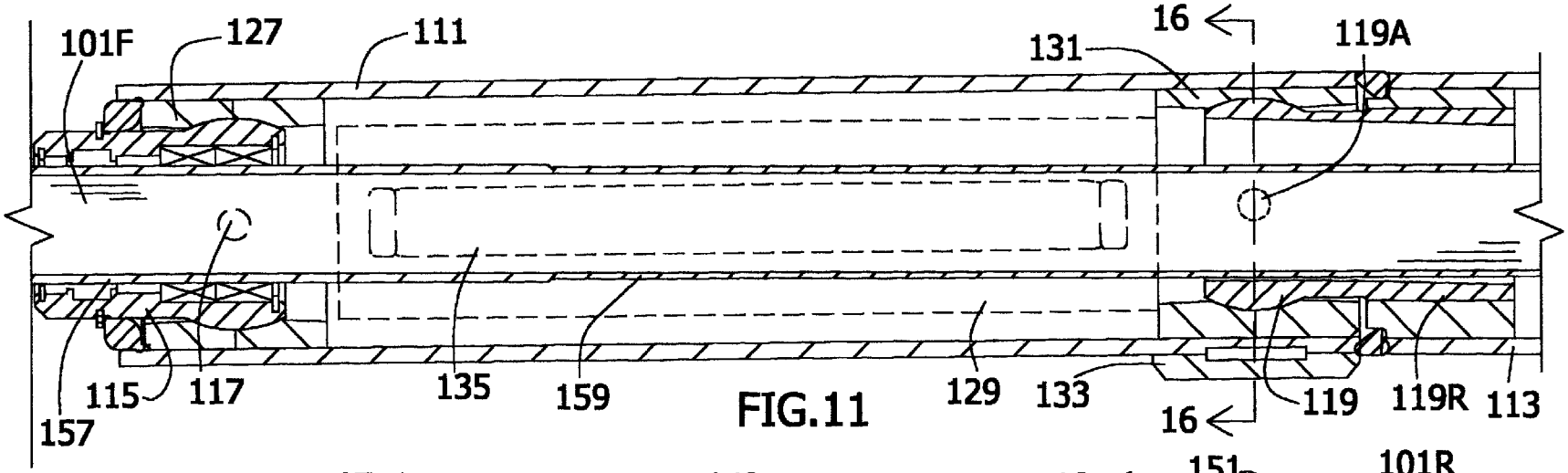
FIG. 11 is a cross sectional view of FIG. 9 taken along the lines of 11—11 thereof.

Referring to FIG. 10 the bore illustrated is curved downwards while the drilling apparatus is in the shifting position and oriented to drill upwards. The rear of the front housing 111 and the front of the rear housing 113 are bent upward allowing the drilling apparatus to be rotated a full 360 degrees in a tighter radius bore than might otherwise be possible. This allows the drilling apparatus to be with drawn through a smaller radius bore without becoming stuck.

Referring to FIGS. 20–25 and 41 when the shifting cam followers 177A and 177B are allowed to progress forward unimpeded by the shifting cam 145 the forward displacement of the main cam follower 163 relative to the main cam 123 is stopped by the contact of the stop washer 167 and the stop bushing 167B. In this position the drilling apparatus is producing the tightest turn possible.

Referring to FIGS. 21–23 and 27–29 the middle wear pad 133 is mounted on the rear of the front housing 111 such that when the rear of the front housing 111 is bent downward the wear pad 133 is forced against the bottom of the bore 179, which pushes laterally on the drilling apparatus until the rear wear pad 151 hits the opposite side of the bore 179, then the front of the drilling apparatus is pivoted toward the opposite side changing the direction of travel.

Referring to FIGS. 26–29 and 44M, when the shifting cam followers 177A and 177B are stopped by shifting cam groove 145M the drilling apparatus is drilling with the main cam follower 163 only partially displaced relative to the main cam 123, such that a larger radius is drilled.

Referring to FIGS. 30–33, 44A and 44P, when the shifting cam followers 177A and 177B are stopped by shifting cam groove 145C the male clutch member 171 is halted from engaging the female clutch member 153 such that the housing 113 cannot be rotated when the shaft is rotated. This lets the operator know that upon pushing forward he will be drilling straight.

Referring to FIGS. 18,19 and 45–50 the clutch stop 147 has two lugs 147L protruding toward the rear of the drilling apparatus. Each lug is identical. Each has a cam groove 147C cutout that acts like a cam and a pin 147P protruding radially outward. The pin 147P is designed to hold the end of one of two elastic bands 153R or 153S whose other end is attached to one of two cam follower pins 153P, that are attached to the clutch ring 153. The elastic bands may be o-rings made from a suitable elastomer. The clutch ring 153 has two cutouts 153C cut into its outer edge. Within these cutouts 153C are mounted the two cam follower pins 153P that act as cam followers. The interior of the ring 153 has teeth 153T protruding toward the center. Each tooth 153T has a beveled surface 153B on its forward face. Cut radially around the clutch rings 153 outer edge is a groove 153G that is wide enough and deep enough for the unobstructed acceptance of the elastic bands 153R and 153S. A male clutch member 171 is mounted fixedly on the shaft 101. On the outer edge of the male clutch member are mounted teeth 171T. Each tooth 171T has a beveled surface 171B facing rearward.

Figures 49, 50:
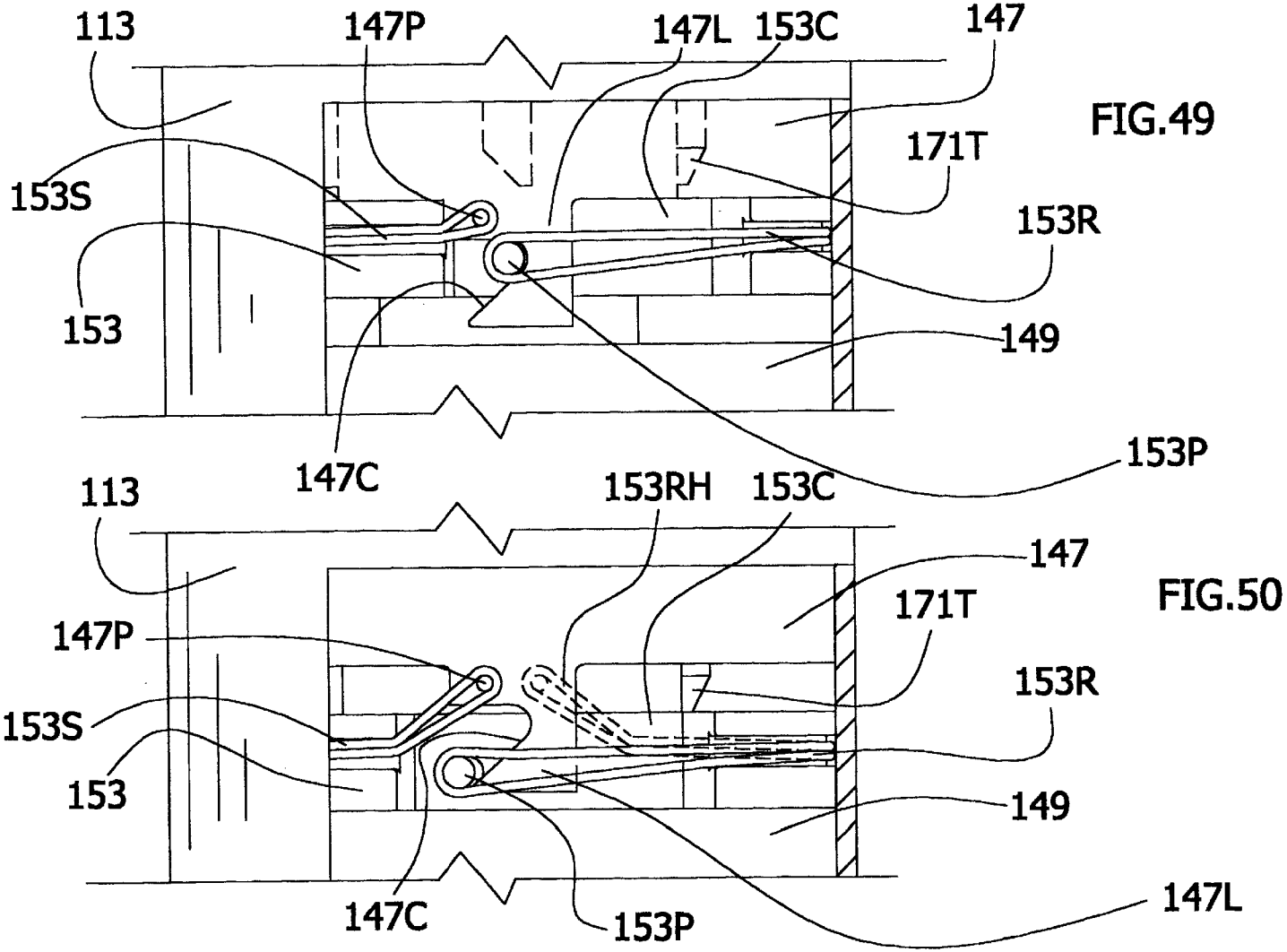
FIG. 49 is a cutout section of the guide housing showing the clutch members in a relaxed position.
FIG. 50 is a cutout section of the guide housing showing the clutch members engaging each other.
Figure 52:
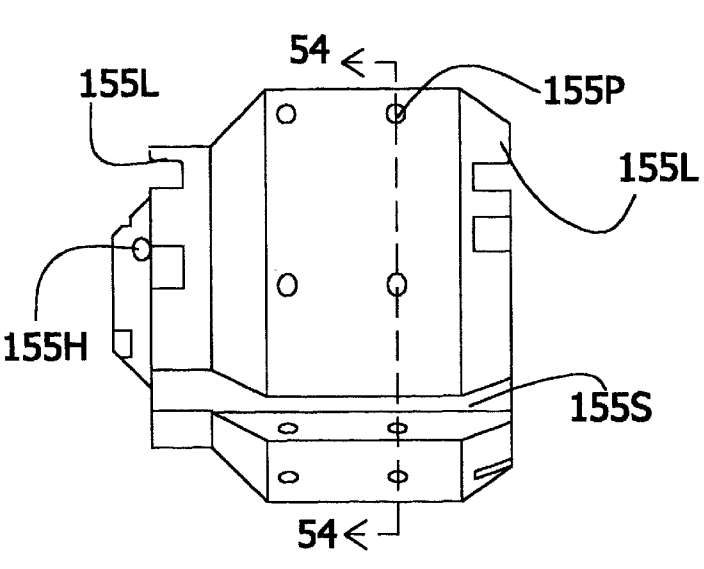
FIG. 52 is a side view of the shaft retainer.
Figure 54:
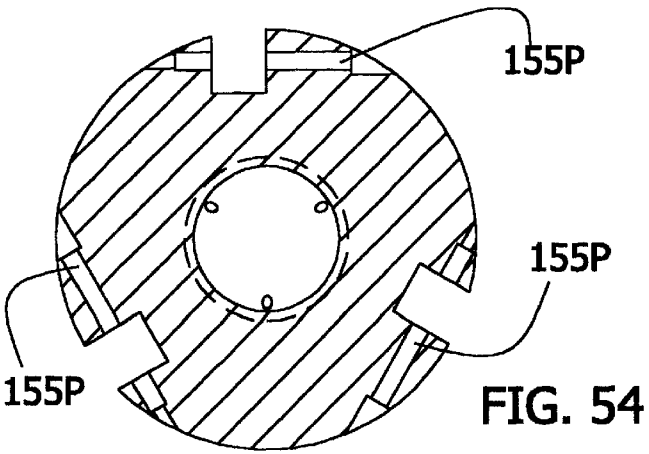
FIG. 54 is a cross sectional view of FIG. 52 taken along the line 54—54 thereof.
Figure 51:
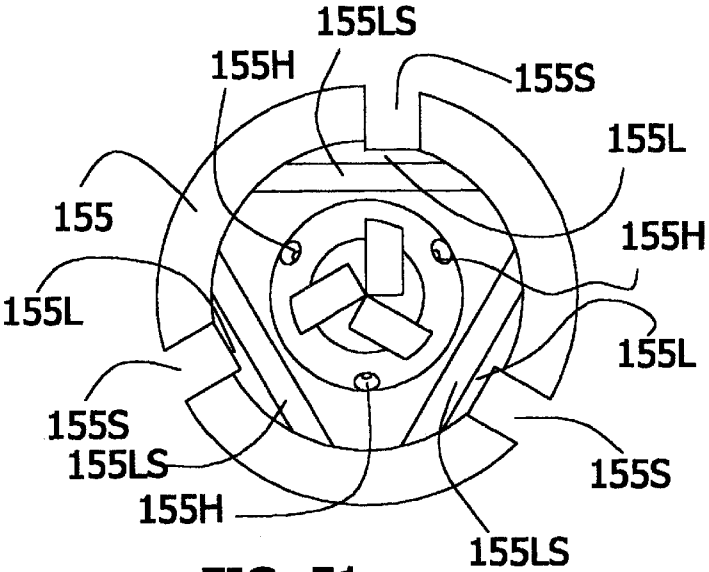
FIG. 51 is a front view of the shaft retainer cut to hold the rotational cutting means.
Figure 53:
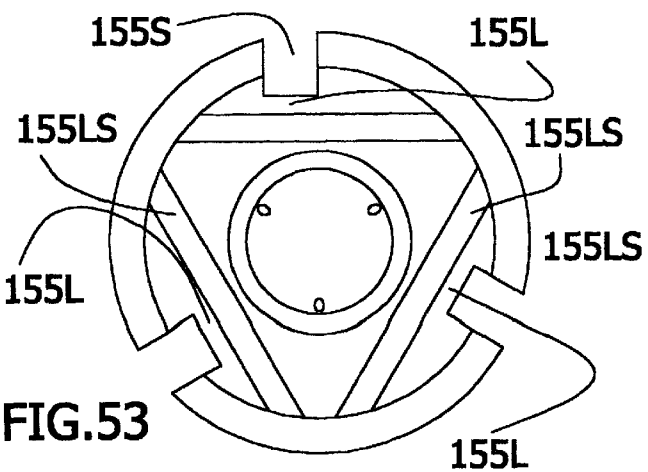
FIG. 53 is a rear view of the shaft retainer.
Figures 55, 56, 57:
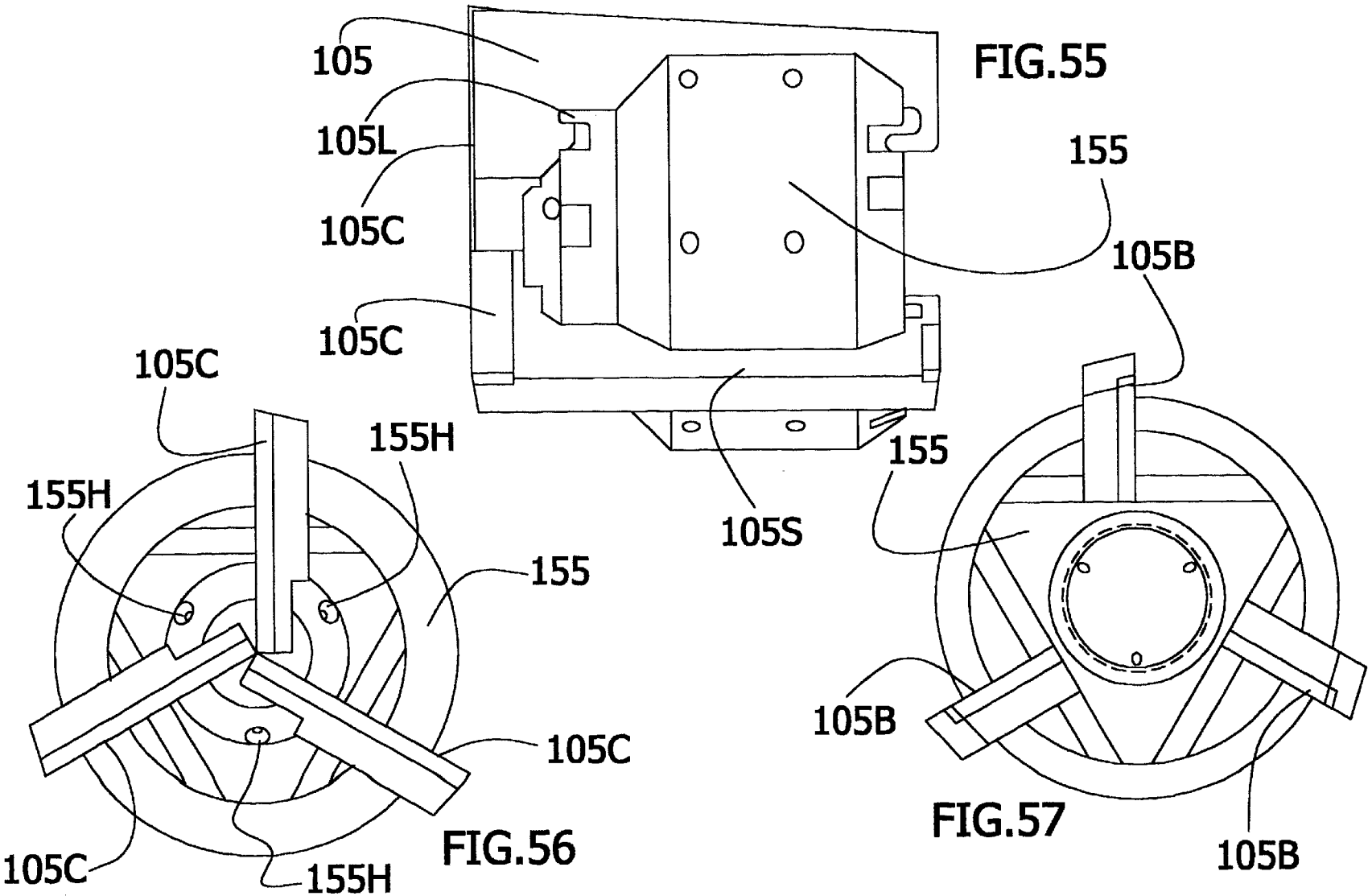
FIG. 55 is a side view of the assembled rotational cutting means.
FIG. 56 is a front view of the assembled rotational cutting means.
FIG. 57 is a rear view of the assembled rotational cutting means.

FIG. 49 shows the clutch assembly in a relaxed state. The housing 113 supports the clutch ring 153 and the clutch stop 147. The male clutch member 171 is forward of the clutch ring 153. The clutch ring 153 is positioned so that the lugs 147L on the clutch stop 147 are located in and engaged with the cutouts 153C on the clutch ring 153. The cam pins 153P are positioned in the cam groove 147C. The elastic bands 153R and 153S are position so that one end is held by a cam pin 153P and stretches through the groove 153G to the pin 147P that is mounted on the opposite lug 147L. In this relaxed state, the elastic bands 153R and 153S keep the clutch ring 153 rotated clockwise as seen from the rear of the drilling apparatus. Being fully rotated clockwise the cam follower pins 153P are positioned in the apex of the cam grooves 147C and the clutch ring 153 is fully forward, resting against the face of the clutch stop 147.

When the male clutch member 171 is pulled rearward, it will either enter into the clutch ring 153 without any interference, or the respective teeth 153T and 171T will hit. If the teeth 153T and 171T hit, the clutch ring 153 will be forced rearwards. This will cause the cam follower pins 153P to contact the cam grooves 147C, which will force the clutch ring 153 to rotate counter-clockwise as seen from the rear. As the counter clockwise rotation is taking place the elastic bands 153R and 153S are stretching and gaining potential energy. The rearward displacement of the clutch ring 153 is stopped when it contacts the rear ball socket 149. By the time the clutch ring 153 has been displaced fully rearward the cam groove 147C has exhausted its influence on the cam follower pin 153P (FIG. 50). In this position the beveled surfaces 153B and 171B on the clutch rings teeth 153T and the male clutch members teeth 171T will be rotationally aligned so that any further rearward displacement of the male clutch member 171 relative to the clutch ring 153 will cause these surfaces 153B and 171B to push on each other, which will continue the counter-clockwise rotation of the clutch ring 153 relative to the clutch stop. The counter-clockwise rotation will stop when the clutch ring 153 and the male clutch member 171 are located such that each tooth 171T is located between adjacent teeth 153T.

In this position, the male clutch member 171 may be rotated in either direction to rotate the clutch ring 153 and hence the housing 113 in either direction. If it is rotated counter clockwise, the clutch ring 153 will be rotated relative to the housing 113 until the clutch stop lugs 147L contact the edges of the cutouts 153C on the clutch ring 153. Further counter-clockwise rotation of the clutch ring 153 will rotate the housing 113 counter-clockwise. If the male clutch member 171 is rotated clockwise, the cam follower pins 153P will contact the cam grooves 147C, which will force the clutch ring 153 forward. The clutch ring 153 will stop being rotated relative to the housing 113 when the edges of the cutouts 153C in the clutch ring 153 contacts the clutch stop lugs 147L. In this position the clutch ring 153 is back in its starting position. Further clockwise rotation of the clutch ring 153 will rotate the housing 113 clockwise. If the male clutch member 171 has moved forward enough to disengage with the clutch ring 153 but has not rotated the clutch ring 153 clockwise enough to reposition the clutch ring 153 in its starting position, the elastic bands 153R and 153L will contract. This will rotate the clutch ring 153 clockwise causing the cam follower pin 153P to contact the cam groove 147C. As the cam follower pin 153P is rotated clockwise it is being forced forward by the cam groove 147C. The rotation and the forward travel relative to the housing 113 stop when the edges of the cutouts 153C on the clutch ring 153 contact the clutch stop lugs 147L. In this position the clutch ring 153 is in its starting position.

Referring to FIGS. 51–65 the rotational cutting means 105 are individual wings positioned on the shaft retainer 155 in radial positions to form a drill bit. Three slots 155S are cut lengthwise into the shaft retainer 155. On the front and rear of the shaft retainer 155 are cut six slots 155LS perpendicular to the slots 155S such that they leave behind a lip 155L corresponding to the front and rear of each slot 155S. Two dowel-pin holes 155P are drilled perpendicular to each slot 155S such that they are in a position to allow dowel-pins 155D to lock the rotational cutting wings 105 in place. The dowel-pin holes 155P are drilled so that the dowel-pins 155D can be inserted and extricated from the direction of rotation such that upon rotation in the proper and common direction, the dowel-pins 155D will not be pushed out of the dowel-pin holes 155P. Smaller diameter hole portions are formed in the member 155 on the side of each slot to allow the dowel-pins to be pressed out. On the front of the shaft retainer are three openings 155H that allow water or other medium to escape from inside the shaft 101. The individual cutting wings 105 have a section behind the actual cutting area 105C that is called the shank 105S. The shank 105S is of a shape that will fit into one of the slots 155S with little clearance. On the front is a front hook 105F. On the rear is a rear hook 105R. A second cutting surface 105B faces toward the rear. Two dowel-pin holes 105D are drilled in the middle of the shank 105S. FIGS. 58–65 show the rotational cutting means 105 being mounted onto the shaft retainer 155 in steps. First the shank 105S is held in line with the slot 155S, then lowering the rear end of the shank 105S so that the rear hook 105R is engaged with the rear lip 155L of the shaft retainer 155. Then the rotational cutter 105 is rotated downwards into the slot 155S until it comes to rest in the bottom of the slot 155S. In this position the rotational cutting means 105 can be pulled rearwards. This engages the front hook 105F with the front lip 155L and lines up its dowel-pin holes 105D with the dowel pin holes 155P in the shaft retainer 155. Then dowel-pins 155D are inserted into each dowel-pin hole 155P.

Figures 66, 67, 68:
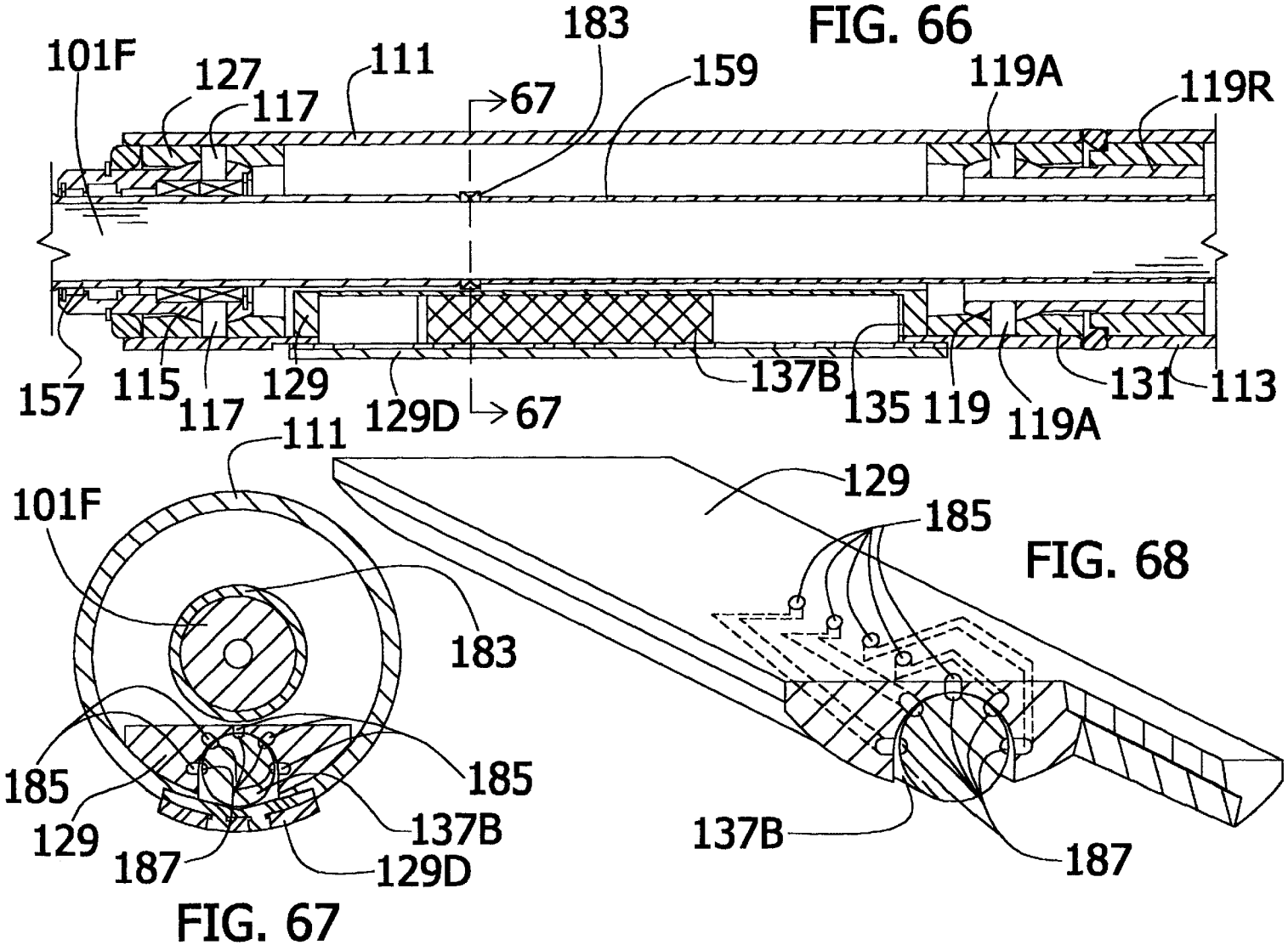
FIG. 66 is a cross sectional view of the front end of the drilling apparatus showing the magnetic displacement device in use.
FIG. 67 is a cross sectional view of FIG. 66 taken along the line 67—67 thereof.
FIG. 68 is an isometric view of the transmitter housing with magnetic sensitive wires positioned to indicate longitudinal displacement of the shaft.
Figure 69:
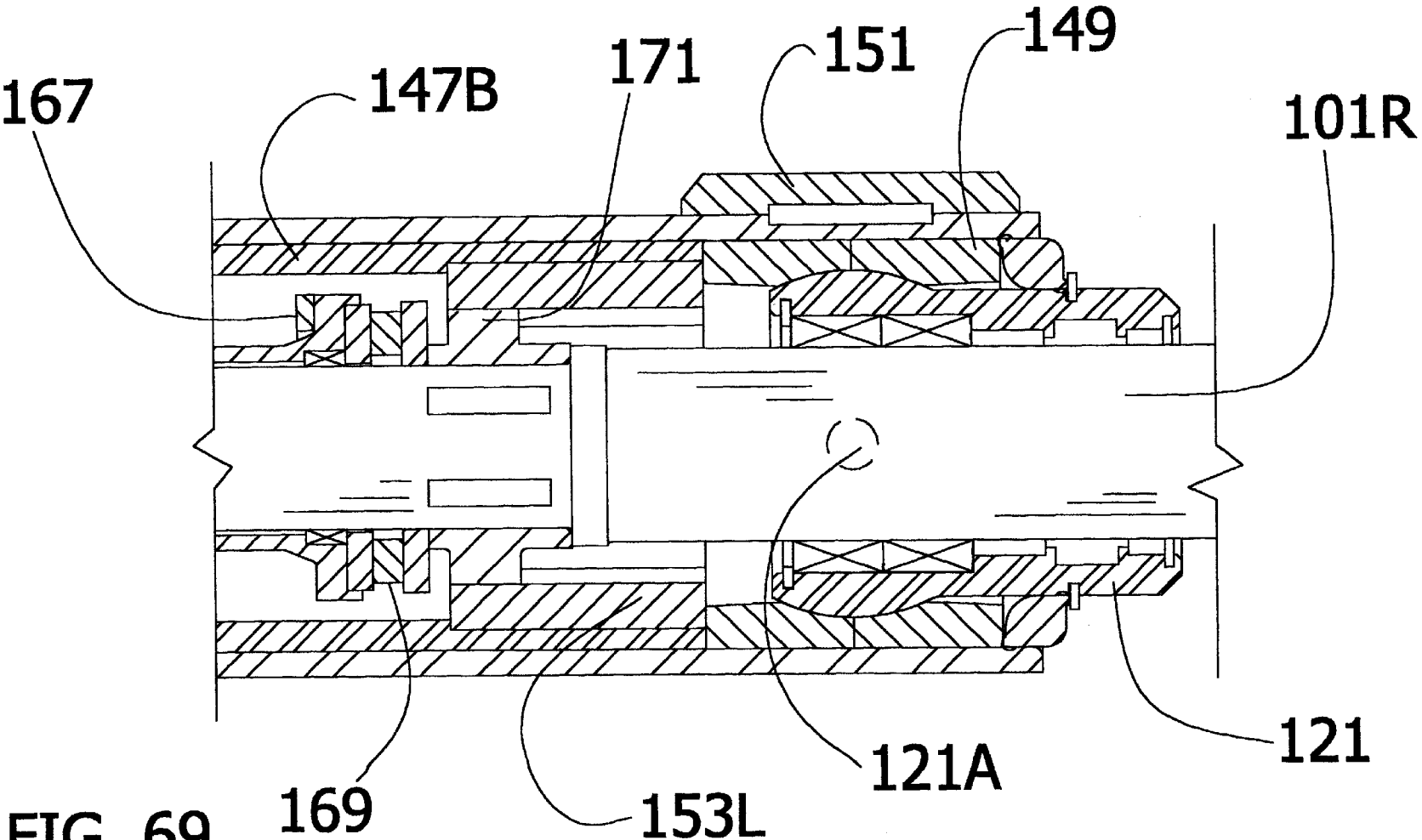
FIG. 69 is a cross sectional view of the rear of the apparatus using a longer clutch means.

Referring to FIGS. 66–68, a magnet 183 is magnetically isolated from but locked onto the shaft 101 in a position which allows it to pass longitudinally in the area of the transmitter case 129 when the shaft 101 is displaced longitudinally relative to the front housing 111. The transmitter case 129 is made of non-magnetic material and has a number of magnetic conducting strips 185 isolated from each other. Each strip 185 has an end positioned in a different longitudinal position with its other end positioned in a different radial position around the transmitter cavity 135. A special transmitter 137B such as the Digitrac Eclipse produced by Digital Control Inc. has to be used. This transmitter 137B is built with magnetically sensitive switches 187 that when activated send signals to the receiver to be viewed by the locator and ultimately by the operator Referring to FIG. 69 the female clutch member 153 and the clutch stop 147 of FIGS. 1–68 are replaced in the drilling apparatus by a longer female clutch member 153L and a corresponding clutch stop 147B. This makes the housings 111 and 113 of the drilling apparatus of FIGS. 1–68 rotate while the bore is being drilled straight as well as when it is in the shifting mode. The clutch will be disengaged when the drilling apparatus is in the turning mode.

Figure 70:
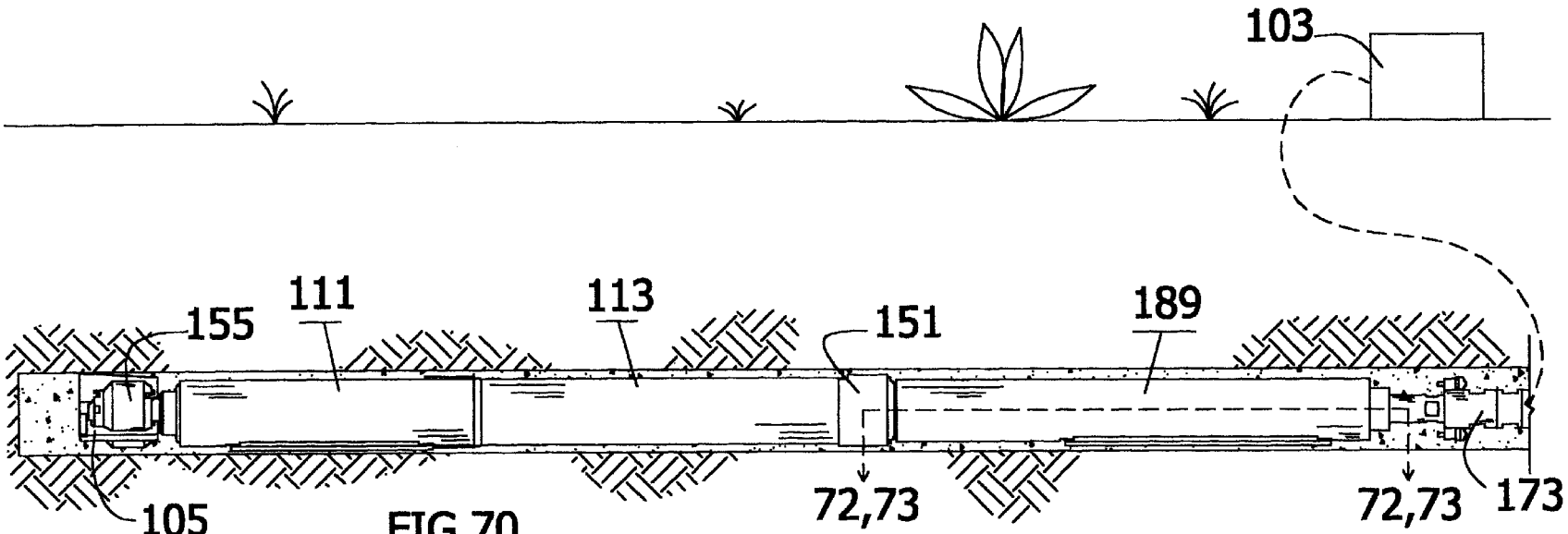
FIG. 70 is a top view of the drilling apparatus with a third housing attached.
Figure 71:
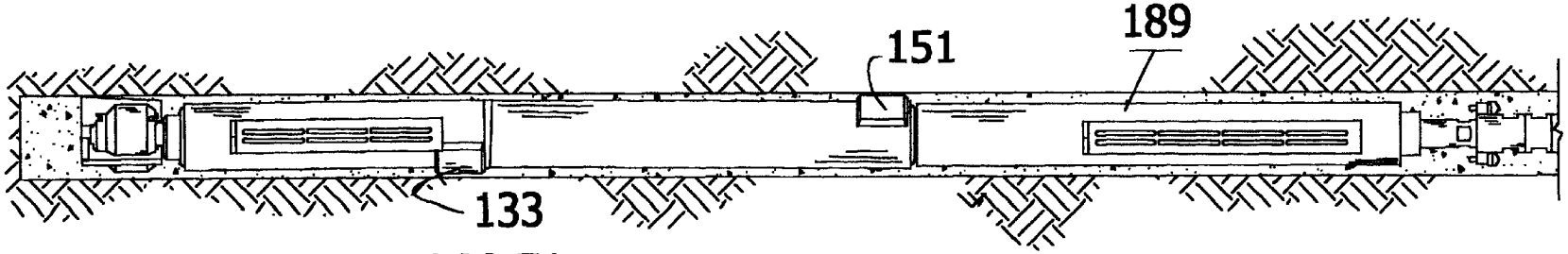
FIG. 71 is a side view of the drilling apparatus with a third housing attached.
Figure 72:
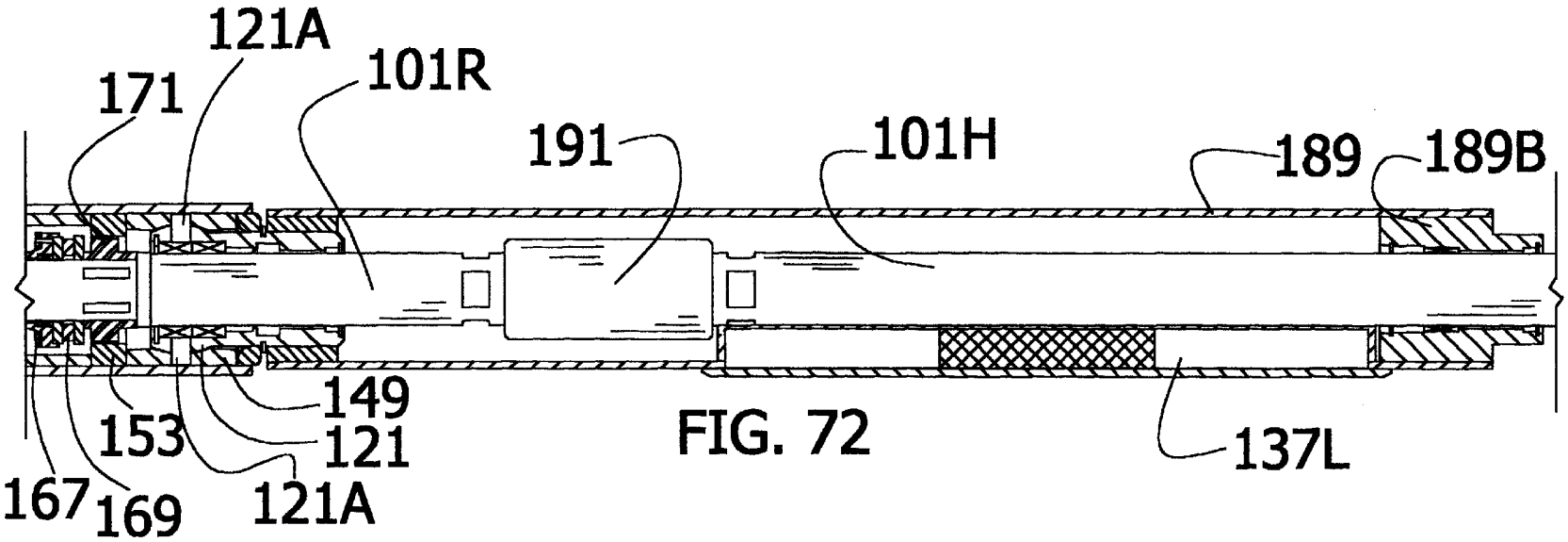
FIG. 72 is a cross sectional view of FIG. 70, using a standard transmitter, taken along the lines 72—72 thereof.

Referring to FIGS. 70–72 a third housing 189 may be attached to the rear of the drilling apparatus via the rear ball 121 such that it is rotationally and longitudinally locked to the drilling apparatus. A third housing shaft 101H is attach to the rear end of the shaft 101R via a standard collar 191 such that the third housing's axis is parallel to the shaft 101 and the third housing shaft 101H is fixedly attached to the shaft 101. The rear of the third housing 189 is supported on the third housing shaft 101H via a bearing compartment 189B. The third housing 189 is designed to hold a larger transmitter 137L than can be held in the normal transmitter compartment 135, which is sometimes needed or preferred to produce a bore. One such transmitter is the Subsite produced by Charles Machine Works Incorporated.

Figure 73:
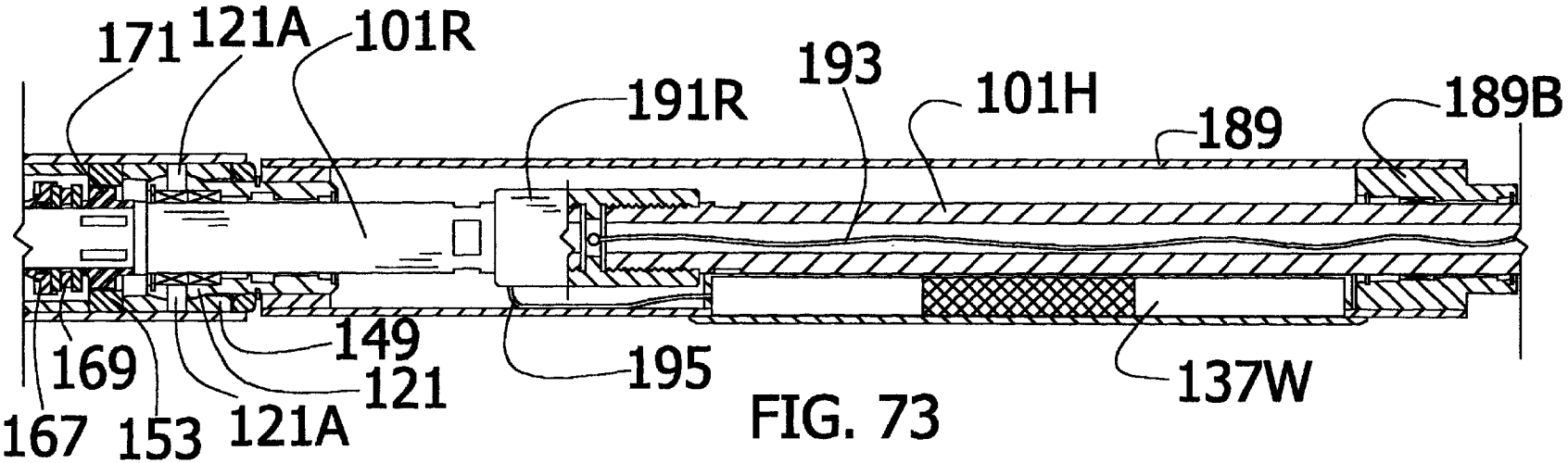
FIG. 73 is a cross sectional view of FIG. 70, using a Wireline transmitter, taken along the lines 73—73 thereof.

Referring to FIG. 73 in the third housing 189 a ring collar 191R can be used, instead of the standard collar 191, to attach the rear of the shaft 101 and the front of the third housing shaft 101H. On the inside of the ring collar 191R is attached a wire 193. The wire 193 is fed back through the shaft 101H and ultimately to the drilling rig 103 and onto a receiver. The wire 193 is spliced and made longer upon the addition of each new drill stem. A brush 195 is provided to transmit a signal from a wireline transmitter 137W that is housed in the third housing 189. The brush 195 is touching but not solidly attached to the ring collar 191R such that a constant connection is achieved even when the shaft 101 is rotating or moving longitudinally relative to the third housing 189. Wireline transmitters are special but not uncommon for longer and/or deeper bores.

Operation

After the crew foreman has determined the bore path, the crew sets up the drill rig, in this case a Vermeer 24/40 produced by Vermeer Manufacturing Incorporated. With the lead drill stem already on the drill rig, the crew threads the drilling apparatus onto it. The crew will then insert transmitter 137 and calibrate it with the receiver located at the surface. The foreman has chosen to use a cutting means/wear pad ratio that would allow the drilling apparatus to rotate 360-degrees about its own axis when in the shifting position even in a curved hole. He could have chosen a number of different ratios, anywhere from barely turning for sewer bores, to a 1/1 ratio which would give him the tightest turn, but would not allow the drilling apparatus to rotate about its own axis in a curved hole. Although, rotating about it's own axis in a curved hole is not necessary to its operation, at times it can be handy. Starting at a 15-degree angle with the horizon and the drilling apparatus set to drill straight, the operator of the drill rig begins the bore.

Initially, the operator of the system will start out with the followers 177A and 177B in the groove positions 145E as shown in FIG. 36 in order to drill straight. The operator drills straight until the drilling apparatus is about 4' deep. At this time, he pulls back on the drill stem. This causes reactions in the drilling apparatus, 1) the clutch engages 171 to 153, 2) the shifting cam followers 177A and 177B pull back spinning the shifting cam 145, and 3) the cam follower lugs 163S and 163L slide rearward relative to the guide housings 111 and 113.

The operator can now rotate the drilling apparatus to the desired orientation, in this case 12:00. This places the front wear pad 133 on the bottom of the drilling apparatus and the rear wear pad 151 on the top of it. The operator can now push the drill stem forward. This causes 1) the clutch to disengage 171 from 153, 2) the shifting cam followers 177A and 177B are pulled forward rotating the shifting cam 145, and 3) the cam follower lugs 163S and 163L ride up the main cam 123 which causes the guide housings 111 and 113 to bend or pivot relative to each other and the shaft 101 so that the front wear pad 133 pushes against the bottom of the bore 179, in the middle of the drilling apparatus, while the rear wear pad 151 pushes on the top of the bore. This reaction forces the cutting means 105, located on the front of the drilling apparatus upward, changing the direction of travel. When the drilling apparatus has reached its full deflection using the chosen cutting means/wear pad ratio, the turning radius is approximately 110 feet. (Note: choosing other cutting means/wear pad ratios will change the radius of the bore.)

The operator can continue turning until he has achieved his desired degree of deviation or until he has to add another drill stem. While adding another drill stem, it is a good time for the crew's locator to check the position of the drilling apparatus, which includes its inclination, and its X, Y and Z position, with the receiver. For a consistent reading the drilling apparatus needs to be positioned in the same clock position every time. For the best reading, the drilling apparatus needs to be in a 3:00 rotational position, as indicated by the receiver. To do this the operator pulls back on the drill stem approximately 5 inches, then pushes forward approximately 2 inches, and finally pulls back approximately 3 inches. This causes the lugs of followers 177A and 177B to be located in the cam groove positions 145C as depicted in FIG. 44A, 145E, as depicted in FIG. 44C, and 145D and as depicted in FIG. 44E respectively. In this position the clutch is engaged and the drill stem can rotate the drilling apparatus until the receiver indicates a 3:00 position. While the drill stem is being changed the locator can take his reading.

After adding a new drill stem and calculating his heading the foreman chooses to drill straight. To do this the operator needs to push forward approximately 2 inches and then pull back approximately 2 inches and then forward approximately 4 inches and then back ward approximately 2 inches. This causes the lugs of the cam followers 177A and 177B to be located in the cam groove positions 145A as depicted in FIG. 44G, 145B, as depicted in FIG. 44(I), 145M, as depicted in FIG. 44M, and 145C, and as depicted in FIG. 44P respectively. In this position he should be able to rotate the drill stem without rotating the drilling apparatus. This indicates that the next time he pushes forward he will be drilling straight. Then pushing forward, he can drill straight for as long as he wants. After drilling for a short distance he notices that the drilling apparatus has drifted slightly off course. Since he is installing steel casing and does not want a major bend in the bore where the pipe will be placed, he decides to use the minor turn feature of the drill head. To do this the operator moves the drill stem back approximately 2 inches, then forward approximately 1 inch, then backward approximately 1 inch, and then pushing forward he can start to drill. This locates the lugs of the followers 177A and 177B in the groove positions 145D as depicted in FIG. 44E, 145A, as depicted in FIG. 44G, 145B, as depicted in FIG. 44(I), and 145M, and as depicted in FIG. 44M respectively. This will cause the drilling apparatus to change directions, but not as quickly as when using the major turn feature.

By oscillating or moving the shaft 101 in and out relative to the drilling apparatus the operator has the choice of a major turning radius, a minor turning radius, or drilling straight. The foreman continues to manipulate the drilling apparatus to achieve his goal of installing steel casing in a directional bore. Furthermore, the foreman has control of the degree of turn that each turning radius gives him by adjusting the diameter of the cutting means in relation to the diameter of the front wear pad and/or the diameter of the rear wear pad before the bore is even started. In this embodiment, while the drilling is being carried out the housings 111 and 113 slide along the bore hole being drilled by the cutting means 105.

Figures 74, 75, 76:
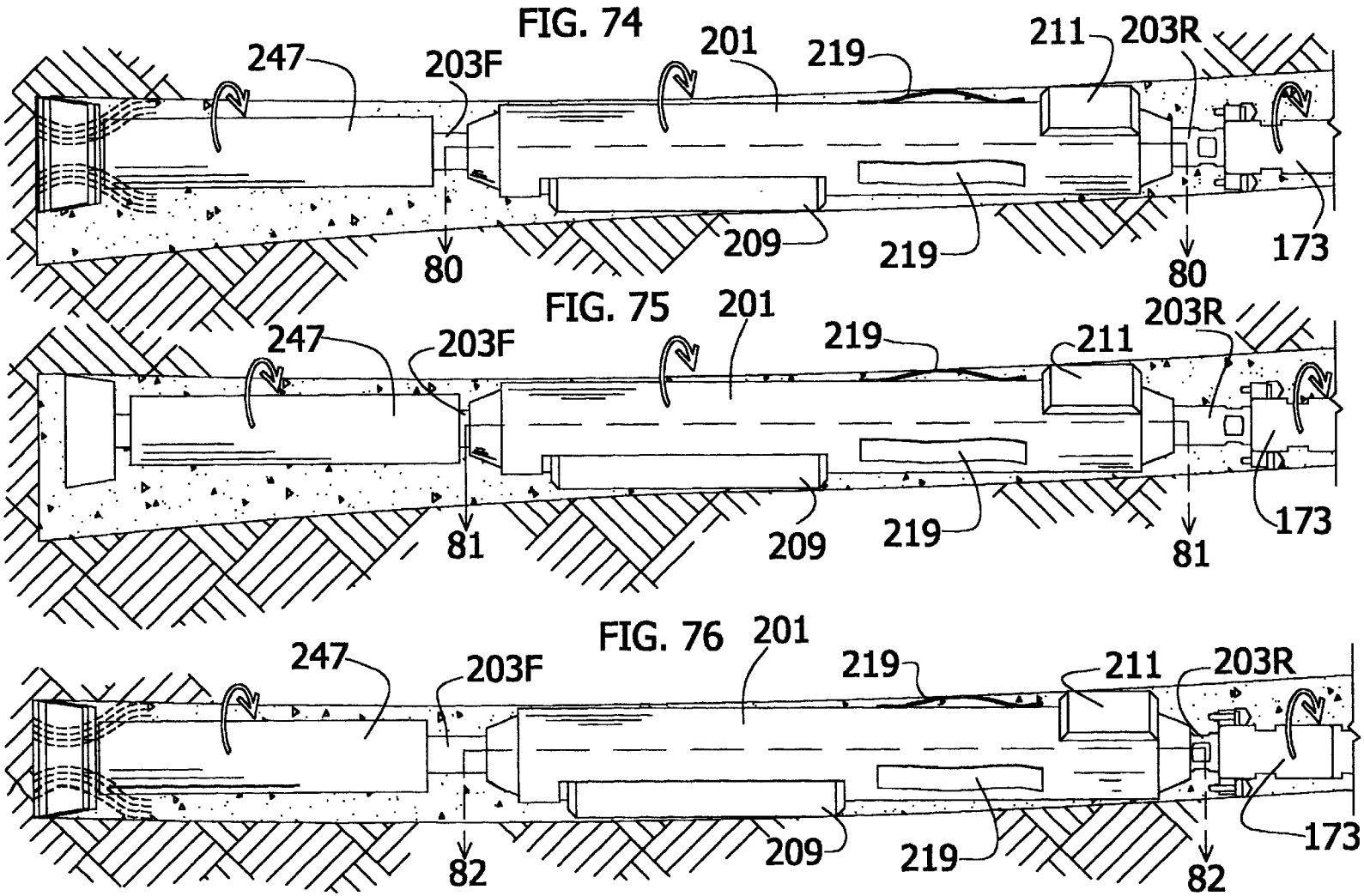
FIG. 74 is an illustration of the alternative drilling apparatus using a percussion type cutting means in the straight drilling mode.
FIG. 75 is an illustration of the alternative drilling apparatus using a percussion type cutting means in the shifting mode.
FIG. 76 is an illustration of the alternative drilling apparatus using a percussion type cutting means in the turning mode.
Figures 77, 78, 79:
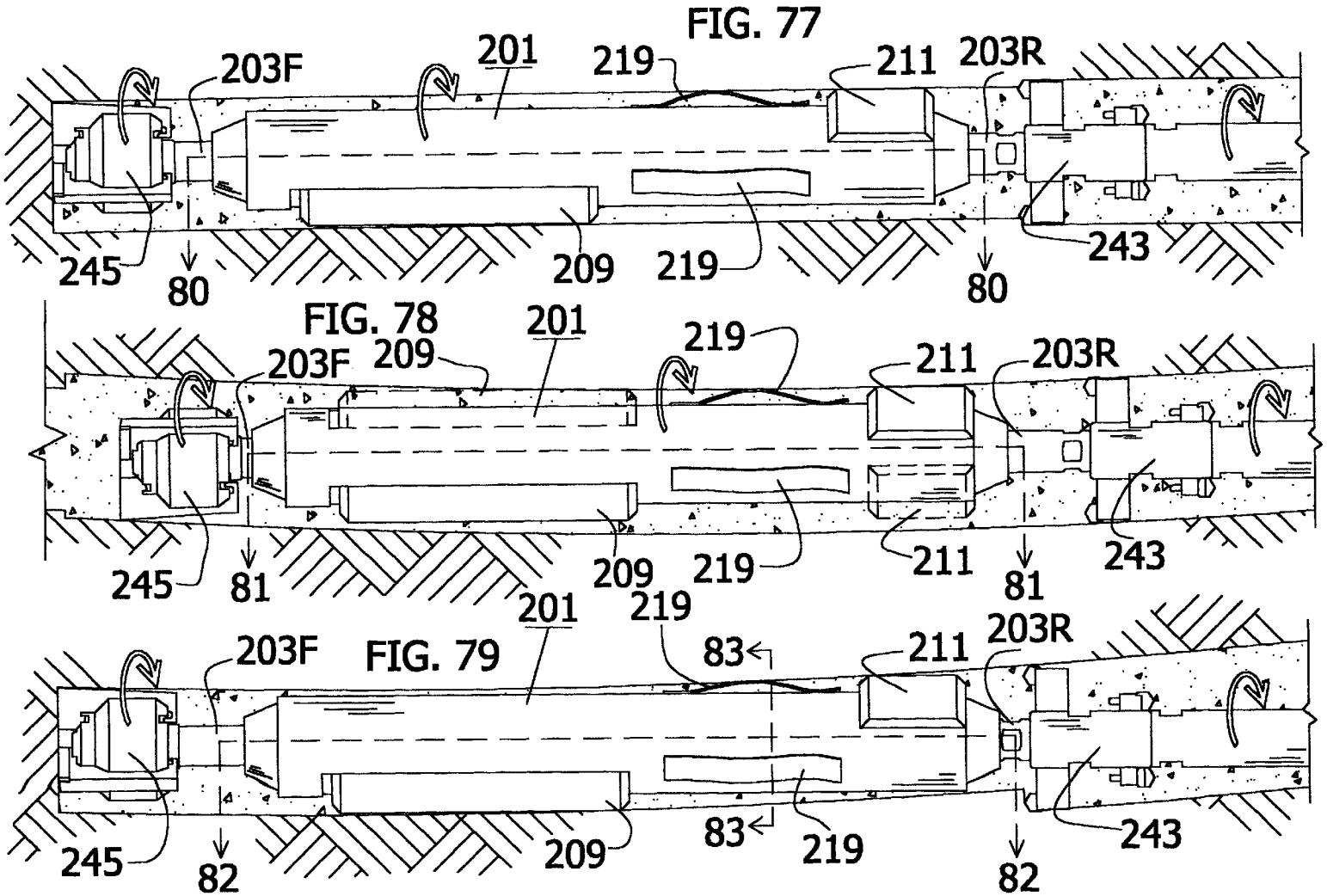
FIG. 77 is an illustration of the alternative drilling apparatus using a rotational type cutting means in the straight drilling mode.
FIG. 78 is an illustration of the alternative drilling apparatus using a rotational type cutting means in the shifting mode.
FIG. 79 is an illustration of the alternative drilling apparatus using a rotational type cutting means in the turning mode.

FIGS. 74–83 refer to another embodiment of the invention. This embodiment has a single housing 201. A shaft 203 passes through the housing 201 such that its forward end 203F passes out of the front of the housing 201 and its rear end 203R passes out of the rear of the housing 201. On the shaft's front end 203F is mounted a cutting means. The cutting means may be a rotary type 245 as shown in FIGS. 77–79 or a percussion type 247 as shown in FIGS. 74–76. In this embodiment the housing 201 rotates with the shaft 203 while straight drilling is being carried out and the housing 201 does not rotate with the shaft while turn drilling is being carried out. The housing 201 is supported on both ends by bearings 205 and is sealed by seals 207. The shaft 203 is free to rotate and move longitudinally relative to the housing 201. The housing supports a front wear pad 209 and a rear wear pad 211. The two wear pads 209 and 211 are 180 degrees from each other and on opposite ends of the housing 201. The resulting central axis of the housing 201 is offset from the central axis of the shaft 203 which allows the wear pads 209 and 211 to influence the direction of travel by contacting the bore wall outside of the cutting diameter. The outside of at least one of the wear pads lies outside of the cutting diameter of the cutting means. On the outside of the housing 201 are three spring-loaded friction arms 219 that add resistance to rotation.

Inside of the housing 201, from front to back, is a front housing support 213, a transmitter housing 215, a forward stop 217, a rearward stop 221, a shifting cam bushing 223 which supports a shifting cam 225 and ties the shifting cam follower 235 rotationally to the guide housing 201, a female clutch member 227, and a rear housing support 229. All of these parts, except the shifting cam 225, are fixedly attached to the housing 201. The shifting cam 225 is longitudinally locked to, but is free to rotate relative to, the housing 201. The cam 225 has grooves formed in its outer surface.

On the shaft is a front sleeve 231, a front thrust bearing 233, a shifting cam follower body 235 supported on the shaft by bearings 235B, a rear thrust bearing 237, a rear spacer 239, and a male clutch member 241. The shifting cam follower body 235 has two shifting cam follower arms 235D and 235A positioned 180 degrees from each other. The shifting cam follower lugs 235L on the shifting cam follower arms 235D and 235A ride in the grooves 225A–225D of the shifting cam 225. All of the parts except the shifting cam follower body 235 which holds arms 235D and 235A are locked to the shaft 203. The shifting cam follower 235 is longitudinally locked to the shaft 203 but is free to rotate relative to the shaft 203. The shifting cam follower 235 is free to move longitudinally with the shaft 203 relative to the housing 201 but is tied rotationally to the guide housing 201, such that it cannot rotate relative to the guide housing 201.

FIGS. 84–95 show the shifting cam follower 235 being longitudinally displaced relative to the shifting cam 225. Since the shifting cam follower 235 is locked rotationally to the housing 201 by the shifting cam bushings 223, the shifting cam 225 is rotated by the lugs 235L of the shifting cam follower 235 pushing on the walls of the shifting cam grooves 225A–225D.

Figures 92, 93, 94, 95:
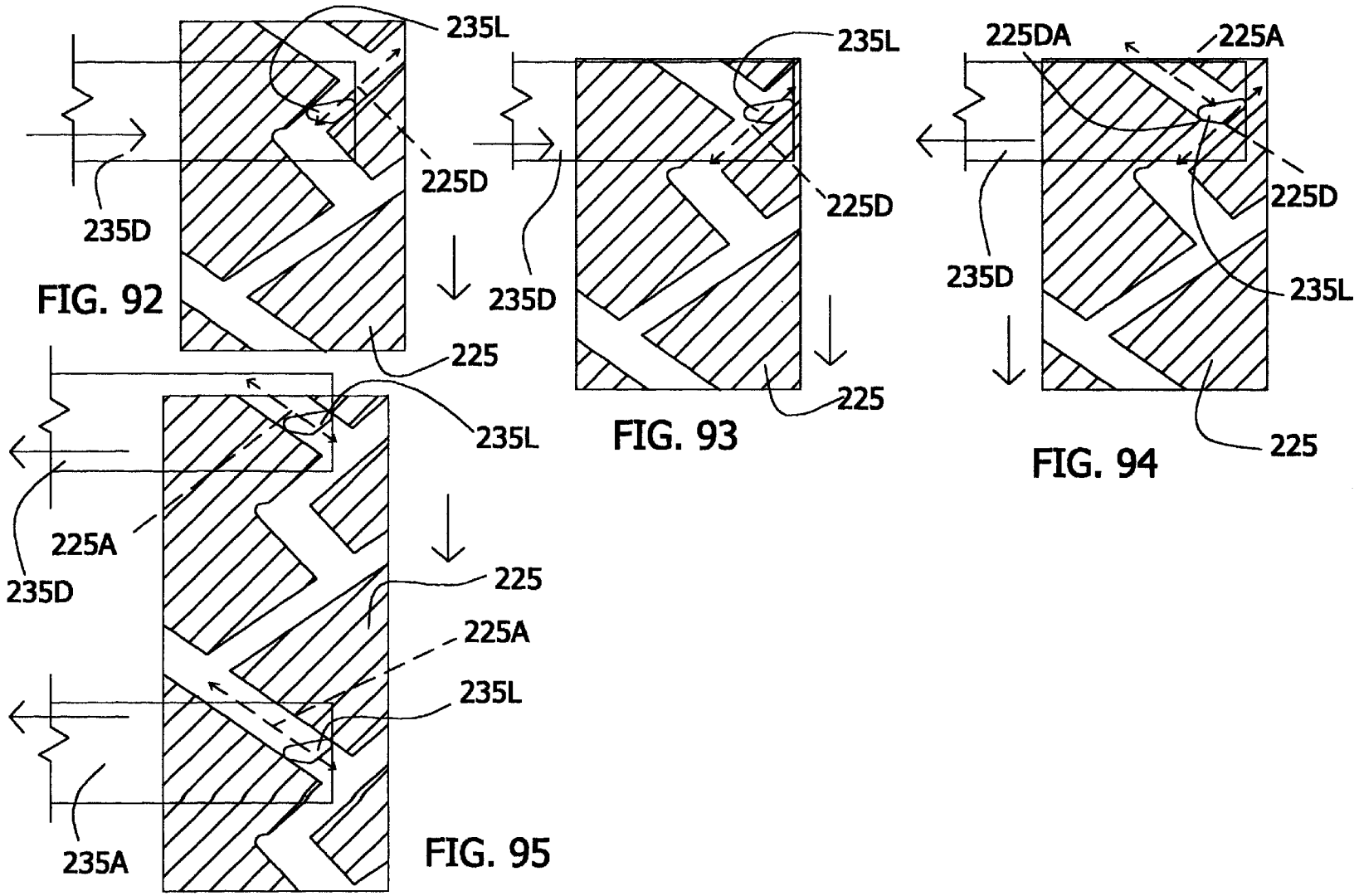
FIG. 92 is a 180-degree flat view of the alternative-shifting cam with the alternative-shifting cam follower in transition from the straight position to the fully rearward position.
FIG. 93 is a 180-degree flat view of the alternative-shifting cam with the alternative-shifting cam follower in the fully rearward position.
FIG. 94 is a 180-degree flat view of the alternative-shifting cam with the alternative-shifting cam follower contacting an intersection of the grooves.
FIG. 95 is a 270-degree flat view of the alternative-shifting cam with the alternative-shifting cam follower in transition between fully rearward and fully forward positions.
Figures 96, 97, 98:
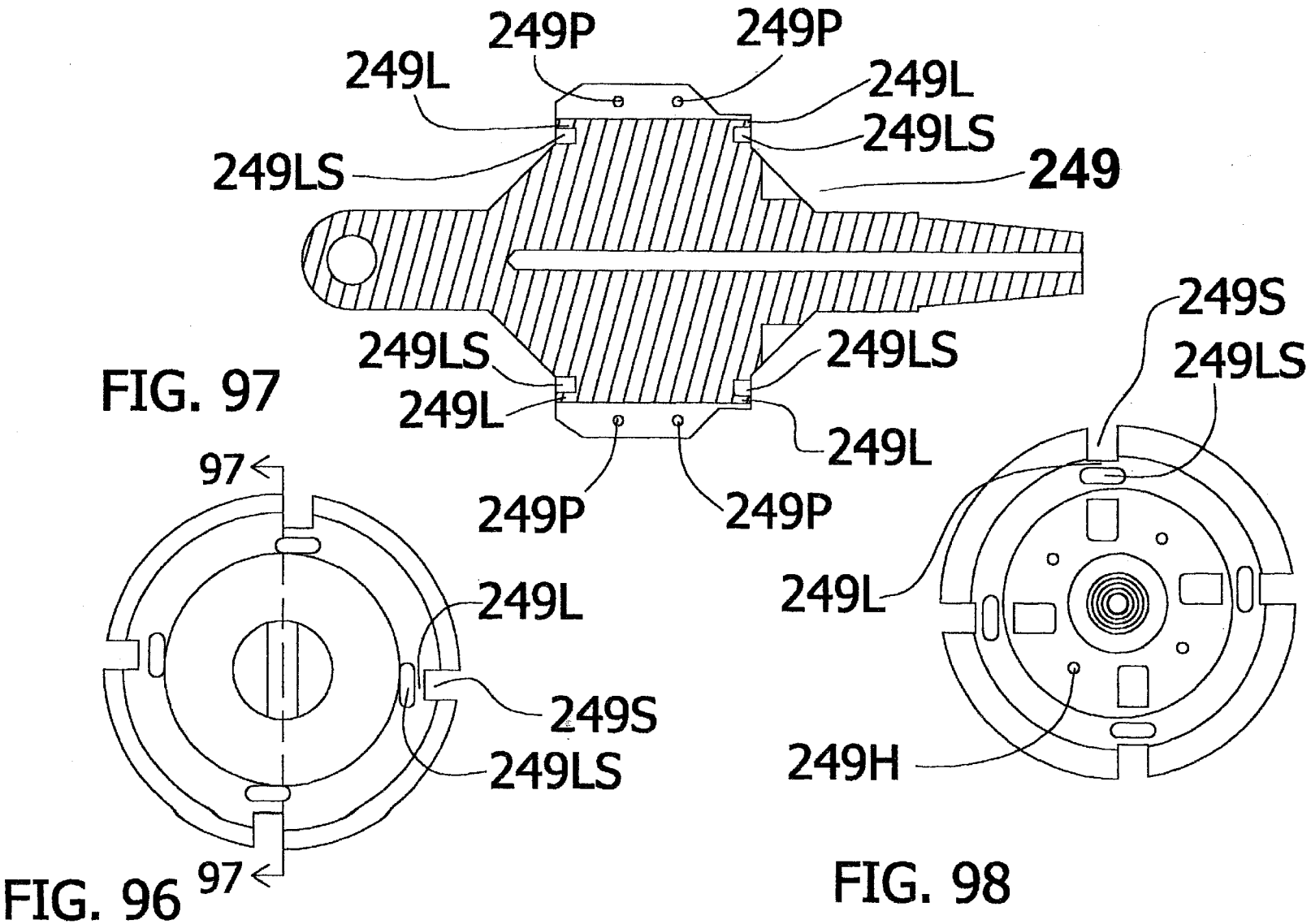
FIG. 96 is the rear view of a hole-opener body.
FIG. 97 is a cross sectional view of the hole-opener body taken along the lines 97—97 thereof.
FIG. 98 is a front view of the hole-opener body.
Figure 100:
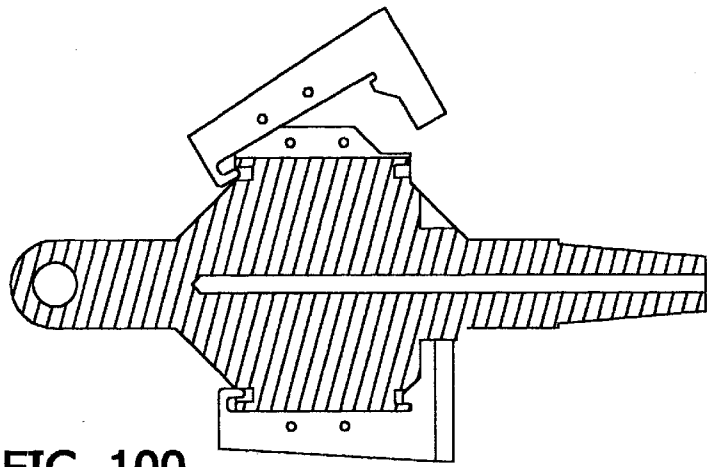
FIGS. 99–104 shows the rotational cutting means being mounted on to the hole-opener body.
Figure 102:
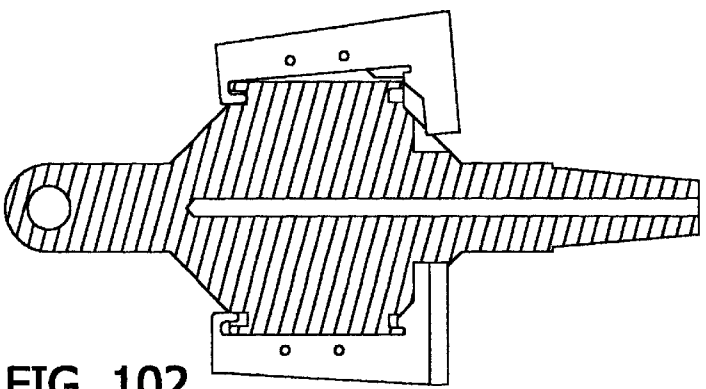
Figure 99:
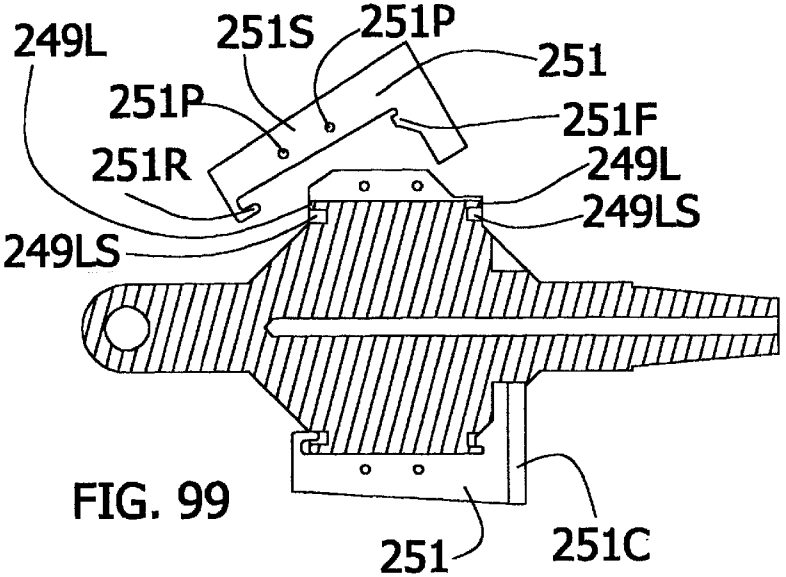
Figure 101:
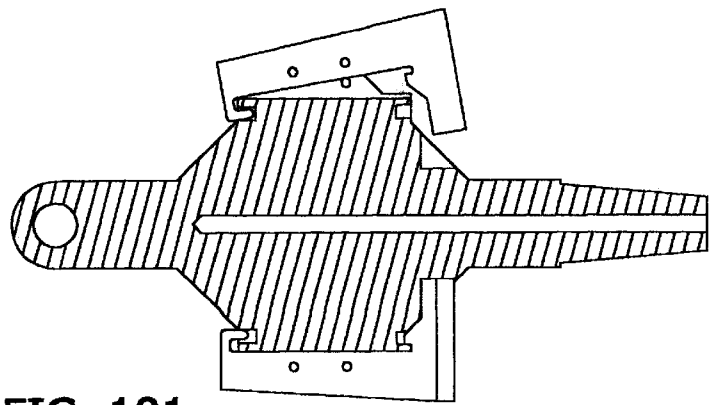
Figure 104:
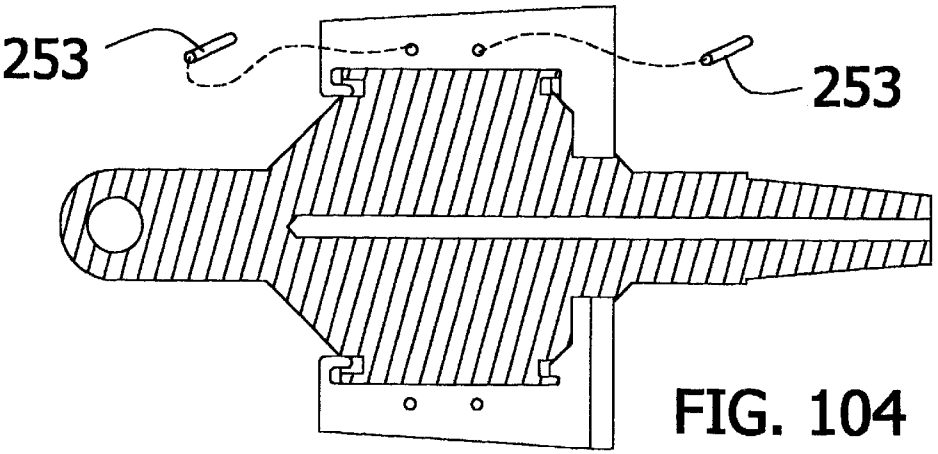
Figure 105:
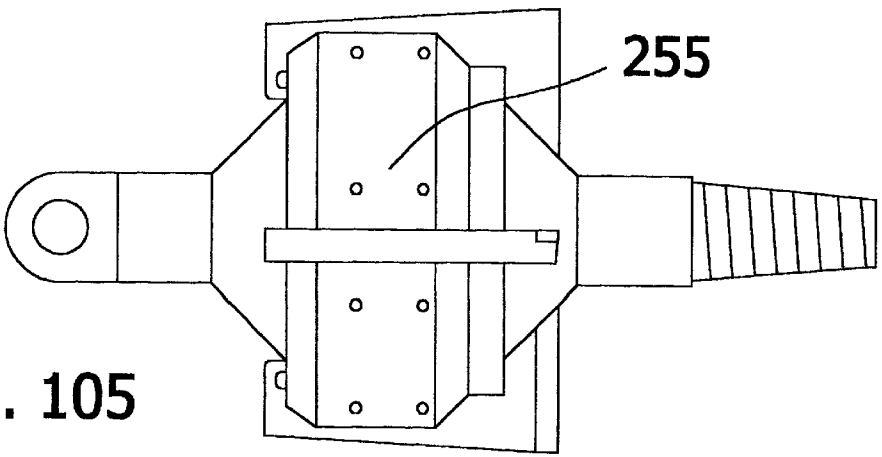
FIG. 105 shows the side view of the hole-opener body with the rotational cutting means mounted thereto.
Figure 103:
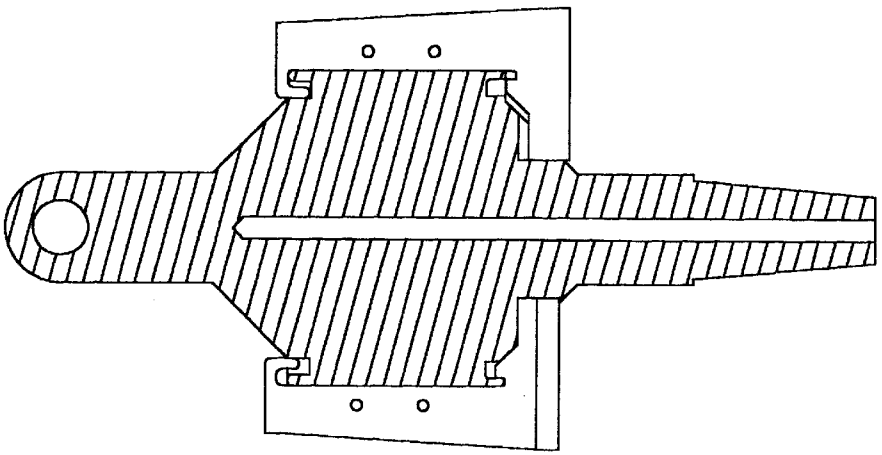
Figure 106:
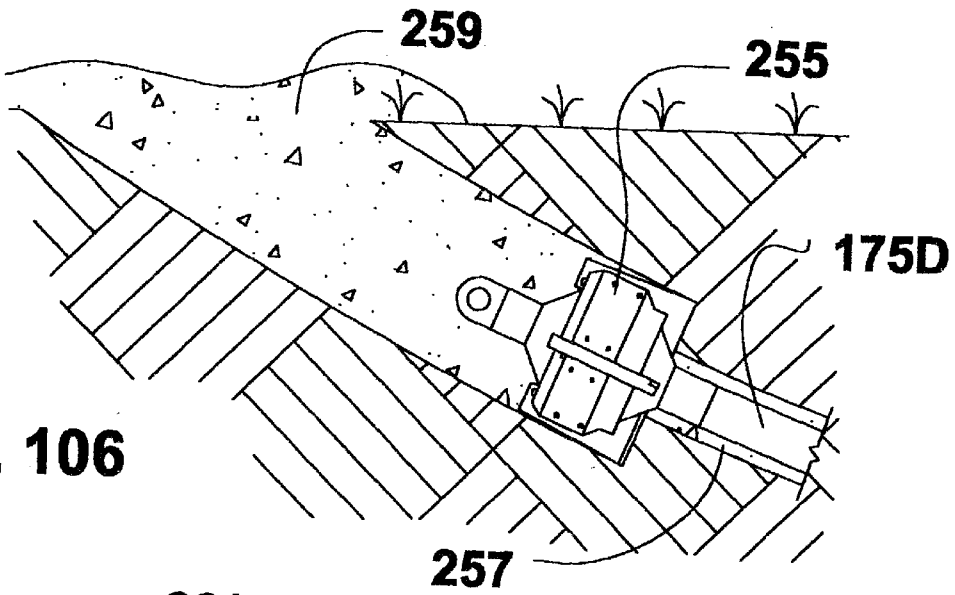
FIG. 106 illustrates the hole opener device of FIG. 105 in use enlarging a hole.

In FIGS. 84–95, the exterior surface of the cam 225 is shown laid flat. The two cam followers 235A and 235D are located 180 degrees apart. In FIG. 95, 270 degrees of the cam 225 is shown and in FIG. 95 both cam followers 235A and 235D are shown. In FIGS. 84–94, only 180 degrees of the cam 235 is shown and only one cam follower 235D is shown although it is to be understood that the complete cam 225 and both followers 235A and 235D will be employed. In FIGS. 84–95 the horizontal arrows depict the direction of longitudinal travel of the followers 235A and 235D and the vertical arrows next to the cam 225 depict the direction of rotation of the cam 225. In FIGS. 84–95, rearward movement of the followers 235A and 235D is to the right and forward movement of the followers 235A and 235D is to the left. The lugs 235L of the followers 235A and 235D can be moved between positions displaced fully rearward as shown by follower 235D in FIG. 87 and to positions fully displaced forward as shown by follower 235D in FIG. 84 and to intermediate positions.

Figures 80, 81:
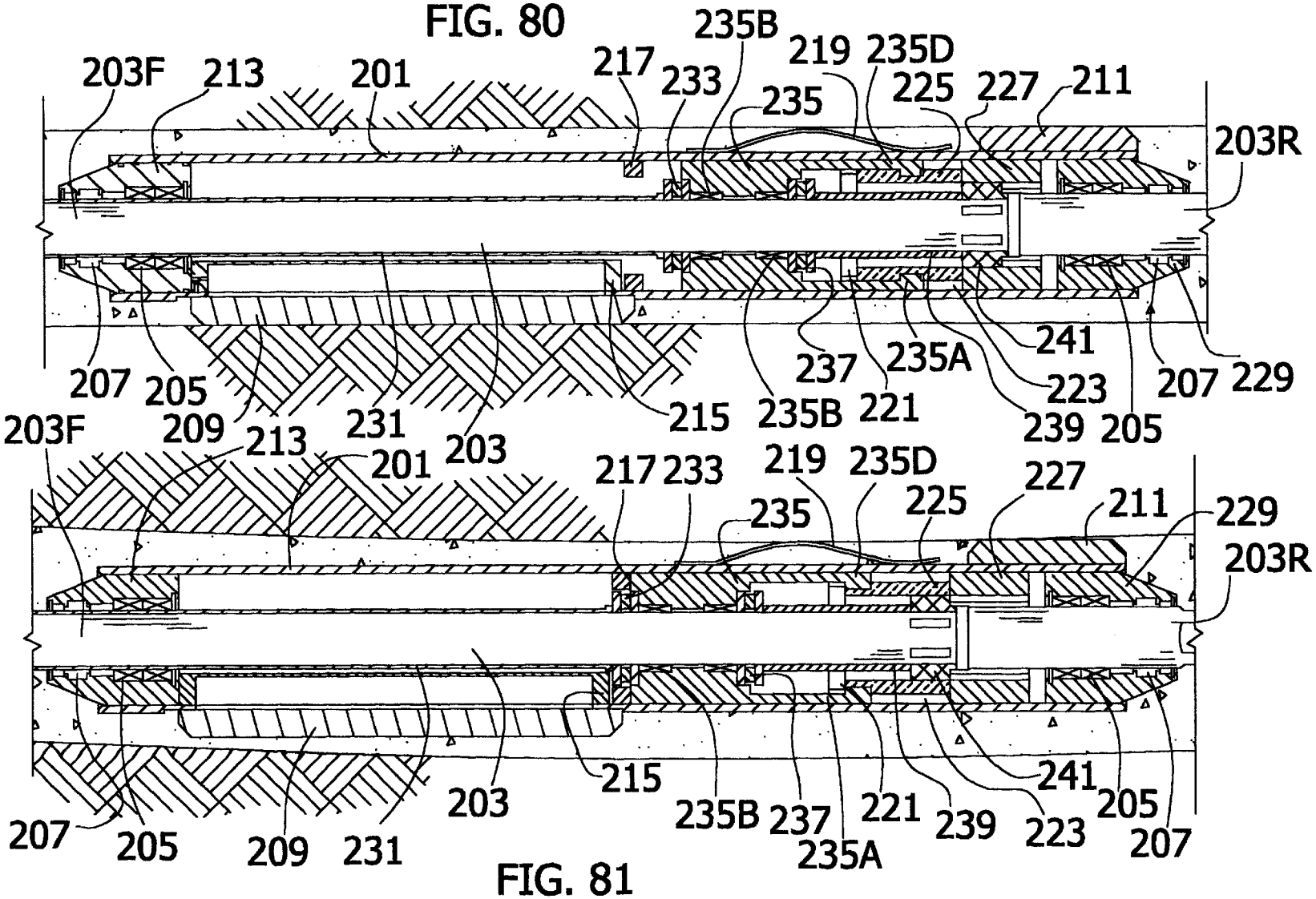
FIG. 80 is a cross sectional view of FIG. 74 and FIG. 77 taken along the lines of 80—80 thereof.
FIG. 81 is a cross sectional view of FIG. 75 and FIG. 78 taken along the lines of 81—81 thereof.
Figure 82:
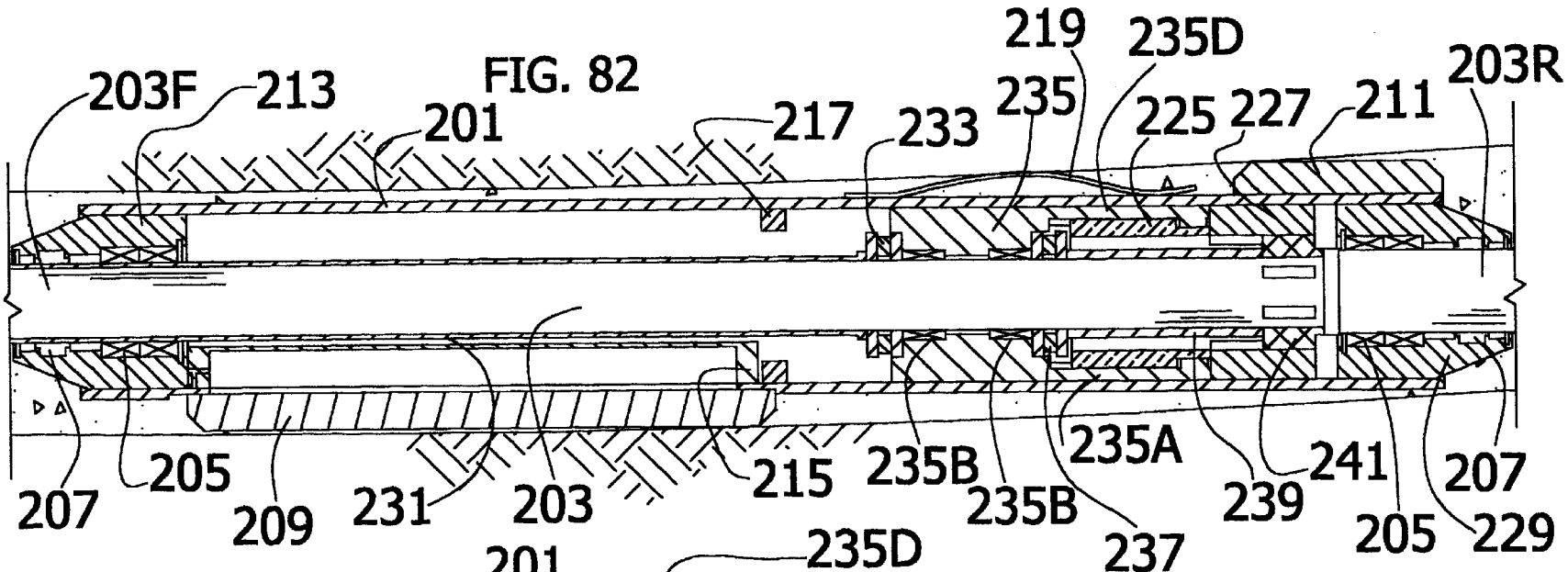
FIG. 82 is a cross sectional view of FIG. 76 and FIG. 79 taken along the lines of 82—82 thereof.
Figure 83:
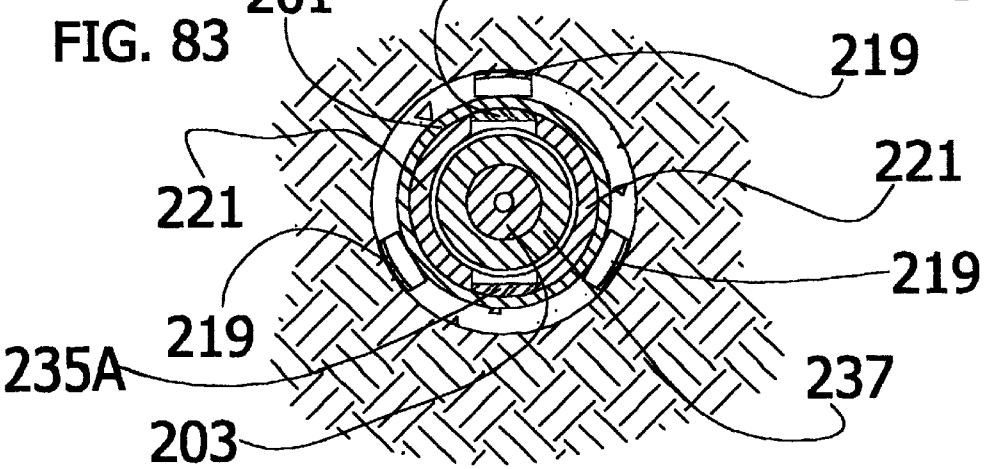
FIG. 83 is a cross sectional view of FIG. 79 taken along the lines of 83—83 thereof.
Figure 84:
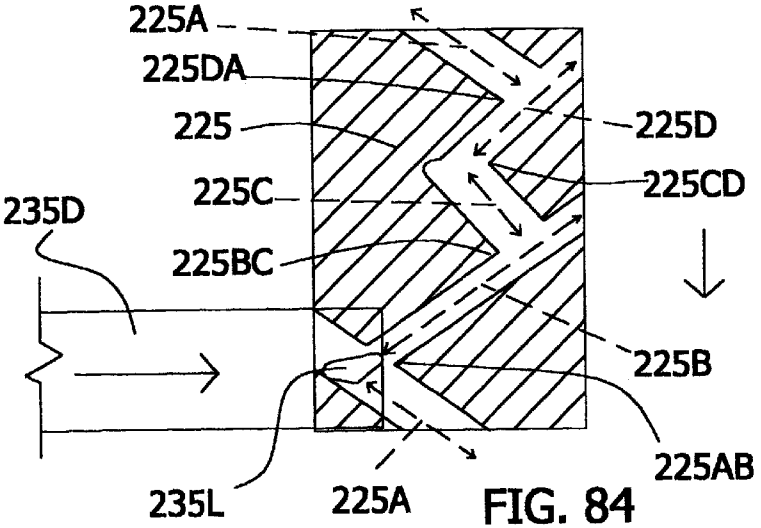
FIG. 84 is a 180-degree flat view of the alternative-shifting cam with the alternative-shifting cam follower in the fully forward position.
Figure 85:
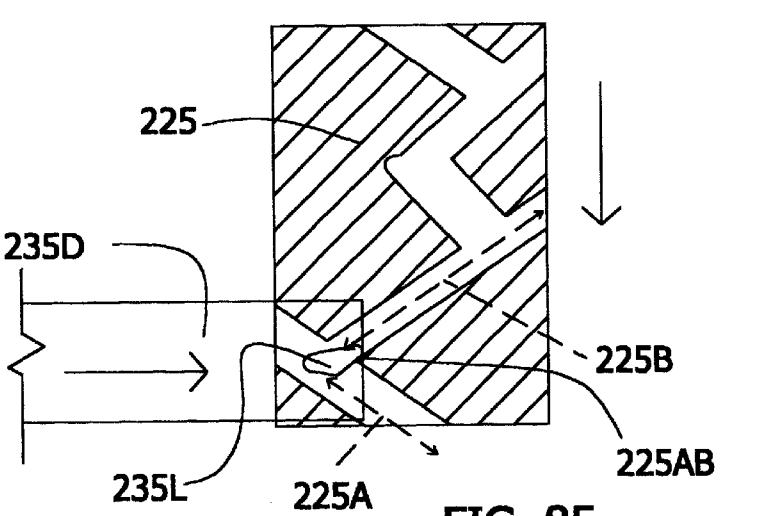
FIG. 85 is a 180-degree flat view of the alternative-shifting cam with the alternative-shifting cam follower contacting an intersection of the alternative shifting cam grooves.
Figure 86:
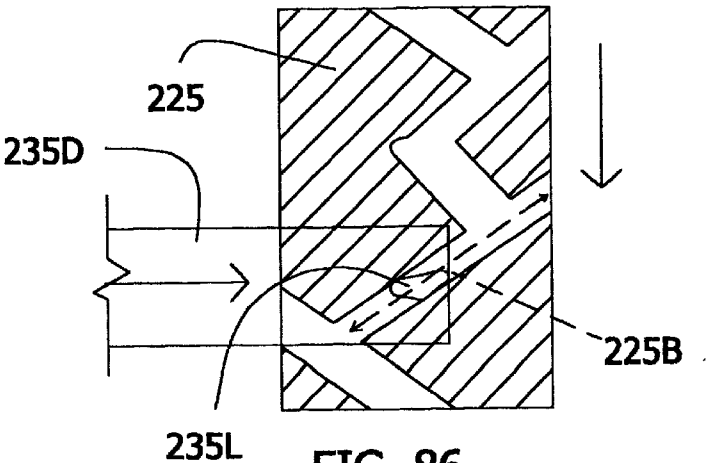
FIG. 86 is a 180-degree flat view of the alternative-shifting cam with the alternative-shifting cam follower in transition between fully forward and fully rearward positions.
Figure 87:
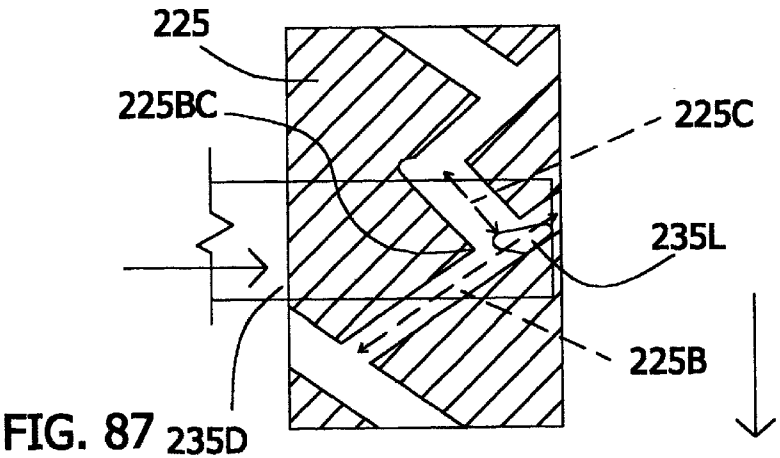
FIG. 87 is a 180-degree flat view of the alternative-shifting cam with the alternative-shifting cam follower in the fully rearward position.
Figure 88:
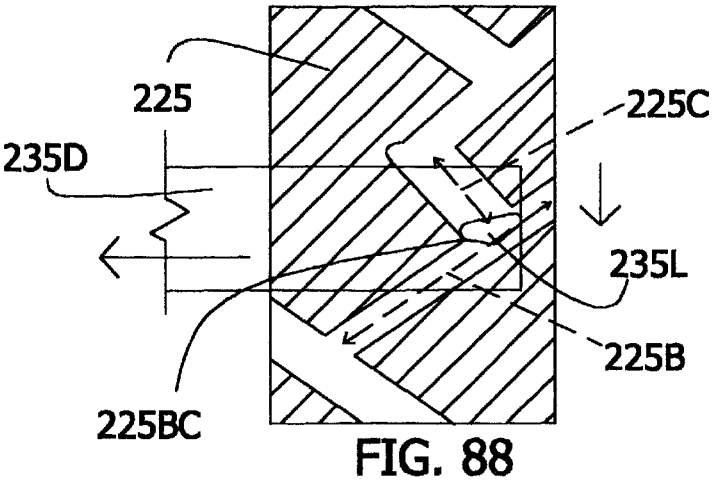
FIG. 88 is a 180-degree view of the alternative-shifting cam with the alternative-shifting cam follower contacting an intersection of the alternative-shifting cam grooves.
Figure 89:
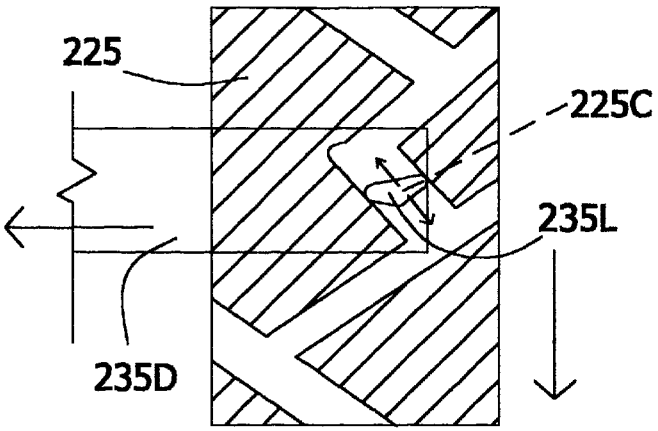
FIG. 89 is a 180-degree flat view of the alternative-shifting cam with the alternative-shifting cam follower in transition between the fully rearward position and the straight position.
Figure 90:
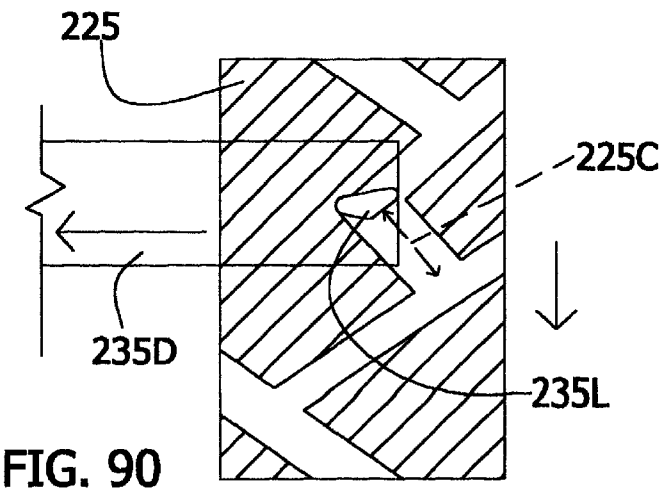
FIG. 90 is a 180-degree flat view of the alternative-shifting cam with the alternative-shifting cam follower in the straight position.
Figure 91:
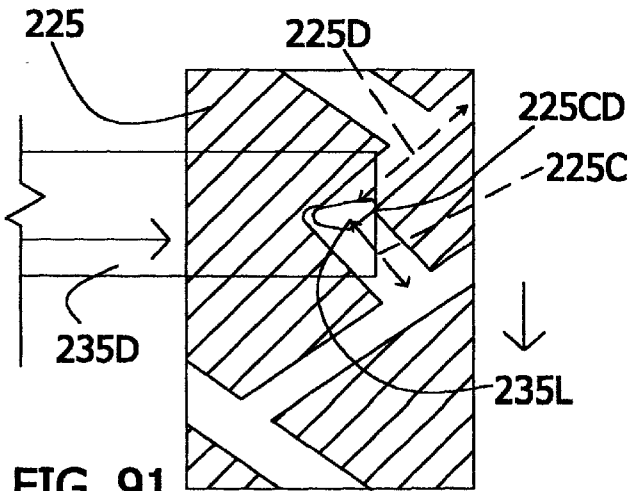
FIG. 91 is a 180-degree flat view of the alternative-shifting cam with the alternative-shifting cam follower in contact with an intersecting groove.

FIG. 84 shows the shifting cam follower arm 235D in the fully forward or turning position. Shifting cam follower arm 235A is not pictured in any of the FIGS. 84–94, but is understood to exist. In this position the clutch means is not engaged. Pulling back on the shifting cam follower arm 235D causes it to contact the shifting cam groove intersection 225AB (FIG. 85). Further rearward displacement causes the shifting cam 225 to be rotated by the shifting cam follower lugs 235L pushing on the wall of the shifting cam groove 225B (FIG. 86). Rearward displacement is stopped when the shifting cam follower body 235 contacts the rearward stop 221 (FIG. 87 and FIG. 82). In this position the clutch means is engaged. Forward displacement of the shifting cam follower arm 235D causes the shifting cam follower lug 235L to contact the shifting cam groove intersection 225BC (FIG. 88). Further forward displacement of the shifting cam follower arm 235D causes the shifting cam follower lug 235L to push on the wall of the shifting cam groove 225C (FIG. 89). This causes the shifting cam 225 to rotate. Forward displacement of the shifting cam follower arm 235D is halted when the shifting cam follower lug 235L contacts the end of the shifting cam groove 225C (FIG. 90). This is the straight drilling position. In this position the clutch means is still engaged and the whole drilling apparatus, including the housing 201, is being rotated as the hole is drilled (FIG. 80). Rearward displacement of the shifting cam follower arm 235D causes the shifting cam follower lug 235L to contact the shifting cam groove intersection 225CD (FIG. 91). Further rearward displacement of the shifting cam follower arm 235D causes the shifting cam follower lug 235L to push on the wall of the shifting cam groove 225D (FIG. 92). This causes the shifting cam 225 to rotate relative to the housing 201. Again the rearward displacement of the shifting cam follower arm 235 relative to the shifting cam 225 is halted when the shifting cam body 235C contacts the rearward stop 221 (FIG. 93 and FIG. 82). In this position the housing 201 can be rotated to a desired clock position in preparation for drilling a curved hole in the chosen direction. Forward displacement of the shifting cam follower arm 235D causes the shifting cam follower lug 235L to contact the shifting cam groove intersection 225DA. Further forward displacement of the shifting cam follower arms 235D and 235A causes the shifting cam follower lugs to push on the walls of the shifting cam grooves 225A (FIG. 95). This causes the shifting cam 225 to rotate. Forward displacement is halted when the shifting cam body 235C contacts the forward stop 217 (FIG. 81 and FIG. 84). In this position the clutch means is disengaged and the housing 201 is held from rotating by friction on the walls of the bore. While the drill stem is rotating and thrusting forward the cutting means 245 or 247, the drilling apparatus is drilling a curved hole. Further manipulations of the drill stems allow the operator to control the direction of travel.

When using a rotary type cutting means 245 with this embodiment, a hole-opener 243 is to be employed directly behind housing 201. The hole-opener 243 is fixedly attached to the shaft 203 and is designed to enlarge the bore enough to allow the entire drilling apparatus to rotate around its own axis, even in a curved hole. If the drilling apparatus is not positioned in a sufficiently large void to allow the drilling apparatus to be rotated about its own axis without hindrance from the bore walls, undue strain and stress will be placed on the drilling apparatus. Furthermore the complete rotation of the drilling apparatus may not be possible in a non-enlarged bore, thus hindering the ability to control the path of the bore.

To use this embodiment with a percussion type cutting means 247, the drilling crew would first thread the drilling apparatus onto the lead drill stem. Then they would mount the percussion head 247 on the front of the drilling apparatus. Next, the transmitter 137 would be inserted under the front wear pad 209. With these things done the bore is ready to begin. Starting with the drilling apparatus in the straight drilling mode and the percussion bit 247 pressed up against the ground, the fluid medium usually either compressed air or water is switched on. This causes the bit 247 to vibrate in and out pulverizing even the hardest rock. As the drilling apparatus is advanced, it is rotated. This makes the bit 247 move in a circular motion with the center of the bore off center from the center of the bit 247. The resultant bore diameter is larger than the cutting bit diameter. As long as the apparatus is moved forward and rotated with the percussion cutting means 247 activated it will drill relatively straight. When the operator wants to change direction, he pulls back on the drill stem. This causes the shifting cam follower 235 to rotate the shifting cam 225. The rearward displacement ceases when the shifting cam follower 235 encounters the rearward stop 221. The drill stem can now rotate the drilling apparatus to the desired rotational position. Once in the desired position, the drill stem can be pushed forward causing the shaft 203 to be forwardly displaced relative to the housing 201. This disengages the clutch means 241 from 227 and causes the shifting cam follower 235 to rotate the shifting cam 225. The forward displacement is halted when the shifting cam follower 235 hits the forward stop 217. The bit 247 is pressed against the earth and the fluid medium is switched on. This causes the bit 247 to vibrate in and out pulverizing the rock. The drill stem can be rotated allowing the bit 247 to impact various spots on the face of the rock being drilled. The bit 247 is rotated about its own center. While turning, the housing 201 is held from rotating by the friction arms 219 that are contacting the wall of the bore. Since the housings wear pads 209 and 211 lay outside of the cutting radius of the percussion means 247, they push on the wall of the bore which in turn pushes on the drilling apparatus moving the cutting means 247 in the opposite direction. The bore can be drilled in the turning mode as far as needed. To drill straight again the drill stem is pulled back. This causes the shifting cam follower 235 to rotate the shifting cam 225 and engages the clutch means 241 to 227. The drill stem is then pushed forward causing the shaft 203 to be displaced relative to the housing 201 until the grooves 225C (FIG. 90) in the shifting cam 225 stop the shifting cam follower 235. In this position the clutch means 241 to 227 is still engaged such that when the drill stem rotates the shaft 203, the entire drilling apparatus, including the housing 201, is rotated. Since the curved hole that the drilling apparatus is now in, is too small to allow the rotation of the drilling apparatus about its axis at first, the percussion means 247 is activated and slowly rotated along with the housing 201 which enlarges the bore diameter. After one revolution, normal drilling can be resumed. The operator can choose between straight and curved drilling at any time. The operator knows that he is drilling straight when he is drilling and the transmitter is showing that the drilling apparatus is rotating. Likewise he knows when he is drilling a curved hole when he is drilling and the transmitter is showing that the drilling apparatus is not rotating.

To use this embodiment with a rotary type cutting means 245. The drilling crew would first thread the drilling apparatus onto the lead drill stem. Then the crew would mount the rotary drill bit 245 on the front of the drilling apparatus. Next, the transmitter 137 would be inserted under the front wear pad 209. Starting with the drill head in the straight drilling mode, the drill stem is rotated and then thrust forward. This makes the drilling apparatus, including the housing 201, as well as the rotary drill bit 245 to do the same, which drills a straight hole.

When the operator wants to turn, he pulls back on the drill stem, which pulls back on the shaft 203 causing it to be displaced relative to the housing 201. At the same time the shifting cam follower 235 rotates the shifting cam 225. The drill stem can be rotated which rotates the shaft 203, which in turn rotates the drilling apparatus until the desired rotational direction is reached. Then pushing forward the shifting cam follower 235 rotates the shifting cam 225 and the clutch means 241 is disengaged from 227. The forward displacement is stopped when the shifting cam follower 235 hits the forward stop 217. With the housing held rotationally in place by the friction arms 219, the drill stem, the shaft 203, and rotary drill bit 245 are rotated and thrust forward cutting the hole. Since at least one wear pad 209 and/or 211 lies outside of the cutting diameter of the rotary bit 245, the protruding wear pad 209 and/or 211 contacts the wall causing the drilling apparatus to be deflected in the opposite direction. While the curved hole is being drilled a hole opener 243 on the rear of the drilling apparatus is enlarging the hole, which is also true when a straight hole is being drilled, but to a lesser extent, because a straight hole is bigger than a curved hole. The curved hole can be cut until the operator chooses to drill straight. When he does desire to drill straight, he pulls back on the drill stem for at least five feet, which positions the entire drilling apparatus in the enlarged hole. While pulling back the shaft 203 and shifting cam follower 235 are displaced relative to the housing 201 and the shifting cam 225. This causes the shifting cam follower 235 to rotate the shifting cam 225 and the clutch means 241 and 227 to engage. The drill stem is then pushed forward which causes the shaft 203, the shifting cam follower 235 and the male clutch means 241 to be displaced relative to the housing 201, the shifting cam 225 and the female clutch member 227. The shifting cam follower 235 hitting the grooves 225C (FIG. 90) in the shifting cam 225 stops the forward displacement. In this position the clutch members 241 to 227 are still engaged which causes the housing 201 to rotate and the bore to be drilled straight. The drill stem is now thrust forward and rotated which causes the entire drilling apparatus to be rotated and thrust forward. The resulting bore is relatively straight and of a larger diameter than the diameter of the rotary drill bit 245. The operator knows that he is drilling straight, if while he is drilling the transmitter is indicating that the housing 201 is rotating and conversely he is turning if the transmitter indicates that the housing 201 is not rotating.

After the bore has reach its destination the drilling crew may wish to enlarge the hole using a hole-opener. If so, they would use a system that attaches rotational cutting means to a hole-opener in a manner similar to the way the rotational cutting means 105 were attached to the shaft retainer 155. (NOTE: the rotational cutting means may be one or more of any style on the market, including roller cones and bullet teeth, with the only change being the mounting shank made special for this application.)

Referring to FIGS. 96–106 the rotational cutting means 251 are individual wings positioned on the hole-opener body 249 in radial positions to form a hole-opener 255. Four slots 249S are cut lengthwise into the hole-opener body 249. On the front and rear of the hole-opener body 249 are cut eight slots 249LS perpendicular to the slots 249S such that they leave behind a lip 249L corresponding to the front and rear of each slot 249S. Two dowel-pin holes 249P are drilled perpendicular to each slot 249S such that they are in a position to allow dowel-pins 253 to lock the rotational cutting means 251 in place. The dowel-pin holes 249P are drilled so that the dowel-pins 253 can be inserted and extricated from the direction of rotation such that upon rotation in the proper and common direction, the dowel-pins 253 will not be pushed out of the dowel-pin holes 249P. Smaller diameter hole portions are formed in the body 249 on the other side of each slot to allow the dowel-pins 253 to be pressed out. On the front of the hole-opener body 249 are four openings 249H that allow water or other medium to escape from inside the hole-opener body 249. The rotational cutting means 251 have a section behind the actual cutting area 251C that is called the shank 251S. The shank 251S is of a shape that will fit into one of the slots 249S with little clearance. On the front is a front hook 251F. On the rear is a rear hook 251R. Two dowel-pin holes 251P are drilled in the middle of the shank 251S. FIGS. 99–104 show the rotational cutting means 251 being mounted onto the hole-opener body 249 in steps. First the shank 251S is held in line with the slot 249S, then lowering the rear end of the shank 251S so that the rear hook 251R is engaged with the rear lip 249L of the hole-opener 249. Then the rotational cutting means 251 is rotated downwards into the slot 249S until it comes to rest in the bottom of the slot 249S. In this position the rotational cutting means 251 can be pulled rearwards. This engages the front hook 251F with the front lip 249L and lines up its dowel-pin holes 251P with the dowel-pin holes 249P in the hole-opener body 249. Then dowel-pins 253 are inserted into each dowel-pin hole 249P. With the rotational cutting means 251 attached to the hole-opener body 249 the hole-opener 255 is ready for use.

To use this hole-opener 255 the drilling crew would attach the hole-opener 249 body to the drill-string 175D. Then the drill rig operator would rotate the drill string 175D and begin to pull the hole-opener 255 through the previously bored hole 257 leaving behind an enlarged hole 259. (NOTE: the hole-opener 255 can be mounted and used to be pulled through the previously bored hole or it can be mounted and used to be pushed through the previously bored hole.)

In hole-opener 255, four slots 249S were used and in the shaft retainer 155 three slots 155S were used. If desired as few as only one slot 249S maybe used in the hole-opener 255 and also only one slot 155S may be used in the shaft retainer 155. If only one slot 249S is used in the hole-opener 255 or if only one slot 155S is used in the shaft retainer 155 the single rotational cutting means 105 or 251 would cut the entire diameter when rotated in a complete revolution.

Figure 108:
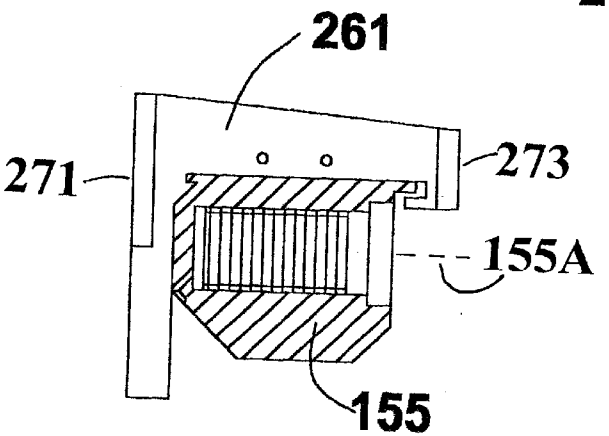
FIG. 108 illustrates a single roller cone but attached to a plate holding mechanism installed in a single slot of a shaft retainer.
Figure 107:
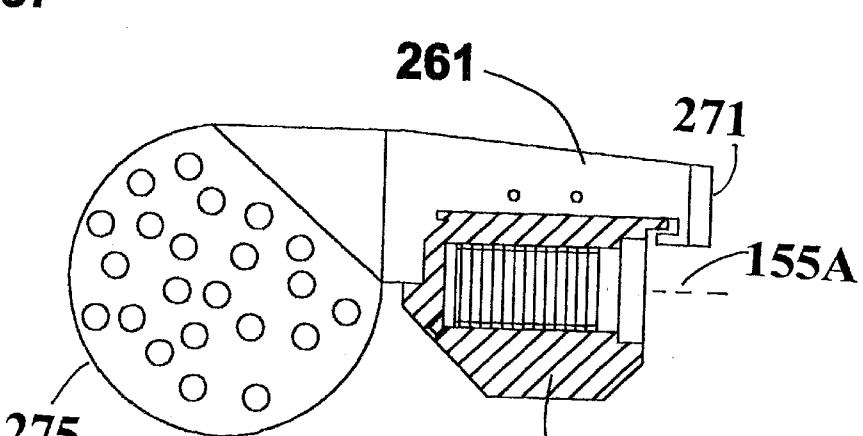
FIG. 107 illustrates a single modified wing type cutting means installed in a single slot of a shaft retainer.

In the single slot shaft retainer 155 a different version of the rotational cutting means 105 may be more desirable. In this version the rotational cutting means 261 would extend across the desired diameter of the hole as in FIGS. 107 and 108. In FIG. 107 cutting edges are shown at 217 and 273 and 155A is the axis of rotation. In FIG. 108, a cutting edge is shown at 271 and member 275 is a roller cutting cone.

What is claimed is:

1. A drill device for forming a hole in the earth, comprising:

a drill bit body having a front end and a rear end with a central axis extending between said front and rear ends and being connectable to a rotatable means, a plurality of angularly spaced apart slots formed in the exterior of said body which are located outward relative to said central axis and extend between said front and rear ends, each slot having a lip extending from each of its said front and rear ends respectively, a cutting means for each of said slots, with each of said cutting means comprising a connecting portion to be located in said slot with a forward end and a rearward end, each connecting portion comprising a hook near each of its said forward and rearward ends respectively for connection to said lips of said slot in which said connecting portion is located, a removable stop positioned to prevent longitudinal movement of said connecting portion of each said cutting means relative to its said slot.

2. The drill device of claim 1, wherein:

each of said slots comprises two spaced apart walls with a wall aperture formed in each of said walls, an aperture formed through said connecting portion of said cutting means for alignment with said wall apertures when said connecting portion of said cutting means is located in its said slot, said removable stop of each of said cutting means comprises a pin adapted to extend through said aperture formed through said connecting portion of said cutting means and to be located in at least one of said wall apertures of said slot in which said connecting portion of said cutting means is located.

3. The drill device of claim 1 wherein each of said cutting means comprises a blade.

4. The drill device of claim 1 wherein lips in each slot face in opposite directions relative to each other.

5. A drill device for forming a hole in the earth, comprising:

a body having a front end and a rear end with a central axis extending between said front and rear ends and being connectable to a rotatable means, at least one slot formed in the exterior of said body which is located outward relative to said central axis and extends between said front and rear ends, said at least one slot having a lip extending from each of its said front and rear ends respectively, a cutting means for said at least one slot and comprising a connecting portion to be located in said at least one slot with a forward end and a rearward end, said connecting portion comprising a hook near its said front and rear ends respectively for connection to said lips of said at least one slot, a removable stop positioned to prevent longitudinal movement of said connecting portion of said cutting means relative to said at least one slot.

6. The drill device of claim 5, wherein:

said at least one slot comprises two spaced apart walls with a wall aperture formed in each of said walls, an aperture formed through said connecting portion of said cutting means for alignment with said wall apertures when said connecting portion of said cutting means is located in said at least one slot, said removable stop of said cutting means comprises a pin adapted to extend through said aperture formed through said connecting portion of said cutting means and to be located in at least one of said wall apertures of said at least one slot.

7. The drill device of claim 5 wherein each of said cutting means comprises a blade.

8. The drill device of claim 5 wherein said lips in said at least one slot face in opposite directions relative to each other.

* * * * *